US007578775B2

(12) United States Patent
Terry

(10) Patent No.: US 7,578,775 B2
(45) Date of Patent: Aug. 25, 2009

(54) PERSONAL EXERCISE SYSTEM

(76) Inventor: Douglas C. Terry, 2248 Cottonwood Cove La., SLC, UT (US) 84121

( * ) Notice: Subject to any disclaimer, the term of this patent is extended or adjusted under 35 U.S.C. 154(b) by 53 days.

(21) Appl. No.: 10/934,669

(22) Filed: Sep. 3, 2004

(65) Prior Publication Data

US 2006/0052223 A1 Mar. 9, 2006

(51) Int. Cl.
*A63B 21/00* (2006.01)

(52) U.S. Cl. ..... 482/126; 482/121

(58) Field of Classification Search ..... 482/121–126, 482/81–82

See application file for complete search history.

(56) References Cited

U.S. PATENT DOCUMENTS

| | | | | |
|---|---|---|---|---|
| 437,822 | A | 10/1890 | Reach | |
| 2,448,384 | A | 8/1948 | Meinzinger | |
| 3,117,781 | A | 1/1964 | Vargo | |
| 3,256,015 | A | 6/1966 | Perrin | |
| 3,355,171 | A | 11/1967 | Oesau | |
| 4,059,265 | A | 11/1977 | Wieder et al. | |
| 4,195,835 | A | 4/1980 | Hinds et al. | |
| 4,245,839 | A | 1/1981 | Trent | |
| 4,293,125 | A | 10/1981 | Hinds | |
| 4,316,610 | A | 2/1982 | Hinds | |
| 4,326,708 | A | 4/1982 | Hinds | |
| 4,328,964 | A | 5/1982 | Wells | |
| D277,218 | S | 1/1985 | Hinds | |
| 4,779,867 | A * | 10/1988 | Hinds | 482/126 |
| 5,505,677 | A | 4/1996 | Hinds | |
| 5,549,532 | A | 8/1996 | Kropp | |
| 5,637,066 | A | 6/1997 | Chang | |
| 5,637,099 | A | 6/1997 | Durdin et al. | |
| 5,681,248 | A * | 10/1997 | Vani | 482/126 |
| 5,735,776 | A * | 4/1998 | Swezey et al. | 482/91 |
| 5,746,687 | A | 5/1998 | Vial et al. | |
| 5,800,322 | A | 9/1998 | Block | |
| 5,846,170 | A | 12/1998 | Ho | |
| 5,885,196 | A | 3/1999 | Gvoich | |
| 5,911,535 | A | 6/1999 | Gvoich | |
| 6,129,650 | A | 10/2000 | Wedge | |
| 6,267,711 | B1 | 7/2001 | Hinds | |
| 6,319,179 | B1 | 11/2001 | Hinds | |
| 6,398,698 | B1 | 6/2002 | Hinds | |
| 6,402,668 | B1 * | 6/2002 | Harker | 482/121 |
| 6,497,641 | B1 | 12/2002 | Hinds | |
| 6,544,152 | B2 | 4/2003 | Rosati | |
| 6,575,883 | B1 | 6/2003 | Hinds | |
| 6,648,804 | B2 * | 11/2003 | Chen | 482/125 |
| 6,663,544 | B2 | 12/2003 | Hinds | |
| 6,770,011 | B1 | 8/2004 | Hinds | |
| 6,979,286 | B1 * | 12/2005 | Hinds | 482/121 |
| 6,988,978 | B1 * | 1/2006 | Nault et al. | 482/126 |

* cited by examiner

*Primary Examiner*—Fenn C Mathew
(74) *Attorney, Agent, or Firm*—Jeffery M. Lilliwhite, PC

(57) ABSTRACT

An exercise system includes an elastic cord assembly including an elastic and plugs. The elastic has a first and second end and a stretch between the first and second ends. One of the plugs is inserted into the first end and another one of the plugs is inserted into the second end. At least one strap assembly is slidably attached to the elastic cord assembly. The strap assembly includes a block having an aperture formed from one side to another side of the block forming an unbroken wall through the block. The strap assembly also includes a strap connected to the block in a manner that forms a loop in the strap. The plugs retain the strap assembly on the stretch of the elastic cord assembly between the first and second ends.

15 Claims, 40 Drawing Sheets

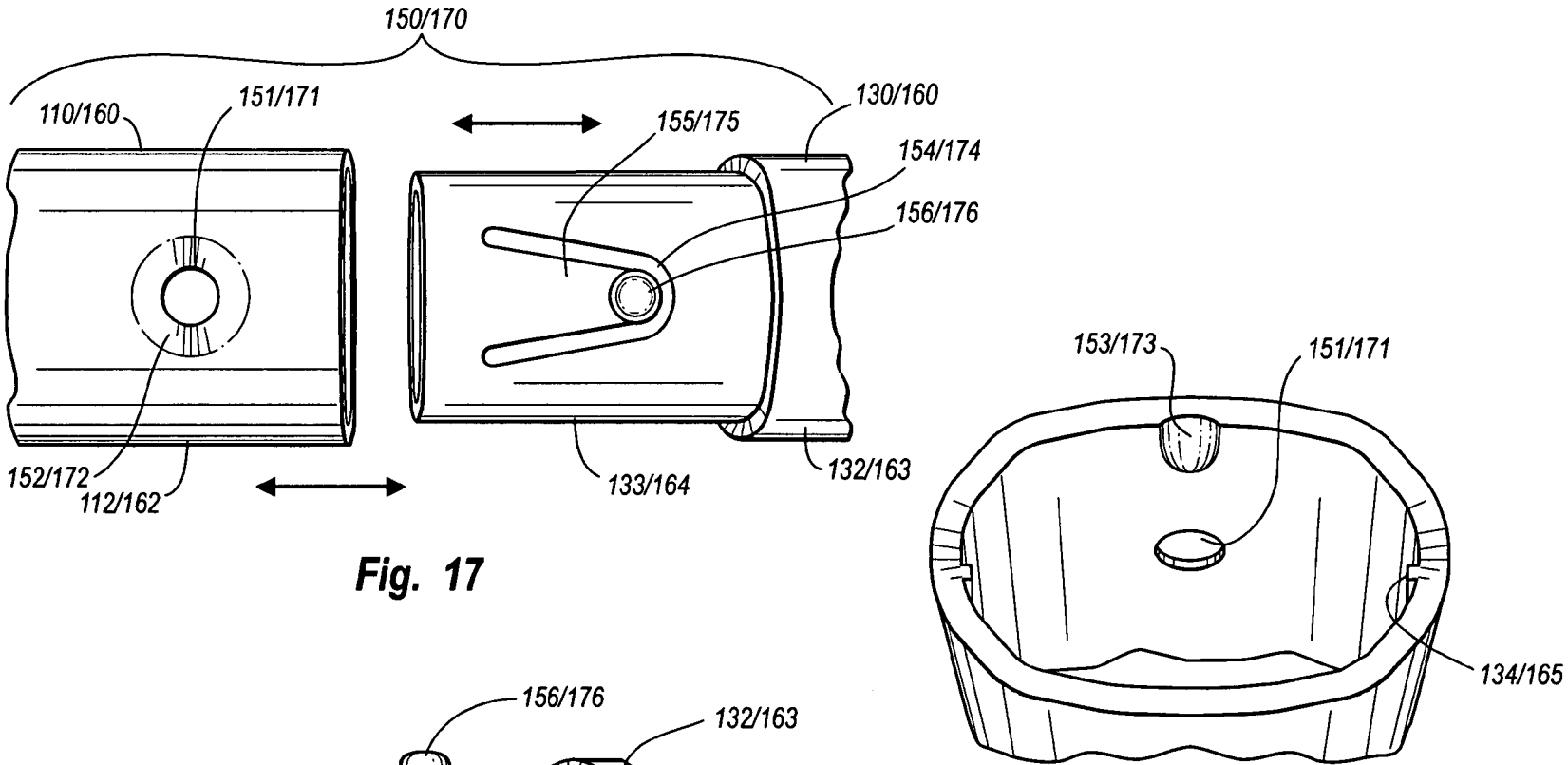
Fig. 17
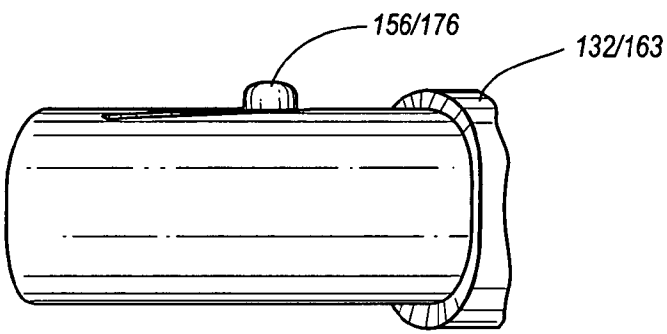
Fig. 18
Fig. 19

PERSONAL EXERCISE SYSTEM

BACKGROUND OF THE INVENTION

1. Field of the Invention

The present invention relates to exercise equipment, and more particularly, to a personal exercise system.

2. Discussion of the Related Art

Exercise systems intended to be used in different ways or configurations to perform different exercises are known. For example, an exercise system that includes an elastic cord and an associated bar has been sold for a period of time. In one device, the ends of the elastic cord are anchored in some manner to a bar with one mid-portion of the cord extending across the bar, through a grooved channel to accommodate the elastic cord. The cord is anchored to something, for instance, a user's feet or a door. Then the bar is tugged or pulled in different ways to stretch the elastic cord to exercise a user's muscles. The cord ends may terminate at any improvised connection system; for example, either a strap impinged in the crack of a door or in any one of several securing mechanisms present on a wall-mounted assembly. The cord ends had handgrips connected to them. The handgrips were inserted into the ends of the bar. The operator may put his or her feet in the handgrips to hold them and stretch the cord's mid-portion upwards by appropriate use of the bar.

In another arrangement, the mid-portion of the cord may be secured to a door or wall by any means. The mid-portion of the cord may also be self-anchored by standing on it. In either arrangement, it is quite common for the operator to grasp the opposing ends of the bar and raise it to a point far above his or her head while stretching the cord. In either arrangement, the assembly becomes a convenient portable substitute for cumbersome weight-lifting apparatus.

One can also wrap a portion of the elastic cord around the ends of the exercise bar in order to shorten the cord's length. The technique could be employed in either of the above-mentioned modes of exercise operation. If the cord's mid-portion, for example, were along or within a groove of the bar, opposing portions of the cord would be wrapped or twisted about the bar ends. If the handles at the cord ends are connected to the bar itself, the cord may be wrapped about the bar at its ends. By wrapping the cord about the bar ends to increase its resistance resulted in a torque built up. While exercising in this manner, the operator had to resist the torque that was created. That unwanted force tended to diminish the ordinarily sought-after benefits from operation of an elastically anchored lifting bar in either mode of exercise.

U.S. Pat. No. 437,822 to Reach shows a tug-of-war belt about which the rope would wrap. It did not have a bar or an elastic cord. U.S. Pat. No. 4,245,839 to Trent shows a tugging belt with the cord ends terminating in door crack impingement. U.S. Pat. No. 2,448,384 to Meinzinger shows a device to grasp a fishing line. U.S. Pat. No. 4,328,964 to Walls disclosed a handle similar to a tennis racquet or golf club with elastic cords connected to a door jam. The operator was to stretch the elastic cords by moving the handle. U.S. Pat. No. 4,195,835 to Hinds, et al. and U.S. Pat. No. 4,316,610 to Hinds, show an exercise bar 20 featuring means to effectually shorten a cable 24 by conveniently wrapping opposing sections of the cable around the end of bar 20. In U.S. Pat. No. 4,316,610, pins 92, 93 are inserted in sleeves 100, 101 until the end faces of bar sections 90, 91 are tightly abutted together.

U.S. Pat. No. 3,355,171 to Oesau discloses separate chains 14, 16 in lieu of a continuous elastic cord anchored to the anchor bar 12 the operator stood upon. U.S. Pat. No. 3,117, 781 to Vargo featured a bar 9, which includes an inextensible cord 17 anchored into a platform 1 upon which the user stood. In U.S. Pat. No. 3,256,015 to Perrin, the cord 25 ends are fastened by interweaving them through holes 21 drilled in the extension or bar 20 so that the operator could exercise by standing upon the cord's mid-portion. U.S. Pat. No. 4,059,265 to Wiede, et al. featured a hollow bar 13 with which connection was accomplished by running the cord 11 ends longitudinally in opposition through passages 15 within the bar 100. Again, the user stood upon the cord's mid-portion during exercise.

Finally, U.S. Pat. No. 4,779,867 to Hinds featured an exercise bar 17 with a cord 11 anchored to the ends of the bar 17. Bar 17 was formed in halves joined by a suitable locking mechanism (see col. 2, line 65). The bar 17 included a groove 19 along its length for the cable 11. At the ends of the bar 17 are lugs 24 for wrapping the cable 11.

In U.S. Pat. No. 4,779,867, Hinds discloses a pair of stirrups 12 that are placed within receptacles 30. This arrangement was bulky, and the stirrups could be oriented only in a direction transverse to the bar 17 because of the interfering presence of lugs 24.

The related devices are limited to specific exercise orientations since they implement restricted arrangements and straps. Furthermore, a user cannot easily emplace the elastic cord in any radial position within a socket of the bar end when the bar end has pegs to enwrap the cord.

SUMMARY OF THE INVENTION

In one embodiment of the invention, an exercise system includes an elastic cord assembly having an elastic and end plugs. The elastic has a first and second end and a stretch between the first and second ends. One of the plugs is inserted into the first end, and another one of the plugs is inserted into the second end.

The exercise system also includes at least one strap assembly slidably attached to the elastic cord assembly. The strap assembly includes a block having an aperture formed from one side to another side of the block forming an unbroken wall through the block. The strap assembly also includes a strap connected to the block in a manner that forms a loop in the strap. The plugs retain the strap assembly on the stretch of the elastic cord assembly between the first and second ends.

In another embodiment of the invention, a handle is provided that includes a frame having a first strut, a second strut, a grip support and a connection segment, The first and second struts extend out from the connection segment in opposing directions. The grip support is positioned between the first and second struts on an end of the frame opposing the connection segment. The connection segment includes at least two ports configured to receive an end of an elastic cord assembly. A grip is disposed on the grip support.

A further embodiment of the invention provides a beam assembly. The beam assembly includes a receiver section having a connector end and a receiving end. A first connector is provided at the connector end of the receiver section. The first connector includes a rounded wall that extends above the receiver section, an opening provided through the first connector and a slot sized to allow an elastic cord assembly to slip into the first connector. A tongue section includes a connector end, a tongue end and a recess section. The tongue end is configured to match and connect with the receiving end of the receiver section. A second connector is provided at the connector end of the tongue section. The second connector includes a rounded wall that extends above the tongue section, an opening provided through the second connector and a slot sized to allow an elastic cord assembly to slip into the second connector.

Also, provided in the beam assembly is a locking mechanism that includes an aperture and a depression on the receiver section. The depression is tapered from an inner surface of the receiver section out to an outer surface of the receiver section. The locking mechanism further includes a parabolic groove, a cantilevered segment and a knob. The parabolic groove is formed on the recess section of the tongue section and arranged to face the opening of the parabolic shape away from the tongue section to provide the cantilevered segment. The knob is provided on the end of the cantilevered segment.

In an alternative embodiment of a beam assembly a locking mechanism includes a set of male threads and a set of female threads. One set of male threads and female threads is arranged on one of the recess sections of the tongue section and the inner surface of the receiver section. The other set of male threads and female threads is arranged on the other one of the recess section of the tongue section and the inner surface of the receiver section. The locking mechanism is arranged so that when the receiver section and tongue section are connected together, the outer walls of the beam assembly are aligned.

In a further embodiment of the present invention, an exercise system kit is provided. The kit includes an elastic cord assembly having an elastic and plugs. The elastic has a first and second end and a stretch between the first and second ends. One of the plugs is inserted into the first end, and another one of the plugs is inserted into the second end. At least one strap assembly slidably attaches to the elastic cord assembly. The strap assembly includes a block having an aperture formed from one side to another side of the block forming an unbroken wall through the block. The strap assembly also includes a strap connected to the block in a manner that forms a loop in the strap.

The kit also includes a beam assembly having a receiver section, a tongue section and a locking device. One end of the receiver section is configured to be connected to one of the first and second ends of the elastic cord assembly, and the opposing end of the receiver section is configured to be connected to the tongue section. One end of the tongue section is configured to be connected to the other of the first and second ends of the elastic cord assembly, and the opposing end of the tongue section is configured to be connected to the receiver section.

These and other features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments of the invention, which are illustrated in the appended drawings. It is appreciated that these drawings depict only typical embodiments of the invention and are therefore not to be considered limiting of its scope. The invention will be described and explained with additional specificity and detail through the use of the accompanying drawings in which:

FIG. 17 is a partial view of a beam assembly illustrating an embodiment of a locking mechanism in accordance with the present invention;

FIG. 18 is a side view of the locking mechanism of FIG. 17;

FIG. 19 is a perspective end view of a receiver section in accordance with an embodiment of the present invention;

DESCRIPTION OF THE PREFERRED EMBODIMENTS

The subject of this application is a personal exercise system including various components, which may be implemented by a user in an array of exercises. It should be appreciated that different configurations can be used to achieve a given exercise; e.g., one component or any combination of components can be used. Although particular combinations are disclosed, variations on those combinations can be used to achieve the same exercise or exercise the same muscles.

Figure 1:
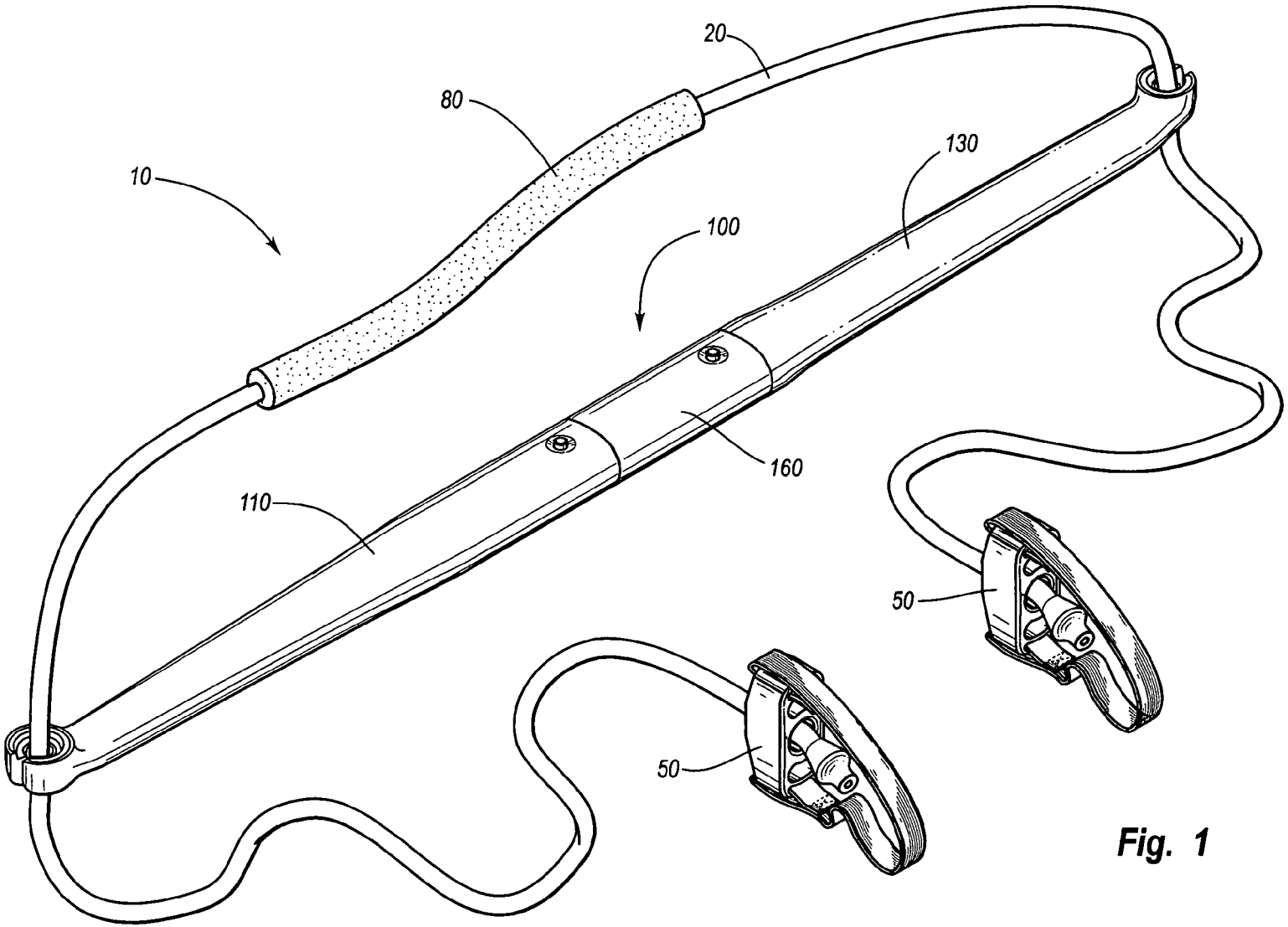
FIG. 1 is a perspective view illustrating some components of the personal exercise system in accordance with an embodiment of the present invention.
Figure 2:
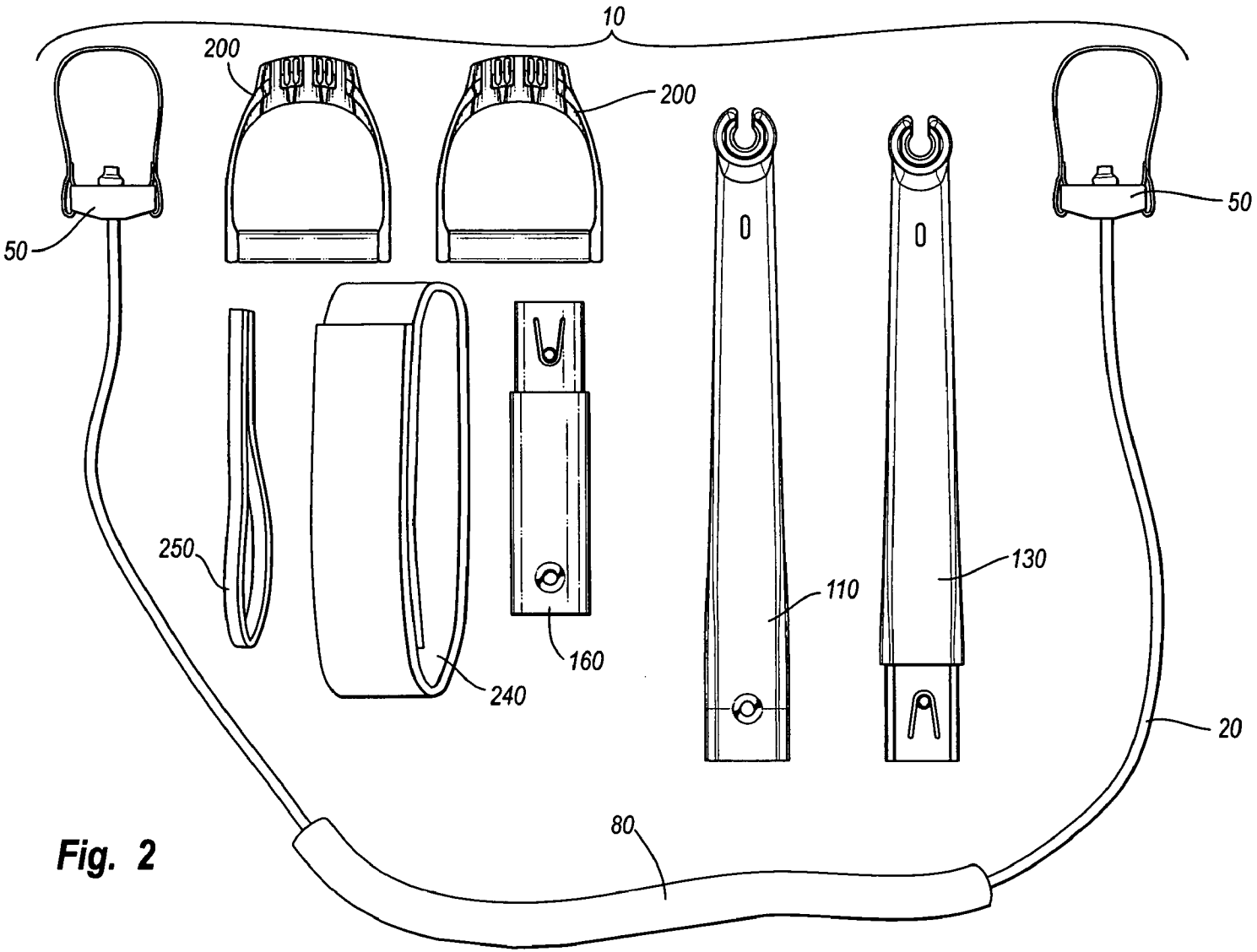
FIG. 2 illustrates the unassembled components of the personal exercise system in accordance with an embodiment of the present invention.

As illustrated in FIGS. 1 and 2 of the present invention, various components are used in a personal exercise system 10. The personal exercise system 10 can include any combination of an elastic cord assembly 20, a strap assembly 50, a cushioning device 80, an identifying device 90, a beam assembly 100, an extension 160, a handle 200, a waist strap 240 and a door strap 250. In the preferred embodiment, the personal exercise system 10 includes at least the elastic cord assembly 20 and the strap assembly 50.

Figures 3, 4:
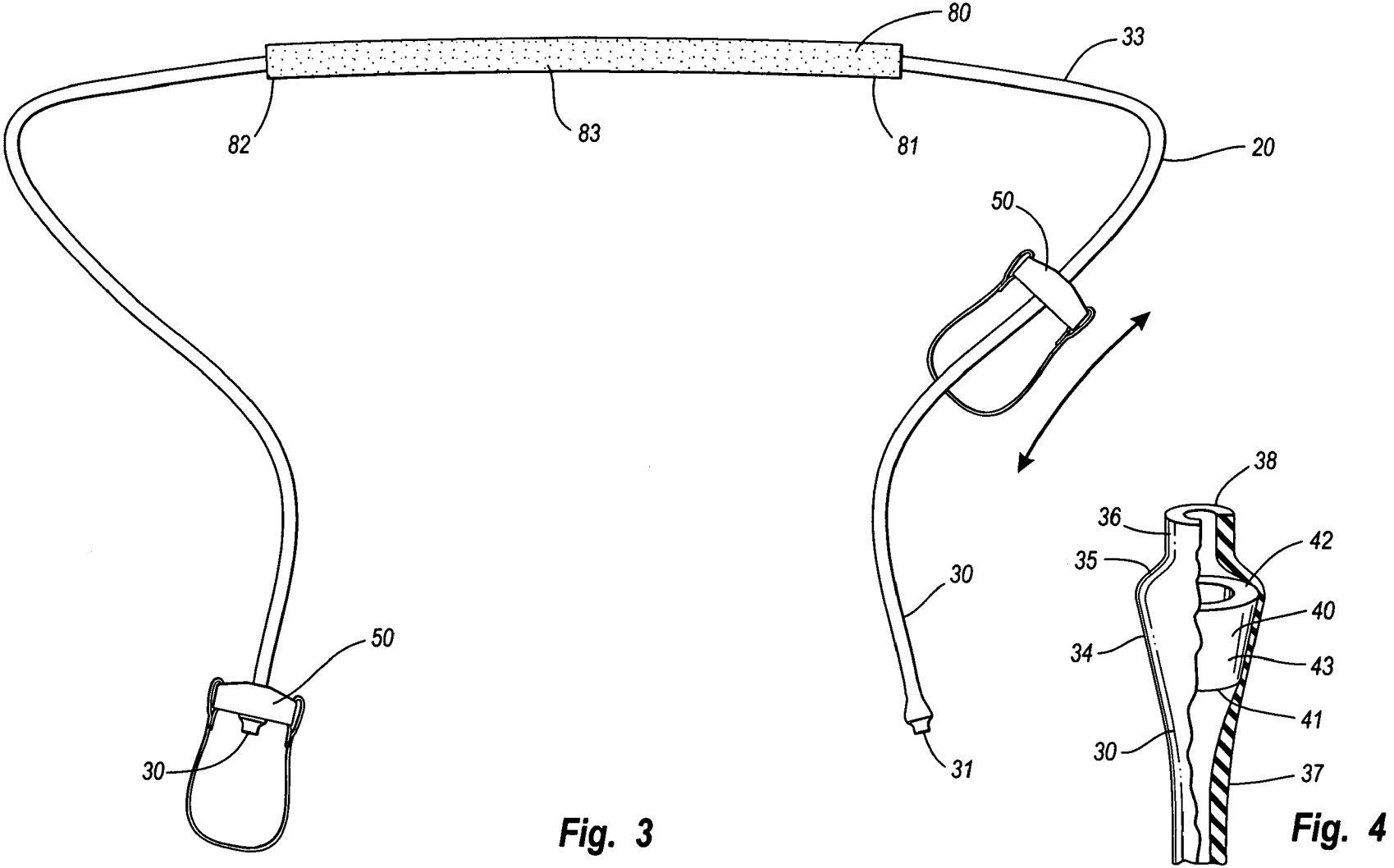
FIG. 3 is a perspective view of an elastic cord assembly in accordance with an embodiment of the present invention.
FIG. 4 is a perspective cut-away view of an elastic and plug in accordance with an embodiment of the present invention.

As shown in FIGS. 3 and 4, the elastic cord assembly 20 includes an elastic 30 and a plug 40 on each end of the elastic 30. The elastic 30 is a length of stretchable material such as a cord or tube to provide elastic deformation when a user stretches the elastic cord assembly 20. In the preferred embodiment, the elastic 30 is made from surgical tubing. The elastic 30 includes a first end 31 and a second end 32 and a stretch 33 between the first and second ends 31, 32.

As shown in FIG. 4, each end of the elastic 30 includes a plug 40. The plug 40 is a rigid cylindrical device that fixes an end of the elastic 30 to another part of the personal exercise system 10. The plug 40 may be made from a plastic, ceramic, metal, composite or other known material to provide a rigid structure. The plug 40 includes an inner end 41, an outer end 42 and a tapered surface 43 between the inner and outer ends 41, 42.

Each end of the elastic 30 includes an outer surface 37 and a lumen or an end aperture 38. The lumen or end aperture 38 is provided in an end of the elastic 30. The plug 40 is sized to be larger than the aperture and is inserted into the end aperture 38 far enough to provide an extra length 36. The end aperture 38 may be separate apertures or lumens on each end of the elastic 30 or an aperture that runs through the entire elastic 30. Once the plug 40 is inserted into the elastic 30, the elastic 30 is deformed to provide a taper surface 34 at the end of the elastic 30. The taper surface 34 is formed by the shape of the tapered surface 43 of the plug 40. A transition surface 35 is formed between the taper surface 34 and the extra length 36.

Figure 5:
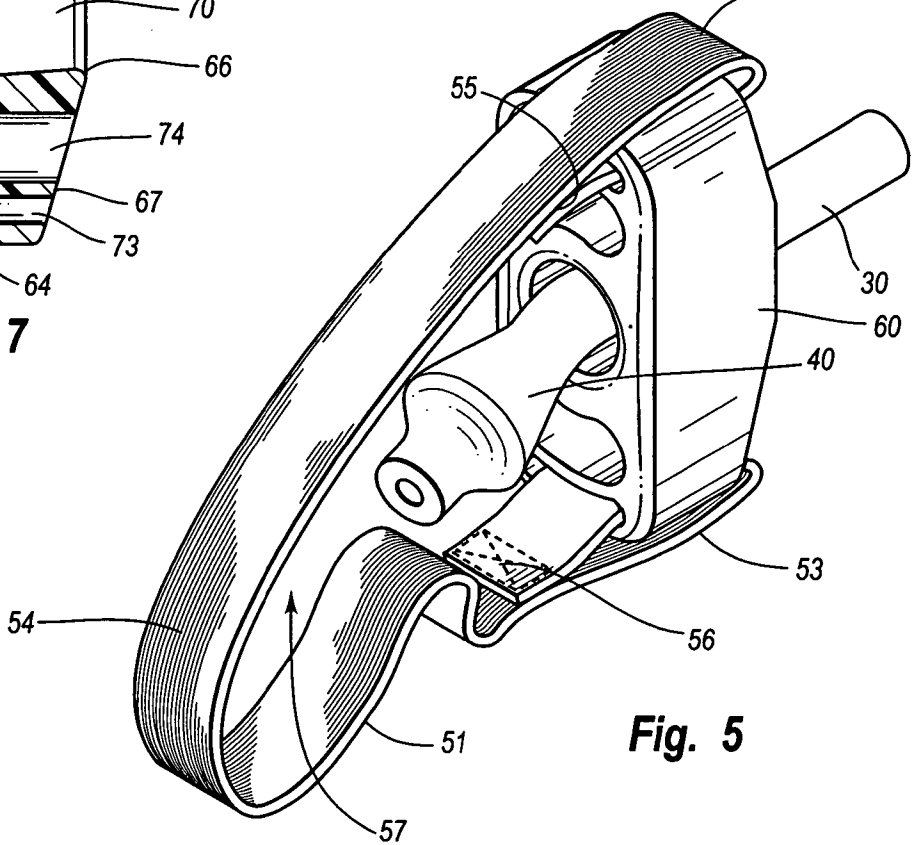
FIG. 5 is a partial perspective view of an elastic cord assembly and strap assembly in accordance with an embodiment of the present invention.

Referring to FIGS. 3 and 5, a strap assembly 50 is provided along the stretch 33 of the elastic 30. The strap assembly 50 may be positioned at any point along the stretch 33 to provide most favorable positioning for any given exercise. The strap assembly 50 includes a strap 51 and a block 60.

The strap 51 is made from a webbing, cloth, plastic or other known material to provide a pliable loop. The strap 51 includes a strap first end 52, strap second end 53 and a mid-section 54 between the strap first and second ends 52, 53. The strap 51 can have a width between about 1.3 centimeters to about 3.2 centimeters, and more preferably about 2.5 centimeters. The width of the strap 51 is sized to provide adequate surface area for a user to grasp and pull on the strap assembly 50 without having the strap 51 "cut into" the user's hand or foot. If the strap is too narrow, the greater forces would be concentrated on the palm, foot or fingers of a user's hand when he or she tugs or pulls on the strap assembly 50. A wider strap, such as one having a width of 2.5 centimeters, spreads the forces across the width of the strap 51. While the strap is here shown to be a flat and cloth-like, it may also be made of leather or of any suitable flexible material of sufficient strength. It may even be made of cloth in that is formed into a tubular shape or that deforms into a tubular shape. Any suitable material that can be used without causing the user discomfort is certainly adaptable to the use detailed herein.

Figure 7:
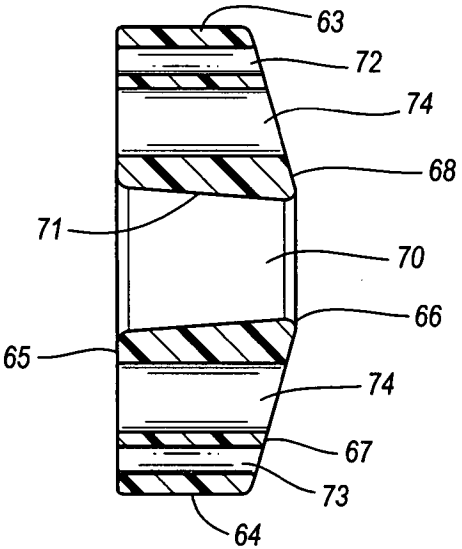
FIG. 7 is a side view of the block of FIG. 6.
Figure 6:
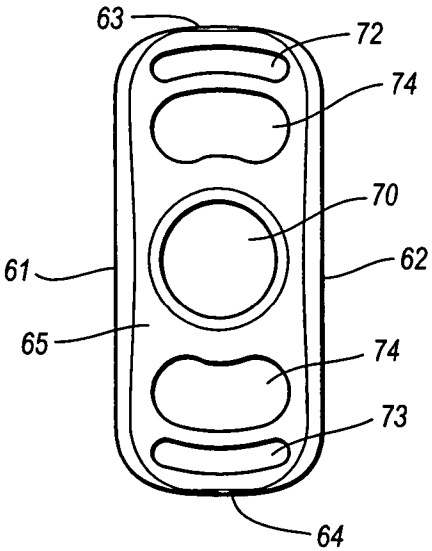
FIG. 6 is a top view of a block in accordance with an embodiment of the present invention.
Figure 8:
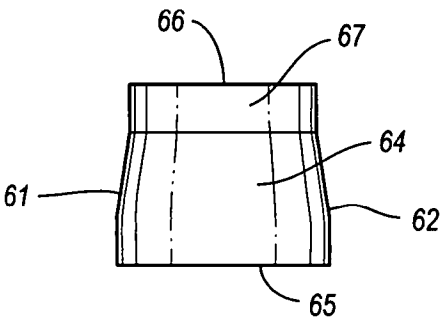
FIG. 8 is an end view of the block of FIG. 6.

As shown in FIGS. 6-8, the block 60 includes a first side 61, second side 62, third side 63, fourth side 64, fifth side 65 and a sixth side 66. The first side 61 opposes the second side 62. The third side 63, fourth side 64, fifth side 65 and sixth side 66 have edges that touch the first side 61 and second side 62. The fifth side 65 and sixth side 66 oppose each other and an aperture 70 extends from the fifth side 65 to the sixth side 66. A first sloping side 67 extends from the fourth side 64 to the sixth side 66. A second sloping side 68 extends from the third side 63 to the sixth side 66. A first strap aperture 72 is provided in the block 60 that extends from the fifth side 65 to the second sloping side 68. A second strap aperture 73 extends from the fifth side 65 to the first sloping side 67. The first and second strap apertures 72, 73 have an oval shape in the preferred embodiment of the present invention. The first and second strap apertures 72, 73 may also be shaped in round, square, rectangular configurations, or any shape that would provide a sufficient space to attach strap 51 to block 60. Molding apertures 74 are provided between the aperture 70 and first strap aperture 72 and the aperture 70 and second strap aperture 73. Other shapes of block are certainly equally adaptable to the use herein set forth.

The strap 51 is attached to block 60 by attaching the first strap end 52 to the first strap aperture 72 using a first fastener 55. The strap second end 53 is attached to the block 60 through the second strap aperture 73. The strap 51 is attached to block 60 in a way to form a loop 57 in the mid-section 54 of the strap 51.

The block 60 may be made of a plastic, metal, ceramic, composite or other known material to provide a rigid component and can be in any desired or suitable shape. In the preferred embodiment, the sixth side 66 is about 6.3 centimeters long and about 2.8 centimeters wide. The aperture 70 is tapered from about 1.9 centimeters on the fifth side 65 to about 1.6 centimeters on the sixth side 66. The taper in the aperture 70 forms a tapered wall 71 that is gradually tapered from the fifth side 65 to the sixth side 66 through the core of the block 60. In the preferred embodiment, the aperture 70 is formed having a continuous wall without any breaks slits or channels in the aperture 70. In this regard, the block 60 is not separated, either accidentally or intentionally, from the elastic 30, providing a safer device. The first side and the second side 61, 62 are about 6.3 centimeters wide and about 2.4 centimeters high at their longest portions.

To assemble the elastic cord assembly 20, the elastic 30 is inserted into the aperture 70 of the block 60. The block 60 of the strap assembly 50 is arranged so that the loop 57 is facing towards the first end 31 of the elastic 30. Then, the plug 40 is press fit into the first end 31. The process is repeated to the opposite end of the elastic 30. The second end 32 of the elastic 30 is inserted into the aperture 70 of another block 60. The other block 60 of the strap assembly 50 is arranged so that the loop 57 is facing towards the second end 32 of the elastic 30. Then, the plug 40 is press fit into the second end 32.

As shown in FIGS. 3-5, the elastic cord assembly 20 fits through the aperture 70 of the block 60. The block 60 can be slid along the stretch 33 to a most favorable position for a user. The plug 40 which creates taper surface 34 that is provided to rest in aperture 70 of the block 60. The plug 40 prevents the strap assembly 50 from sliding past the ends of the elastic 30. In this manner, a user can pull on the strap 51 of the strap assembly to stretch the elastic 30. The taper surface 34 is shaped at a similar slope to that of the tapered wall 71 of aperture 70. This fit provides a snug attachment when a user pulls on the elastic 30.

As shown in FIG. 3, a cushioning device 80 is slidably attached along the stretch 33 of the elastic 30. The cushioning device 80 includes a first end 81, a second end 82 and a mid-portion 83 between the first and second ends 81, 82. The cushioning device 80 is made from a foam or other supple material to provide adequate cushioning for a user operating the personal exercise system 10. For example, the cushioning device 80 may be formed in a flat or tube section. In the preferred embodiment, the cushioning device is a tube shape having an outer diameter and an inner diameter and thickness. The inner diameter creates a cavity large enough to slide the elastic 30 through the inner diameter. In the preferred embodiment, the thickness of the cushioning device 80 is about 0.5 centimeters. The inner diameter is about 1.5 centimeters and the outer diameter is about 2.5 centimeters providing a thickness of about 0.5 centimeters. The cushioning device 80 can be fixedly attached to a midpoint of the elastic 30 or slidably attached to the elastic 30. When the cushioning device 80 is slidably attached to the elastic 30, the cushioning device 80 can be moved between the first and second ends 31, 32 of the elastic 30 to optimize the point to be cushioned or move the cushioning device 80 to a position from a place where it may be in the user's way.

Figure 10:
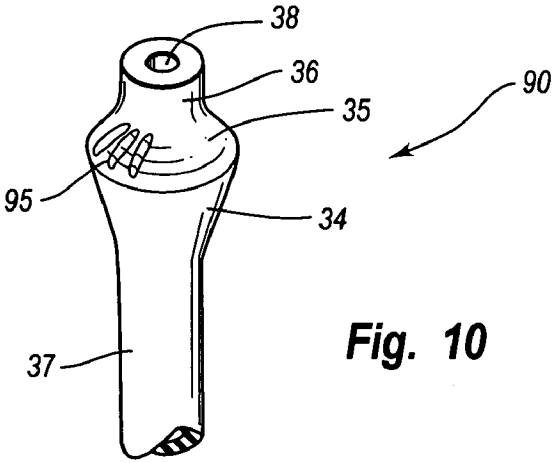
FIG. 10 is a perspective view of an end of an elastic cord assembly illustrating an identifying device in accordance with another embodiment of the present invention.
Figure 9:
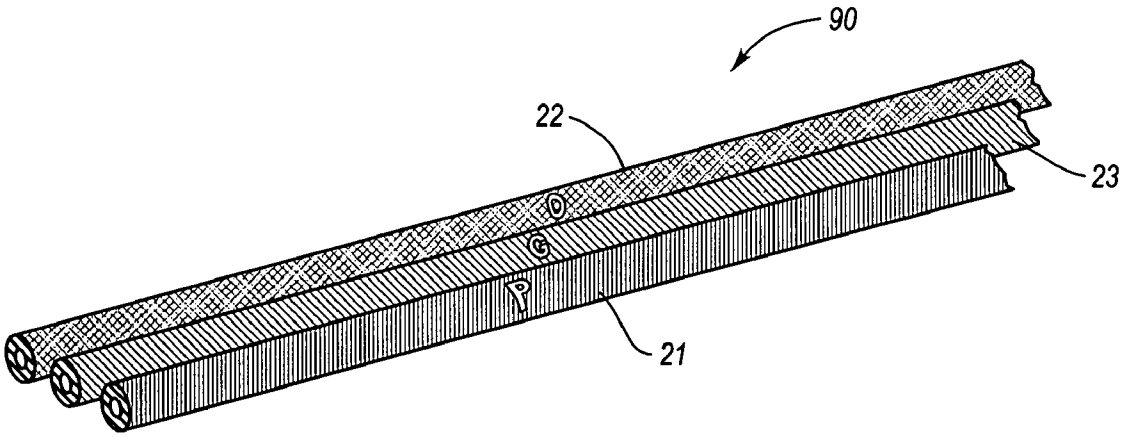
FIG. 9 illustrates an identifying device in accordance with an embodiment of the present invention.
Figure 11:
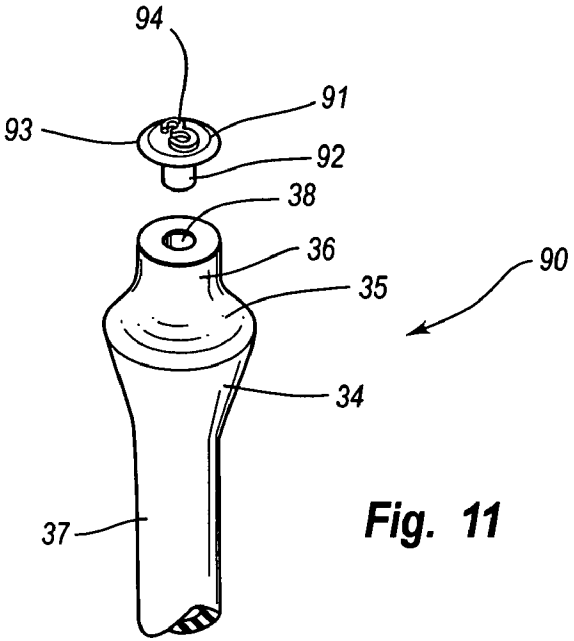
FIG. 11 is a perspective view of an end of an elastic cord assembly illustrating an identifying device in accordance with a further embodiment of the present invention.

The elastic cord assembly, as shown in FIGS. 9-11, can be provided with an identifying device 90 to distinguish one elastic cord assembly having an elastic with a specific elasticity from another. For example, the identifying device 90 can be the color of the elastic 30. A first elasticity characteristic 21 as shown in pink provides a low resistive characteristic of about 5 to about 10 pounds. A second elasticity characteristic 22 as shown in orange has a medium resistive characteristic of about 10 to about 15 to about 20 pounds. Further, a third elasticity characteristic 23 as shown in green has a high resistive characteristic of about 15 pounds. The three elasticity characteristics may be given any range of resistance. For the purpose of illustrating three separate characteristics, three different elastic cord assemblies are shown having different colors to identify a different elasticity characteristic. In this way, a user can determine which elastic cord assembly would be most favorable for a given exercise.

Other types of an identifying device 90 may be used to distinguish different types of elastic cord assemblies. As shown in FIGS. 10 and 11, identifying devices are used to identify an elastic cord assembly 20. With respect to FIG. 10, markings 95 are placed on the outer surface 37 of the elastic. Specifically, the transition surface 35 includes markings 95 that are raised up above the outer surface 37. These markings 95 may include symbols, numbers and other information that may be used to distinguish one elastic cord assembly from another.

As shown in FIG. 11, the identifying device can be an end cap 91 can identify a elastic cord assembly 20 having a given elasticity characteristic. Specifically, the end cap 91 includes an insert 92 having a surface 93 for placing indicia 94. The insert 92 is placed in the end aperture 38 and is sized to provide a tight fit. The surface 93 can be a substantially flat surface to provide the indicia 94. The surface 93 may be formed to conform with the extra length 36 of the elastic 30. The indicia 94 may include numbers, symbols or other identifying marks to distinguish one elastic cord assembly from another. For example, numbers 1-3 or L, M and H may be used to distinguish elastic characteristics that range between low, medium and high.

With respect to FIGS. 12A-15, a beam assembly 100 is provided as an optional component of the personal exercise system 10. The beam assembly 100 includes a first or receiver section 110, a first connector 120, a second or tongue section 130, a second connector 140 and a locking mechanism 150. Optionally, an extension 160 may be provided with the beam assembly 100. The beam assembly 100 includes rounded edges 101 to provide a better grip for a user operating the personal exercise system 10. The beam assembly 100 is preferably manufactured from plastic, a composite material such as carbon fiber, a metal or other known rigid material. The material used to make the beam assembly may be any material known to one skilled in the art that provides a light-weight rigid structure. The beam assembly 100 optionally includes molding apertures 102 along the surfaces of the beam assembly 100. The molding apertures 102 are provided to assist in the molding process to form the components of the beam assembly 100. The molding apertures 102 are shown as slots or ovals, but may be in the shape of circles to alleviate any internal stresses in the beam assembly 100.

Figure 12A:
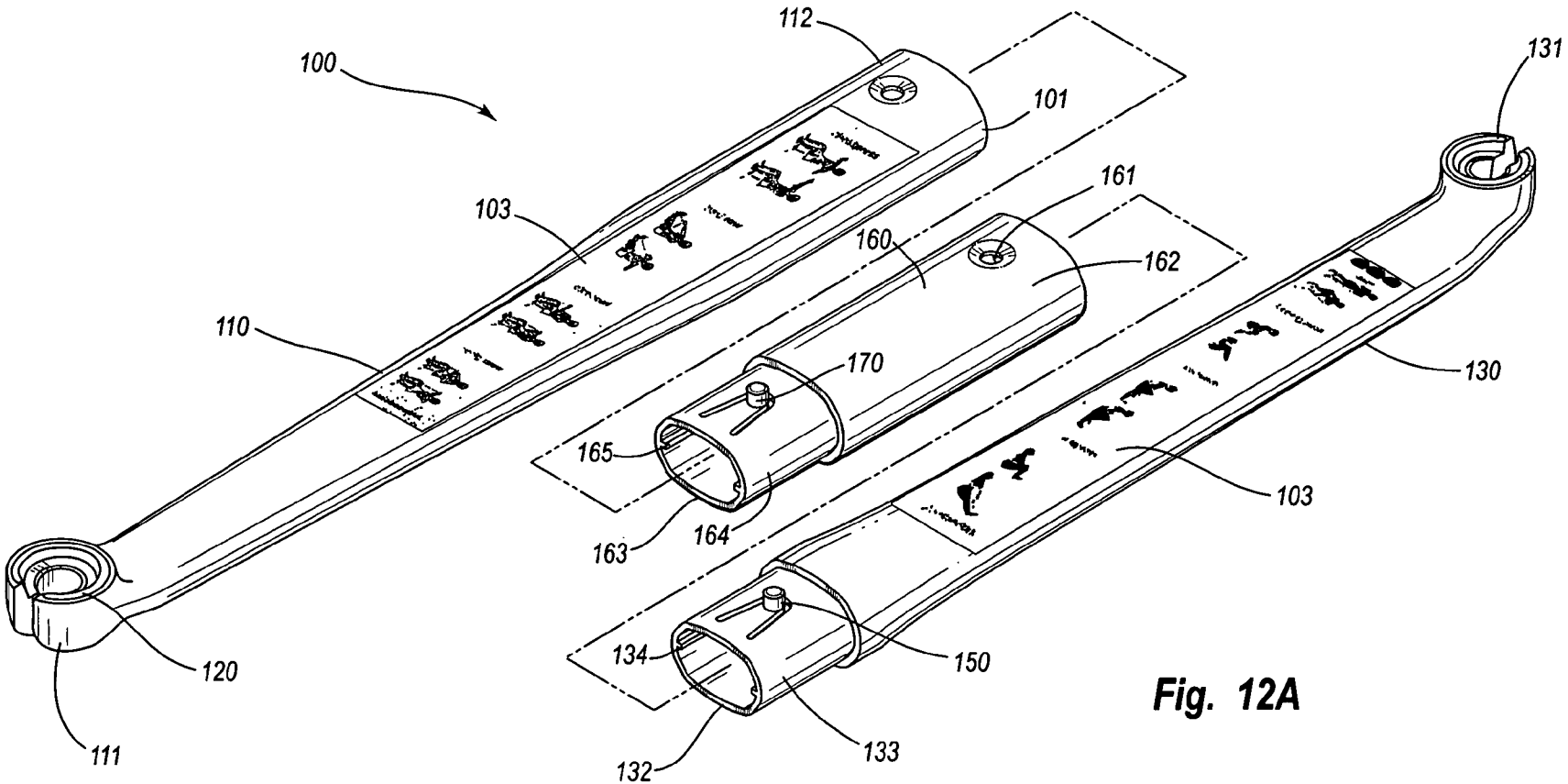
FIG. 12A-B are exploded views of a beam assembly in accordance with an embodiment of the present invention.
Figure 12B:
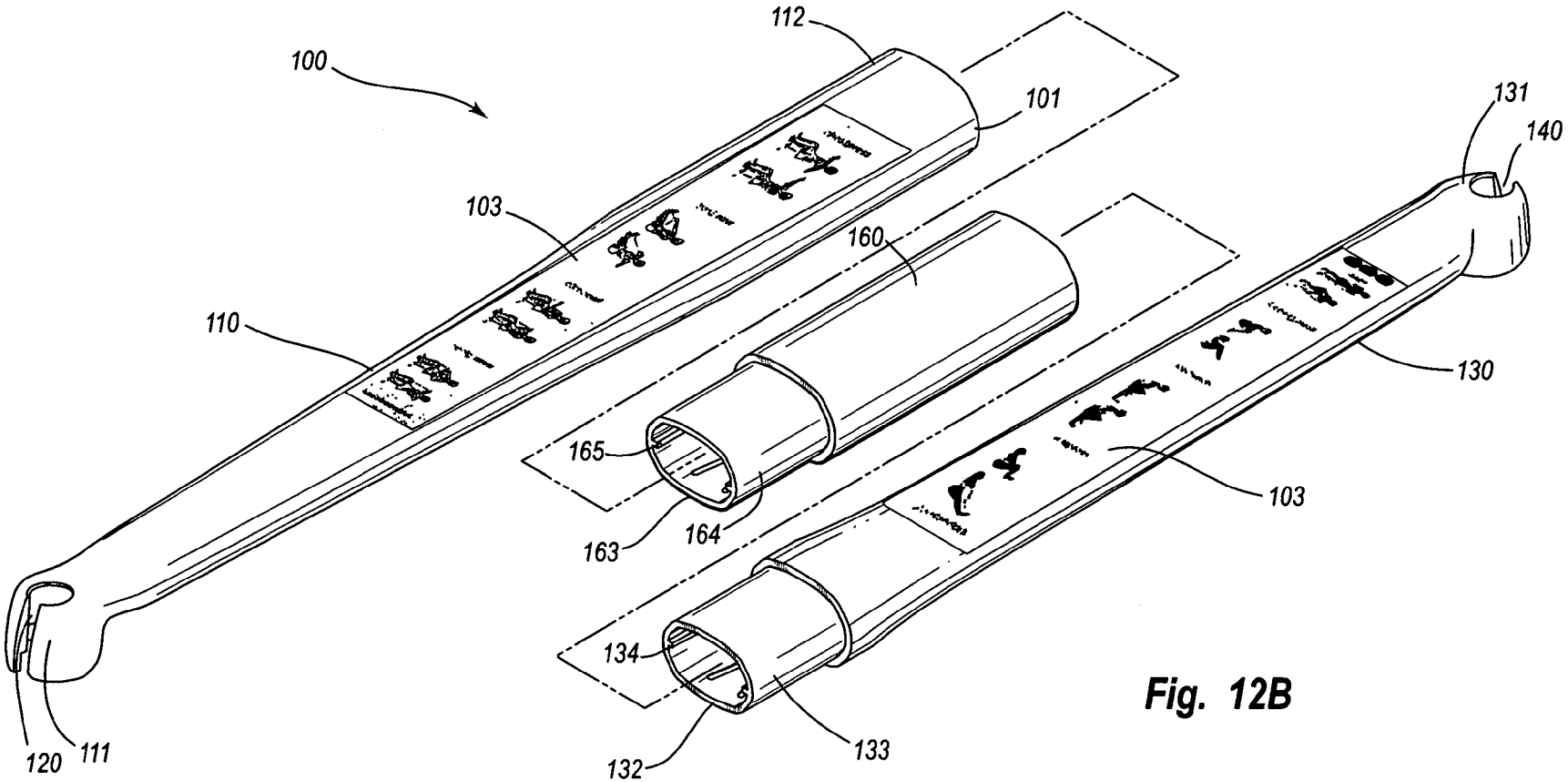
Figure 13:
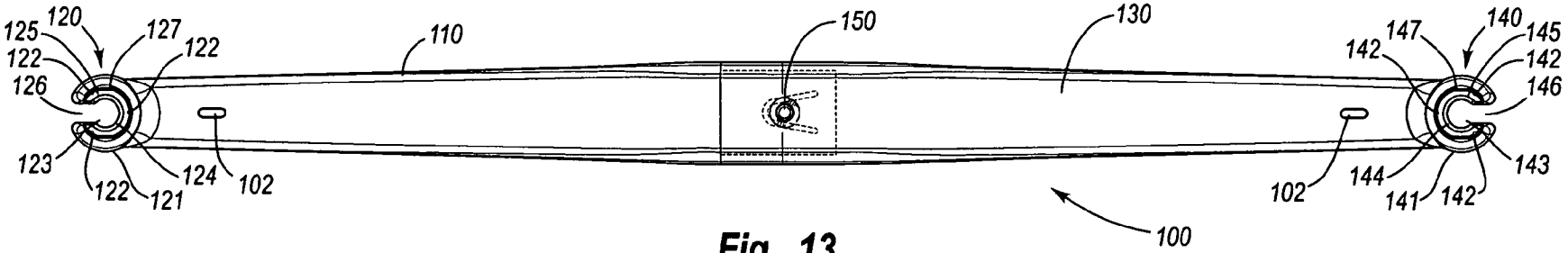
FIG. 13 is a top view of a beam assembly without an extension.
Figure 14:
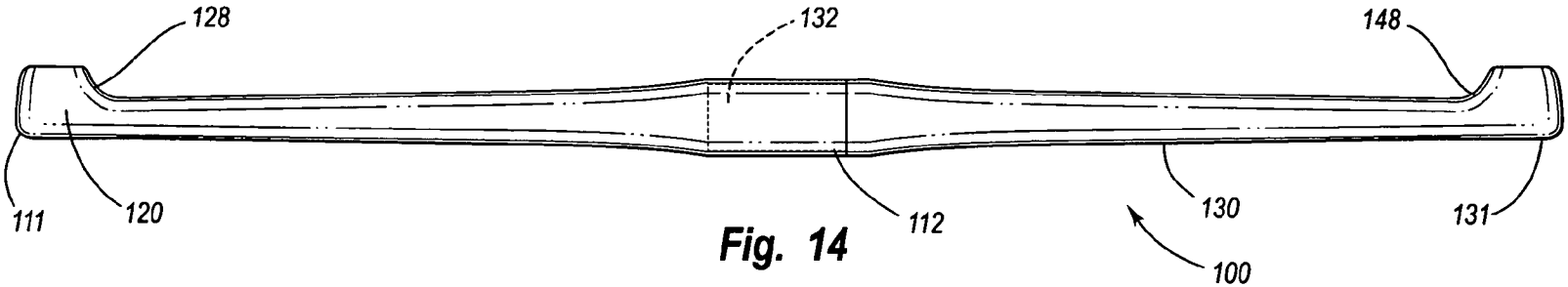
FIG. 14 is a side view of the beam assembly of FIG. 13.
Figure 15:
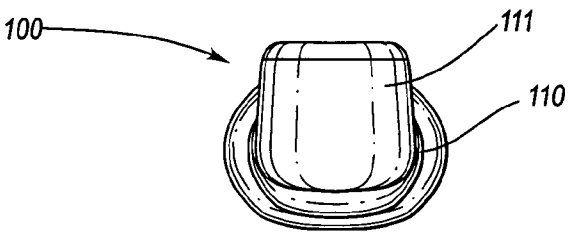
FIG. 15 is an end view of the beam assembly of FIG. 13.
Figure 16B:
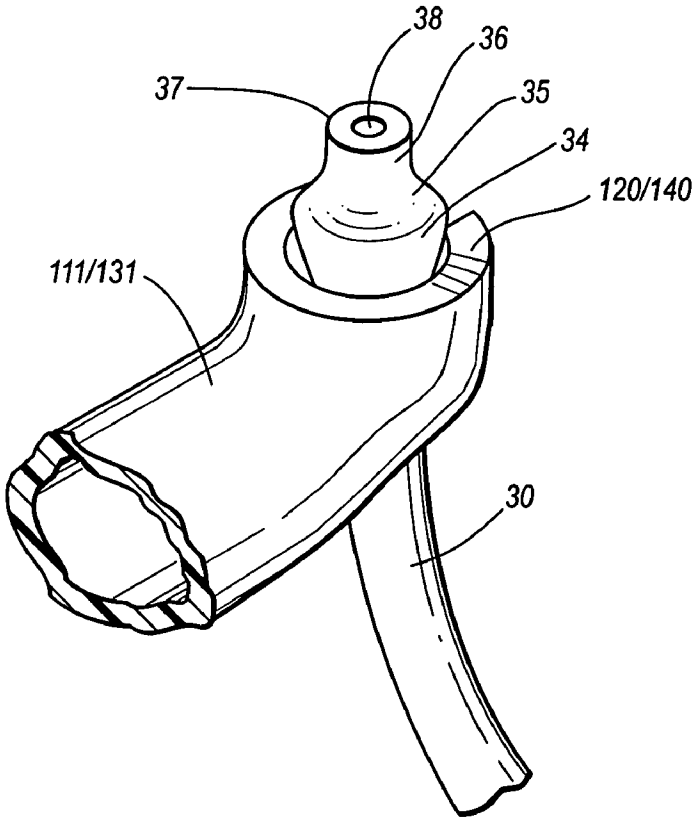
FIG. 16B is an assembled view of the elastic cord assembly and the connector of the beam assembly of FIG. 16A.
Figure 16A:
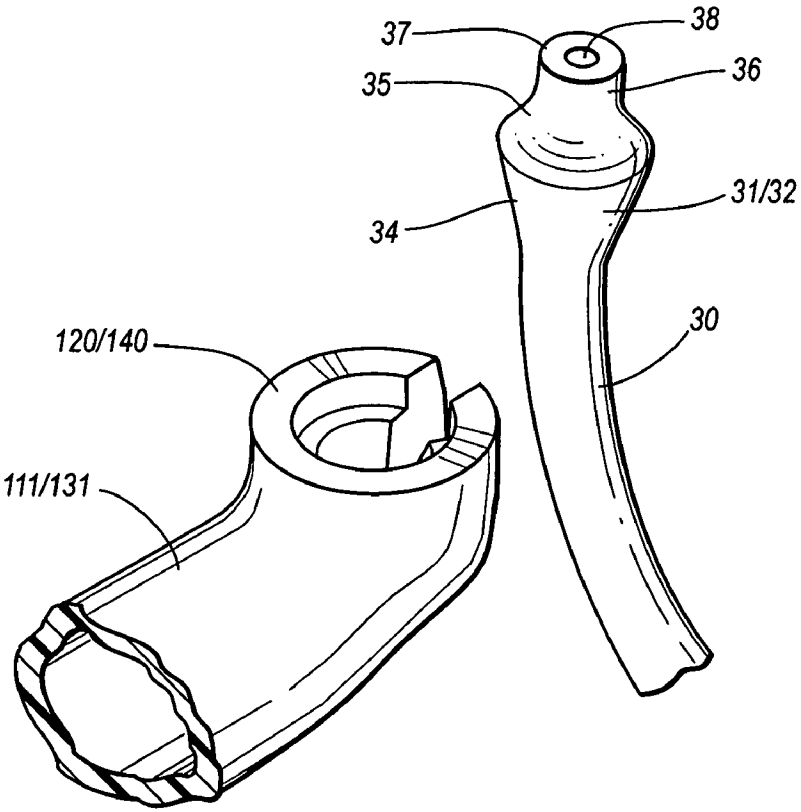
FIG. 16A is a disassembled view of an elastic cord assembly and a connector of a beam assembly in accordance with an embodiment of the present invention.

Indicia 103 may be attached to the larger widths of the beam assembly 100 as shown in FIGS. 12A-B. The indicia 103 can be applied to the surfaces of the beam assembly 100 in a variety of different ways. For example, a decal can include the indicia 103, which is adhered to the surfaces of the beam assembly 100. Other methods can be used to adhere the indicia 103 to the beam assembly 100, such as a silkscreen, molding techniques, or other methods known to place indicia on a surface. In the preferred embodiment, the beam assembly 100 provides two wide surfaces on opposing sides of the beam assembly 100 to place the indicia 103. The indicia 103 can be illustrations of how various exercises are accomplished. One improvement of the present invention is to provide two surfaces on opposing sides of the beam assembly 100 for placing indicia 103. Since there are so many combinations of available exercises, the indicia assists the users in setting up a varied work-out for the major muscle groups.

The receiver section 110 and tongue section 130 are provided with flat-like surfaces on at least two sides. The flat-like surfaces are sized to provide a surface for the indicia 103. For example, the flat-like surfaces can be sized to suit the indicia 103 having a length up to about 30.5 centimeters and a width up to about 4.5 centimeters on the beam assembly 100. Portions of each decal can be wrapped around the receiver and tongue sections 110, 130, respectively. The indicia 103 can also be placed on a tube-shaped piece of plastic that is wrapped around the receiver section 110 or the tongue section 130 by heat shrinking the plastic the respective portions of the beam assembly 100.

The first section or receiver section 110 has a length, width and height. The receiver section 110 includes a connector end 111 and a securement or receiving end 112. In the preferred embodiment, the length is about 41 centimeters, the width ranges between about 5.0 centimeters at the receiving end 112 and about 3.5 centimeters at the connector end 111, and the height ranges between about 3.5 centimeters at the receiving end 112 and about 1.8 centimeters at the connector end 111. The width is larger than the height to provide a better gripping surface for a user's hands. The thickness of the receiver section 110 can vary, but is generally in the range of about 2.0 millimeters.

As shown in FIGS. 13-16B, the first connector 120 is provided at the connector end 111. The first connector 120 includes a rounded wall that extends above the height of the receiver section 110. In addition, the first connector 120 includes an opening 123 having a tapered inner surface 124 for placing the outer surface 37 of the elastic 30 in the opening 123. A slot 126 is provided on the outer end of the first connector 120 that is sized to allow the elastic 30 to slip into the first connector 120. The first connector 120 also includes a ridge 122, ledge 125 and flat surfaces 127 for providing connector surfaces for the handle 200. The ridge 122, ledge 125 and flat surfaces 127 are optional for placement of other components in the first connector 120. A curvature 128 is provided between the rounded wall 121 and the receiver section at the connector end 111 to provide a smooth transition between the receiver section and the first connector 120.

In the preferred embodiment, the ledge 125 is positioned about 1.0 centimeters below the top of the rounded wall 121. The ledge 125 extends around the opening 123 and terminates at the slot 126. The tapered inner surface extends about 1.2 centimeters below the ledge 125. The opening ranges between about 2.0 centimeters at the ledge 125 to about 1.75 centimeters at the bottom of the opening 123. The width of the slot 126 is about 1.7 centimeters. The width of the ledge 125 is about 3.0 centimeters. The flat surfaces 127 are positioned above the ledge 125 on an inner surface of the rounded wall 121 at opposing ends and substantially parallel to the slot 126. The ridges 122 are placed on the inner surface of the rounded wall 121 at points between the slot 126 and the flat surfaces 127 and in between flat surfaces 127 opposite the slot 126.

The second or tongue section 130 has a length, width and height. The tongue section 130 includes a connector end 131 and a securement or tongue end 132. In the preferred embodiment, the length is about 41 centimeters, the width ranges between about 5.0 centimeters at the tongue end 132 and about 3.5 centimeters at the connector end 131, and the height ranges between about 3.5 centimeters at the tongue end 132 and about 1.8 centimeters at the connector end 131. The width is larger than the height to provide a better gripping surface for a user's hands. The tongue section 130 also includes a recess section 133 where the height of the recess section 133 is recessed below height and the width of the recess section 133 is recessed from width as shown in FIGS. 12A-B. Accordingly, the recess section 133 is smaller than the tongue section 130 by about 3.0 millimeters around all of the outer surfaces of the tongue section 130. The thickness of the tongue section 130 can vary, but is generally in the range of about 2.0 millimeters. Further, the tongue section 130 includes strengthening ribs 134 positioned along a portion of the length on the inner surface of the tongue section 130 to add additional rigidity to the beam assembly 100. The strengthening ribs 134 are positioned on opposing inner walls of the tongue section 130.

The second connector 140 is provided at the connector end 131, also illustrated in FIGS. 13-16B. The second connector 140 includes a rounded wall 141 that extends above the height of the tongue section 130. In addition, the second connector 140 includes an opening 143 having a tapered inner surface 144 for placing the outer surface 37 of the elastic 30 in the opening 143. A slot 146 is provided on the outer end of the second connector 140 that is sized to allow the elastic 30 to slip into the second connector 140. The second connector 140 also includes a ridge 142, ledge 145 and flat surfaces 147 for providing connector surfaces for a handle if the handle is configured to be inserted into the beam assembly 100. The ridge 142, ledge 145 and flat surfaces 147 are optional for placement of other components in the second connector 140. A curvature 148 is provided between the rounded wall 141 and the tongue section 130 at the connector end 131 to provide a smooth transition between the tongue section 130 and the second connector 140.

A locking mechanism 150, as shown in FIGS. 17-19, is provided to lock sections of the beam assembly 100 together. For example, the tongue section 130 can slide into and lock with the receiver section 110. If an extension 160 is used, the locking mechanism 150 attaches the receiver section 110 and the tongue section 130 to each end of the extension 160 using a supplementary locking mechanism 170 in conjunction with locking mechanism 150. Although a specific locking mechanism 150 is illustrated in the present invention, other locking mechanisms and arrangements may be used to attach the section of the beam assembly 100 together. For example, two or more locking mechanisms can be provided. One locking mechanism can be positioned on an opposing side to another locking mechanism to provide additional safety in preventing the sections of the beam assembly 100 from separating. In the present invention, however, one locking mechanism has been found to be sufficient to secure the sections of the beam assembly 100 together.

The locking mechanism 150 includes an aperture 151 and a depression 152 on the receiver section 110. In the preferred embodiment, the aperture 151 has a diameter between about 9.5 millimeters to about 1.3 centimeters. The depression 152 can be a taper from the outer surface of the receiver section 110 down towards a lower portion of the aperture 151 to allow a user's finger to easily depress the knob 156.

The locking mechanism 150 on the tongue section 130 includes a parabolic groove 154, a cantilevered segment 155 and knob 156. The parabolic groove 154 is formed on the recess section 133 of the tongue section 130. The parabolic groove 154 is arranged to face the opening of the parabolic shape away from the tongue section 130 and to provide the cantilevered segment 155. The knob 156 is provided on the end of the cantilevered segment 155 to provide a springing action. When the tongue section 130 is slid into the receiver section 110, the knob 156 is forced down by displacing the cantilevered segment 155 into the tongue section 130. The tongue section 130 and receiver section 110 are then slid together until the knob 156 engages the aperture 151 to lock the locking mechanism 150. A user disengages the locking mechanism 150 by pressing the knob 156, thereby displacing the cantilevered segment 155 into the tongue section 130 far enough to depress the knob 156 below the aperture 151 and slide the tongue section 130 and receiver section 110 apart from each other.

To assist in attaching the locking mechanism 150, a notch 153 is provided in the inner surface of the receiver section 110. The notch 153 is inline with the aperture 151 and is positioned so that a user can push the tongue section 130 and receiver section 110 together without having to manually push the knob 156 into the tongue section 130 first. In the preferred embodiment, the knob 156 has a diameter between about 9.0 millimeters to about 12.0 millimeters and a height between about 4.0 millimeters to about 5.0 millimeters. The preferred embodiment illustrates the knob 156 projecting outward from the tongue section. In an alternative embodiment, a knob can be provided on the receiver section 110 and arranged to project inward. This way, the knob would snap into an aperture on the tongue section to lock the locking mechanism. In effect, the locking mechanism would be reversed from the illustrations of FIGS. 17-19.

Figure 22:
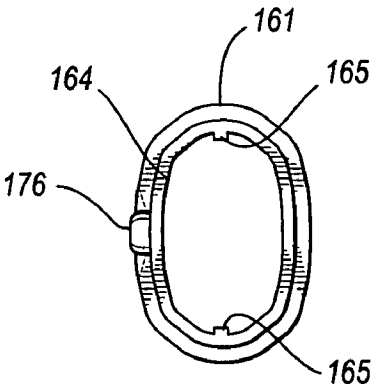
FIG. 22 is an end view of the extension of FIG. 20.
Figure 20:
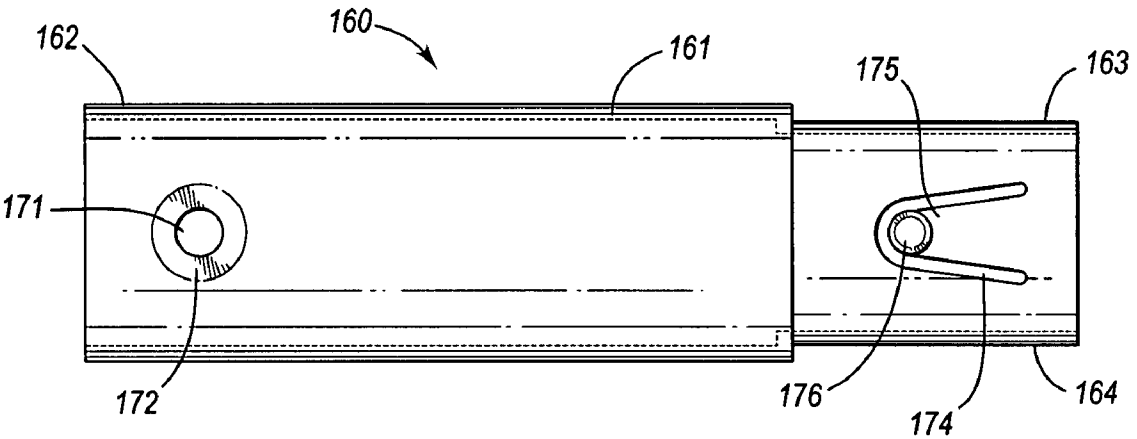
FIG. 20 is a top view of an extension in accordance with an embodiment of the present invention.
Figure 21:
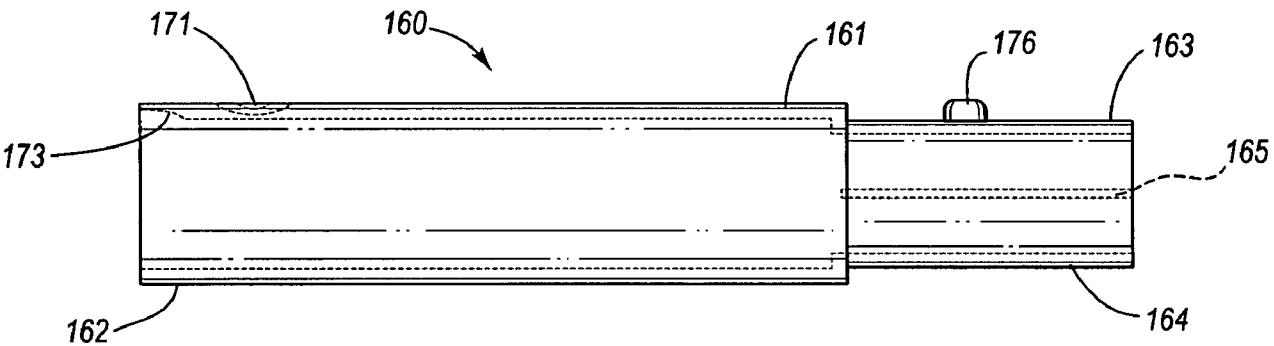
FIG. 21 is a side view of the extension illustrated in FIG. 20.

As shown in FIGS. 20-22, an extension 160 is provided to lengthen the beam assembly 100 when a user desires a longer length. The extension 160 is inserted in between the receiver section 110 and the tongue section 130. The extension 160 includes an extender section 161 and a supplementary locking mechanism 170.

The extender section 161 has a length, width and height. The extender section 161 includes a receiving end 162 and a tongue end 163. In the preferred embodiment, the length is about 21.2 centimeters, the width is about 5.0 centimeters, and the height is about 3.5 centimeters. The width and the height are sized to match the receiver section 110 and the tongue section 130. The thickness of the extender section 161 can vary, but is generally in the range of about 2.0 millimeters.

The tongue end 163 includes a recess section 164 where the height of the recess section 164 is recessed below the height and the width of the recess section 164 is recessed from width. Accordingly, the recess section 164 is smaller than the extender section 161 by about 3.0 millimeters around all of the outer surfaces of the extender section 161. The extender section 161 also includes strengthening ribs 165 positioned along a portion of the length on the inner surface of the extender section 161 to add additional rigidity to the extension 160. The strengthening ribs 165 are positioned on opposing inner walls of the extender section 161.

The supplementary locking mechanism 170, similar to the locking mechanism 150 shown in FIGS. 12A-B and 17-19, is provided to lock the extension 160 with the receiver section 110 and the tongue section 130. For example, the receiver section 110 can slide into and lock with the tongue end 163 of the extension 160. Likewise, the tongue section 130 can slide into and lock with the receiving end 162 of the extension 160. Although a specific supplementary locking mechanism 150 is illustrated in the present invention, other locking mechanisms and arrangements may be used to attach the extension 160 with the receiver section 110 and the tongue section 130.

The supplementary locking mechanism 170 includes an aperture 171 and a depression 172 on the receiving end 162. In the preferred embodiment, the aperture 171 has a diameter between about 9.5 millimeters to about 1.3 centimeters. The depression 172 can be a taper from the outer surface of the extender section 161 down towards a lower portion of the aperture 171 to allow a user's finger to easily depress the supplementary locking mechanism 170.

The supplementary locking mechanism 170 on the tongue end 163 includes a parabolic groove 174, a cantilevered segment 175 and knob 176. The parabolic groove 174 is formed on the recess section 164. The parabolic groove 174 is arranged to face the opening of the parabolic shape away from the tongue end 163 and to provide the cantilevered segment 175. The knob 176 is provided on the end of the cantilevered segment 175 to provide a springing action. When the tongue end 163 is slid into the receiver section 110, the knob 176 is forced down by displacing the cantilevered segment 175 into the tongue end 163. Likewise, when the tongue section 130 is slid into the receiving end 162, the knob 156 is forced down by displacing the cantilevered segment 155 into the receiving end 162.

The tongue section 130 and receiver section 110 are both slid into the extension 160 until the knobs 156, 176 engage the respective apertures 151, 171 to lock the locking mechanism 150 and the supplementary locking mechanism 170. A user disengages the supplemental locking mechanism 170 in a similar manner as discussed above with respect to the locking mechanism 150. A user presses the knob 176 to displace the cantilevered segment 175 into the tongue end 163 far enough to depress the knob 176 below the aperture 171 and slide the tongue end 163 and receiver section 110 apart from each other. In the preferred embodiment, the knob 176 has a diameter between about 9.0 millimeters to about 12.0 millimeters and a height between about 4.0 millimeters to about 5.0 millimeters. As discussed above, a user presses the knob 156 to displace the cantilevered segment 155 into the tongue section 130 far enough to depress the knob 156 below the aperture 151 and slide the tongue section 130 and receiving end 162 apart from each other.

As discussed above with respect to the locking mechanism 150, a notch 173 is provided to assist in attaching the supplemental locking mechanism 170. The notch 173 is formed in the inner surface of the receiving end 162. The notch 173 is inline with the aperture 171 and is positioned so that a user can push the tongue section 130 and receiving end 162 together without having to manually push the knob 156 into the tongue section 130 first.

Figure 23:
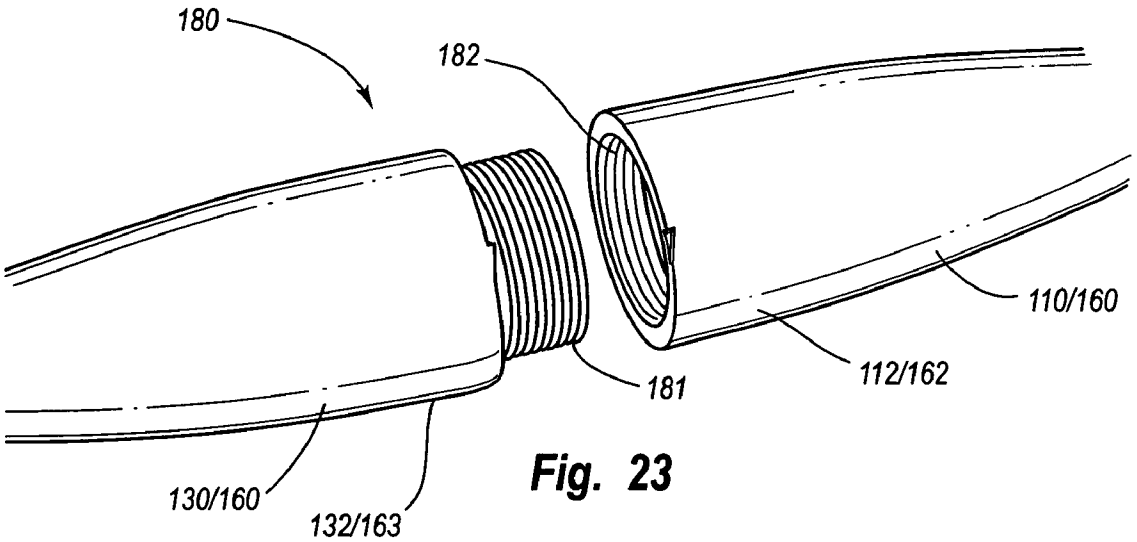
FIG. 23 is a perspective view of a locking mechanism in accordance with another embodiment of the present invention.

As shown in FIG. 23, a locking system 180 can be used instead of the locking mechanism 150 and supplementary locking mechanism 170. The locking system 180 includes a set of male threads 181 and a set of female threads 182. One of the male threads 181 or female threads 182 can be arranged on either the recess section 133 of the tongue section 130 or the inner surface of the receiver section 110. In FIG. 23, the male threads 181 are illustrated on the recess section 130 and the female threads 182 are placed on the inner surface of the receiver section 110. With respect to the extension 160, one of a set of male threads and a set of female threads are provided on the tongue end 163 and the other one on the receiving end 162 in a similar manner.

When the locking mechanism 180 is implemented, the male and female threads 181, 182 should be aligned so that the width and height of the receiver section 110 match up with the width and height of the tongue section 130 when the receiver section 110 and tongue section 130 are tightened together so that all the surfaces are substantially aligned. Likewise, the threads on the extension 160 should be arranged in a similar manner so that the width and height of the extension 160 matches the widths and heights of the receiver section 110 and the tongue section 130 and all the surfaces are substantially aligned. If the receiver section 110 and the tongue section 130 are provided with a round surface, then the arrangement of the threads does not become an important criterion for aligning the outer surfaces. Also, a snap lock or detent can be arranged at the end of the threads to provide a positive locking mechanism. The snap lock or detent can be a ridge or knob that is sized to fit into a groove or recess.

Figure 24:
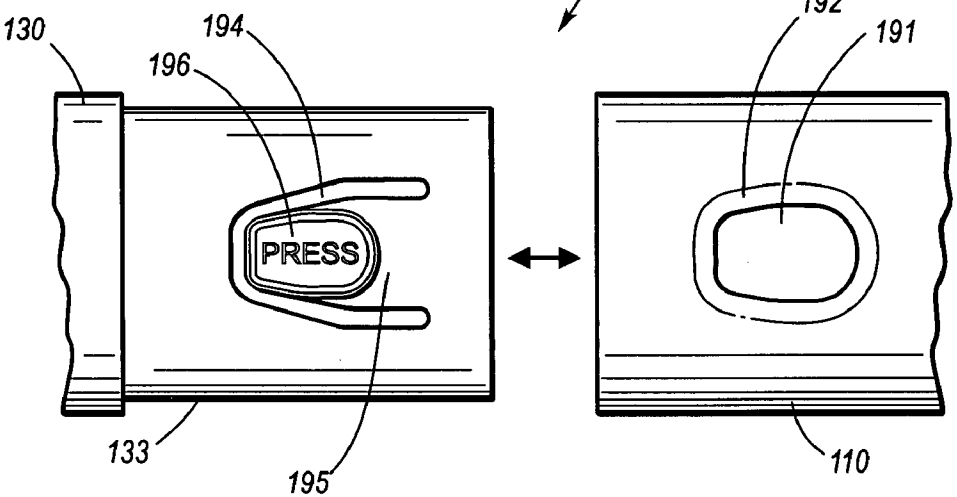
FIG. 24 is a perspective view of a locking mechanism in accordance with further embodiment of the present invention.
Figures 25, 26, 27, 28, 29, 30:
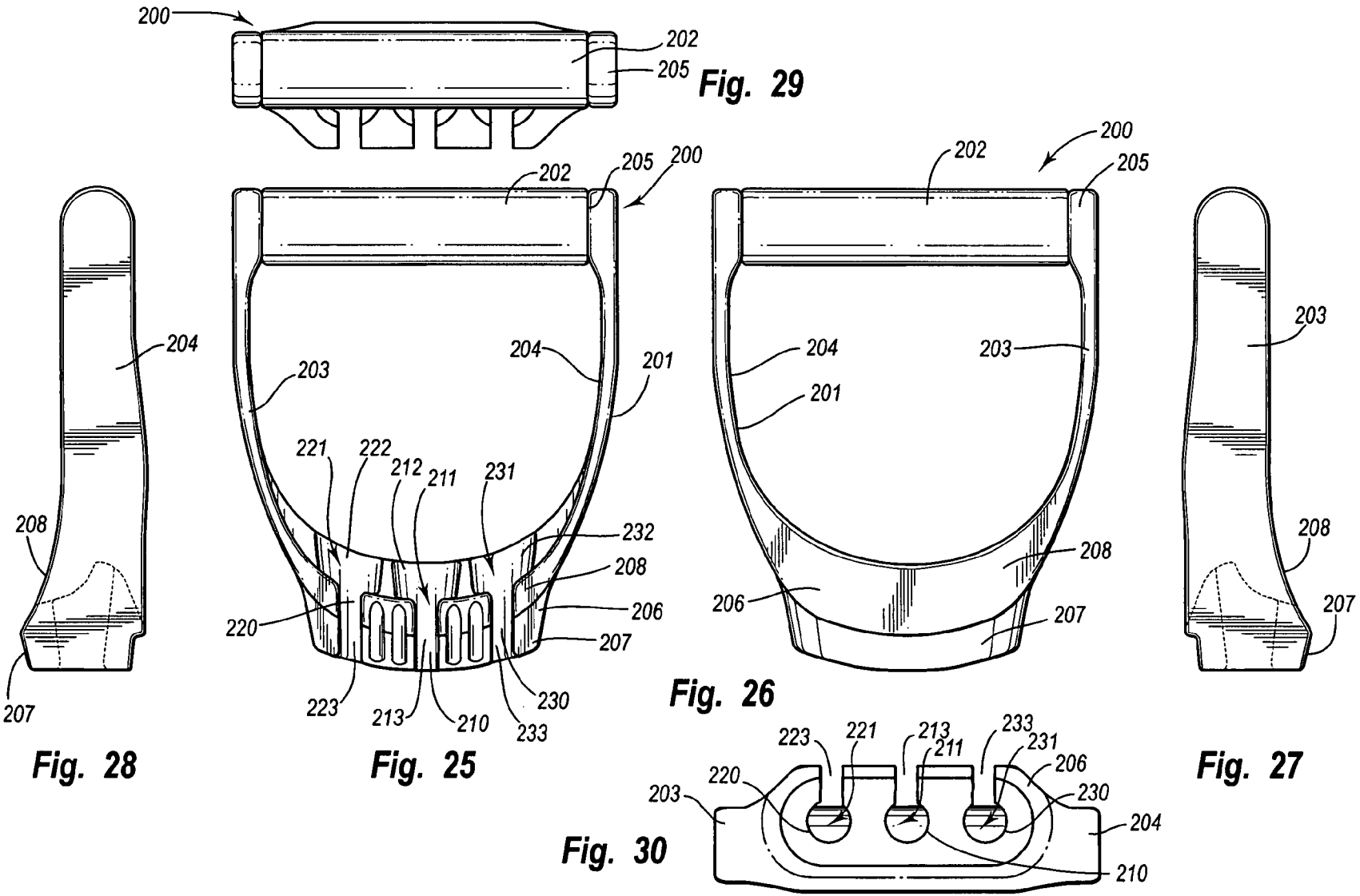
FIG. 25 is a front view of a handle in accordance with an embodiment of the present invention.
FIG. 26 is a back view of the handle of FIG. 25.
FIG. 27 is a first side view of the handle of FIG. 25.
FIG. 28 is a second side view of the handle of FIG. 25.
FIG. 29 is a top view of the handle of FIG. 25.
FIG. 30 is a bottom view of the handle of FIG. 25.

Referring to FIG. 24, a locking mechanism 190 is provided having a larger pressing surface. The larger surface allows a user to more easily disconnect the locking mechanism 190, especially if the user has larger fingers or long fingernails. The locking mechanism 190 is used in a similar manner as locking mechanism 150 and supplementary locking mechanism 170 discussed above. The locking mechanism 190 can be used in place of locking mechanism 150 and supplementary locking mechanism 170.

The locking mechanism 190 includes an aperture 191 and a depression 192 on the receiver section 110. In the preferred embodiment, the aperture 191 has a length of about 2.2 centimeters and a width of about 1.4 centimeters. The aperture 191 can be positioned at about 2.0 centimeters from the edge of the receiving end 112. The depression 192 can be a taper from the outer surface of the receiver section 110 down towards a lower portion of the aperture 191 to allow a user's finger to easily depress the locking mechanism 190.

The locking mechanism 190 on the tongue section 130 includes a groove 194, a cantilevered segment 195 and knob 196. The groove 194 is formed on the recess section 133 of the tongue section 130. The groove 194 is arranged to face the opening of the parabolic-like shape away from the tongue section 130 and to provide the cantilevered segment 195. The knob 196 is provided on the end of the cantilevered segment 195 to provide a springing action. In the preferred embodiment, the knob 196 has a length of about 2.1 centimeters, a width of about 1.3 centimeters and a height between about 4.0 millimeters to about 5.0 millimeters. The knob 196 can be positioned at about 2.1 centimeters from the junction of the tongue end 132 and the recess section 133.

Figure 31:
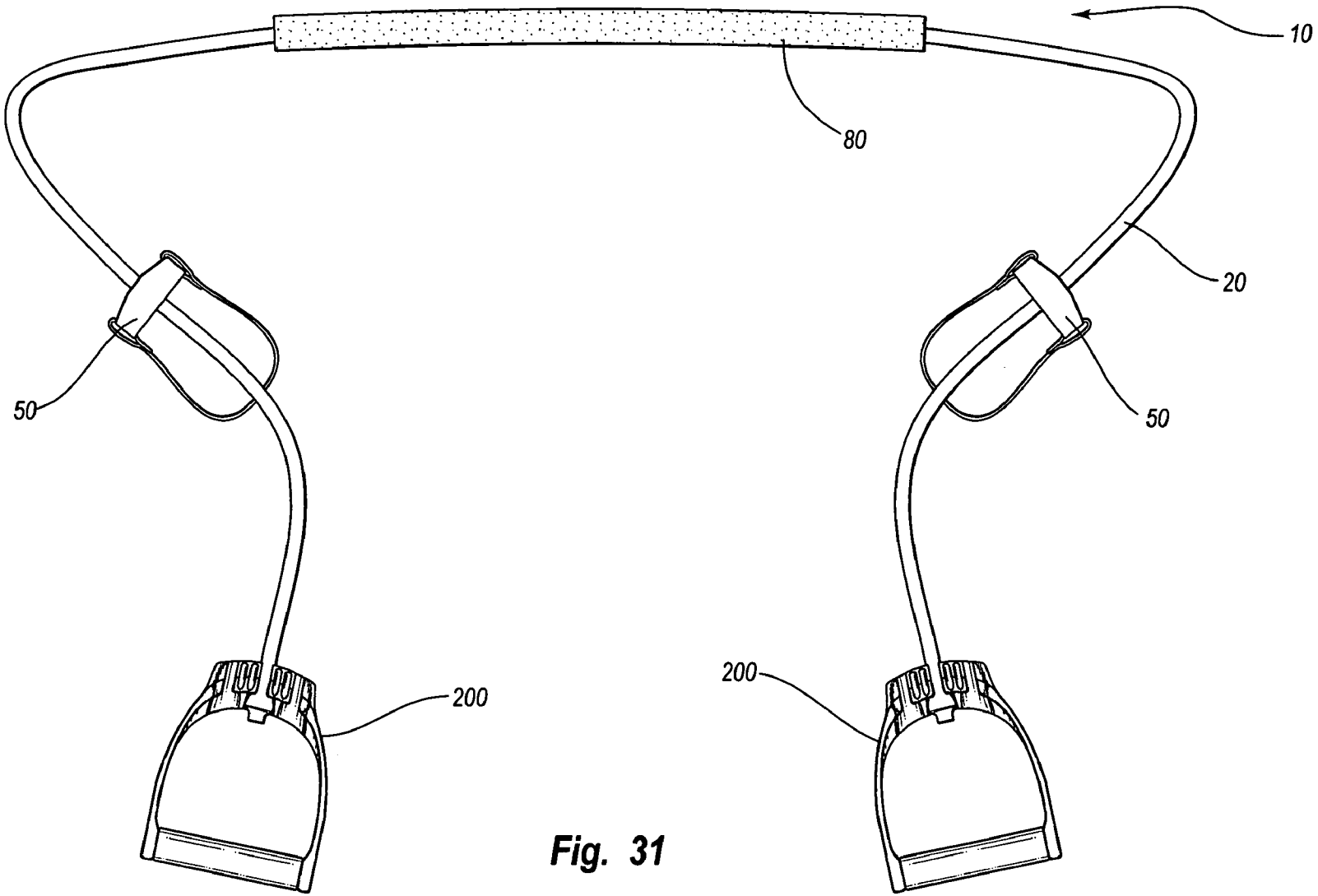
FIG. 31 is a perspective view of the elastic cord assembly, strap assembly and handles in accordance with an embodiment of the present invention.
Figure 32:
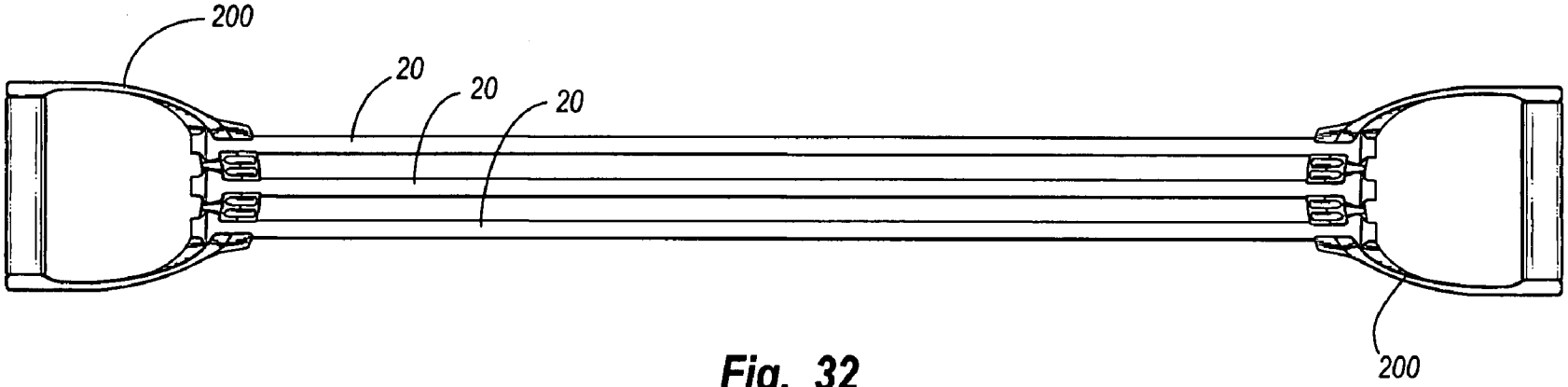
FIG. 32 is a perspective view of three elastic cord assemblies and two handles in accordance with an embodiment of the present invention.
Figure 33:
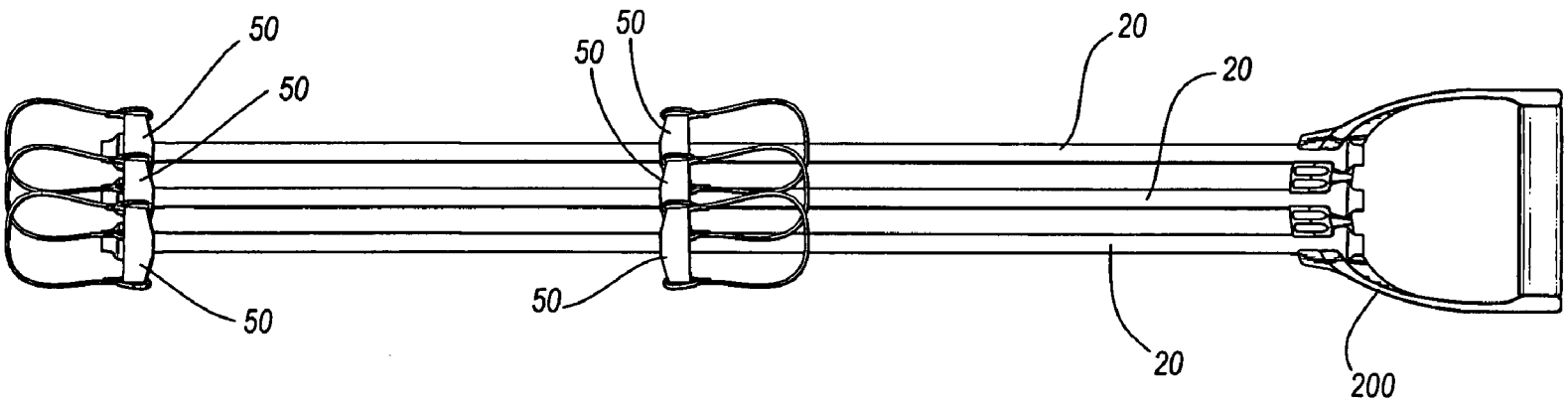
FIG. 33 is a perspective view of three elastic cord assemblies attached to a handle and each elastic cord assembly having strap assemblies.
Figure 34:
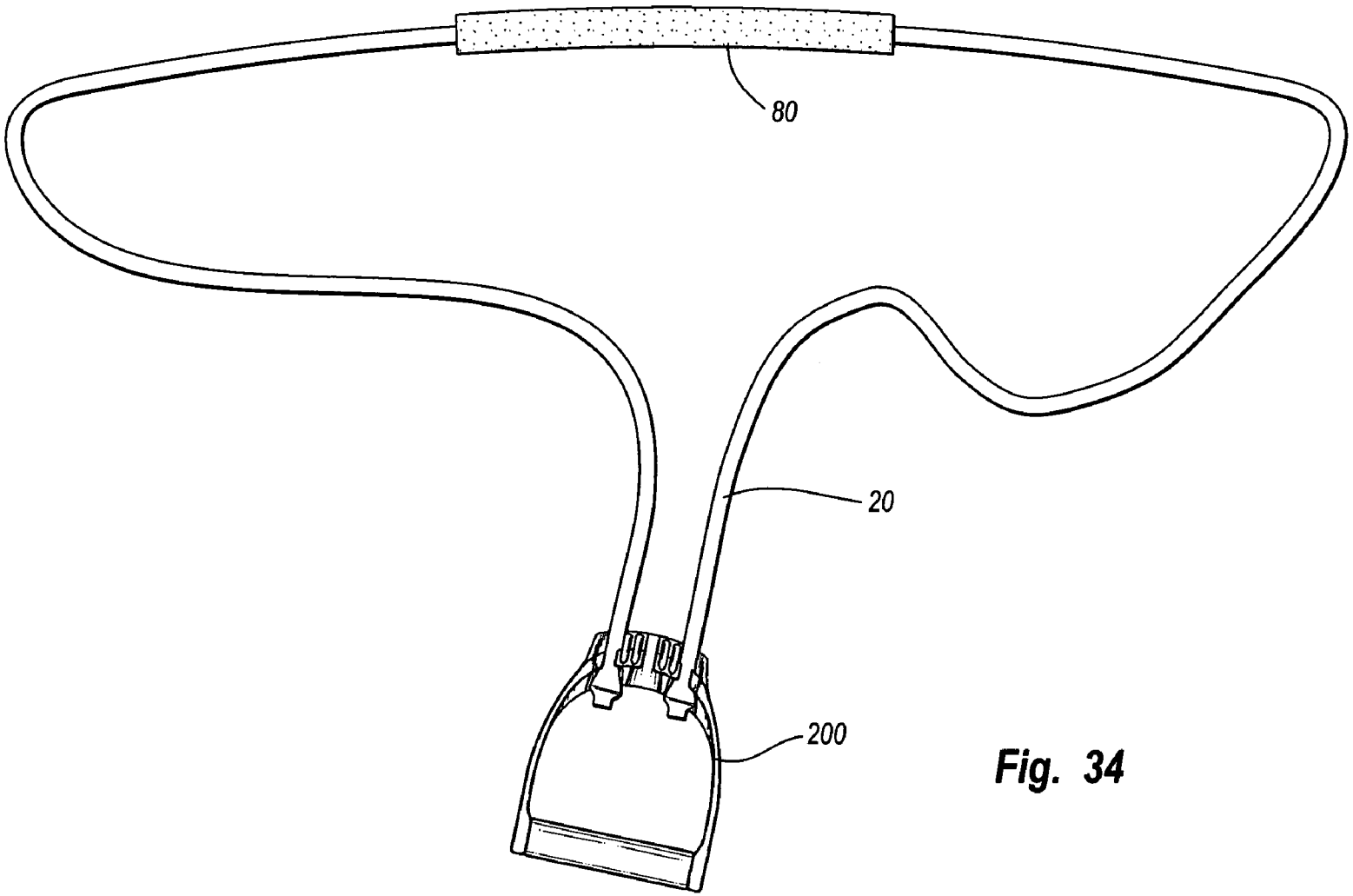
FIG. 34 is a perspective view of a handle attached to an elastic cord assembly having a cushioning device.

As shown in FIGS. 25-30, a handle 200 is provided to be attached to the elastic cord assembly 20. The handle 200 includes a frame 201, a grip 202, a center port 210, a first adjacent port 220 and a second adjacent port 230. Although the present embodiment includes three ports for attaching an elastic cord assembly 20, the handle 200 may include a variety of ports, for example, one to about six ports. The number of ports may be provided to attach one or more elastic cord assemblies to the handle depending on the type of exercise the user desires. For example, a user may attach two handles to one elastic cord assembly as shown in FIG. 31. In another arrangement, three elastic cord assemblies may be used with two handles as shown in FIG. 32, or with one handle as shown in FIG. 33. In another arrangement, one handle may be used to attach both ends of the elastic cord assembly 20 to the first and second adjacent ports 220, 230 as shown in FIG. 34.

The frame 201 includes a first strut 203, a second strut 204, and grip support 205 and a connection segment 206. The first strut 203 and second strut 204 extend out from the connection segment 206. The grip support 205 is positioned between the first strut 203 and second strut 204 on an opposite end of the frame 201 opposing the connection segment 206. The first strut 203, second strut 204, grip support 205 and connection segment 206 are arranged in a manner to provide an opening in the frame 201 for a user's hand. In the preferred embodiment, the first strut 203 and second strut 204 are slightly bent or curved to provide additional room for a user's hand to grip the handle 200. Also, the handle 200 may be elongated to accommodate a user's foot when the handle 200 is placed in a horizontal position.

A grip 202 is provided on the grip support 205. The grip can have a tube shape that completely surrounds the grip support 205. Alternatively, the grip 202 may include ridges and valleys or a textured surface to provide additional gripping characteristics for a user's hand. The grip 202 is arranged on the grip support 205 so that the grip 202 can freely rotate around the grip support 205. This allows a user to maintain a tight grasp on the grip 202 without requiring the handle 200 to slip in the user's hand while the user rotates the handle 200 through a series of exercises.

In the preferred embodiment, the opening in the frame 201 is about 10.2 centimeters by 11.4 centimeters. The length of the first and second struts 203, 204 are about 12.7 centimeters long and have a width that ranges between about 2.4 centimeters to about 3.5 centimeters. The grip is about 11.4 centimeters long and about 2.5 centimeters in diameter. The grip support is about 2.1 centimeters in diameter.

The connection segment 206 includes a curved protuberance 207 and a curvature 208. The curved protuberance 207 extends outward from the frame 201 to provide additional structure for the ports. The curved protuberance extends beyond the frame 201 about 0.7 centimeters at the center port 210 to about 2.0 centimeters at the first and second adjacent ports 220, 230.

The center port 210 includes an opening 211, a tapered inner surface 212 and a slot 213. The center port 210 is provided at a mid-section of the handle 200. The opening 211 ranges between about 2.5 centimeters at the opening of the frame 201 and about 0.8 centimeters at the outermost point. The tapered inner surface 212 is shaped to receive the taper surface 34 of the elastic 30. The slot 213 is provided in the center port 210 to allow the elastic 30 to slip into the center port 210 for positioning the elastic cord assembly 20 into the handle 200.

The first and second adjacent ports, 220, 230 are positioned on opposing sides spaced from the center port 210. The first adjacent port 220 includes an opening 221, a tapered inner surface 222 and a slot 223. The second adjacent port 230 includes an opening 231, a tapered inner surface 232 and a slot 233. The first and second adjacent ports 220, 230 are positioned on opposing sides adjacent to the center port 210 and are sized and shaped similar to that of center port 210.

Figure 35:
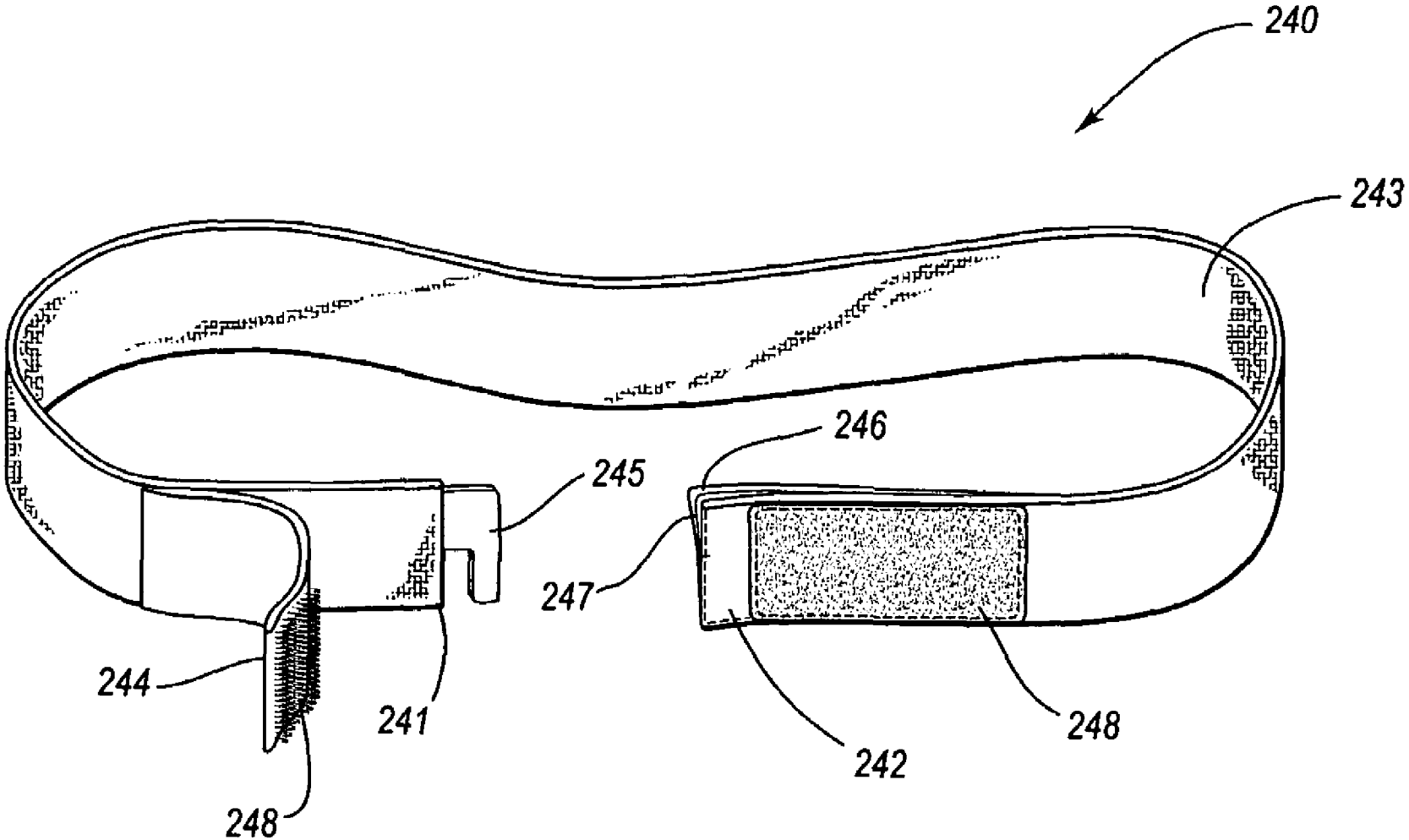
FIG. 35 is a perspective view of a waist strap in accordance with an embodiment of the present invention.

The personal exercise system 10 may also include a waist strap 240 as shown in FIG. 35. The waist strap 240 includes a clasping end 241, a receiving end 242 and a length 243 between the clasping end 241 and receiving end 242. When the clasping end 241 and receiving end 242 are fastened together, the length 243 forms a loop. The length 243 is made from a pliable material such as webbing, cloth or leather. In the preferred embodiment, the length is about 7.7 centimeters wide and about 114.0 centimeters long.

The clasping end 241 includes a fold 244 and a U-clip 245. The U-clip 245 is provided in the fold 244 of the clasping end 241. The receiving end 242 includes a loop 246 and slit 247. The material at the receiving end 242 is folded over and sewn to the material to provide a loop 246. The slit 247 is provided at the crest of the loop 246. The slit 247 extends about one-third of the distance into the loop 246.

To fasten the ends of the waist strap 240 together, the U-clip 245 is inserted into the slit 247, which aligns the clasping end 241 with the receiving end 242. The fold 244 is then placed across the clasping end 241 to the receiving end 242 and fastened in place with a fastener 248, such as a hook and loop fastener system.

Figure 37:
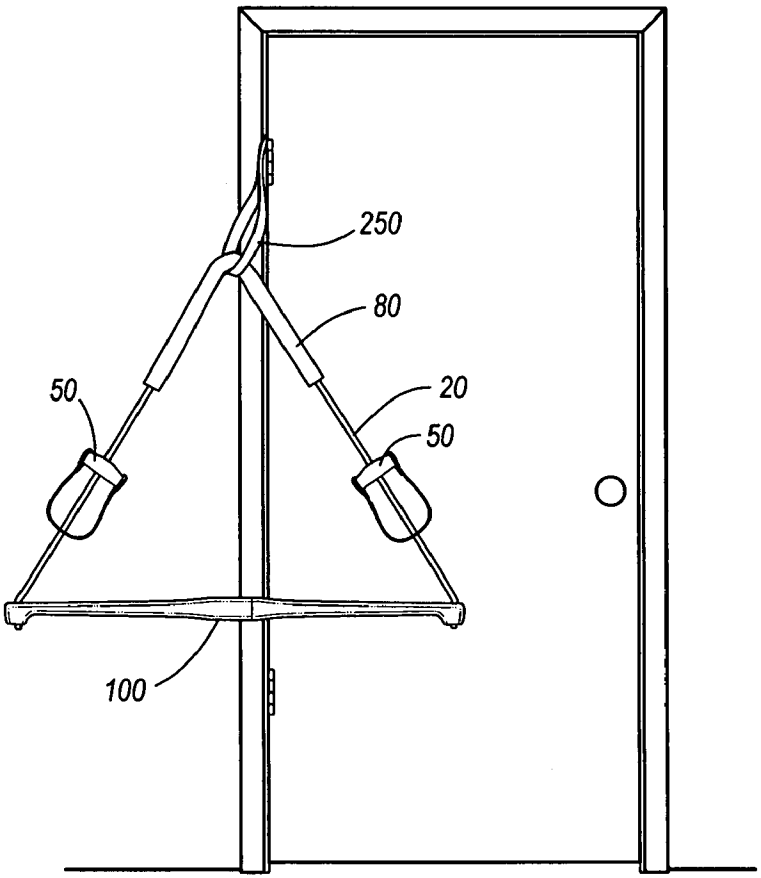
FIG. 37 is a perspective view of a personal exercise system including a door strap in accordance with an embodiment of the present invention.
Figure 36:
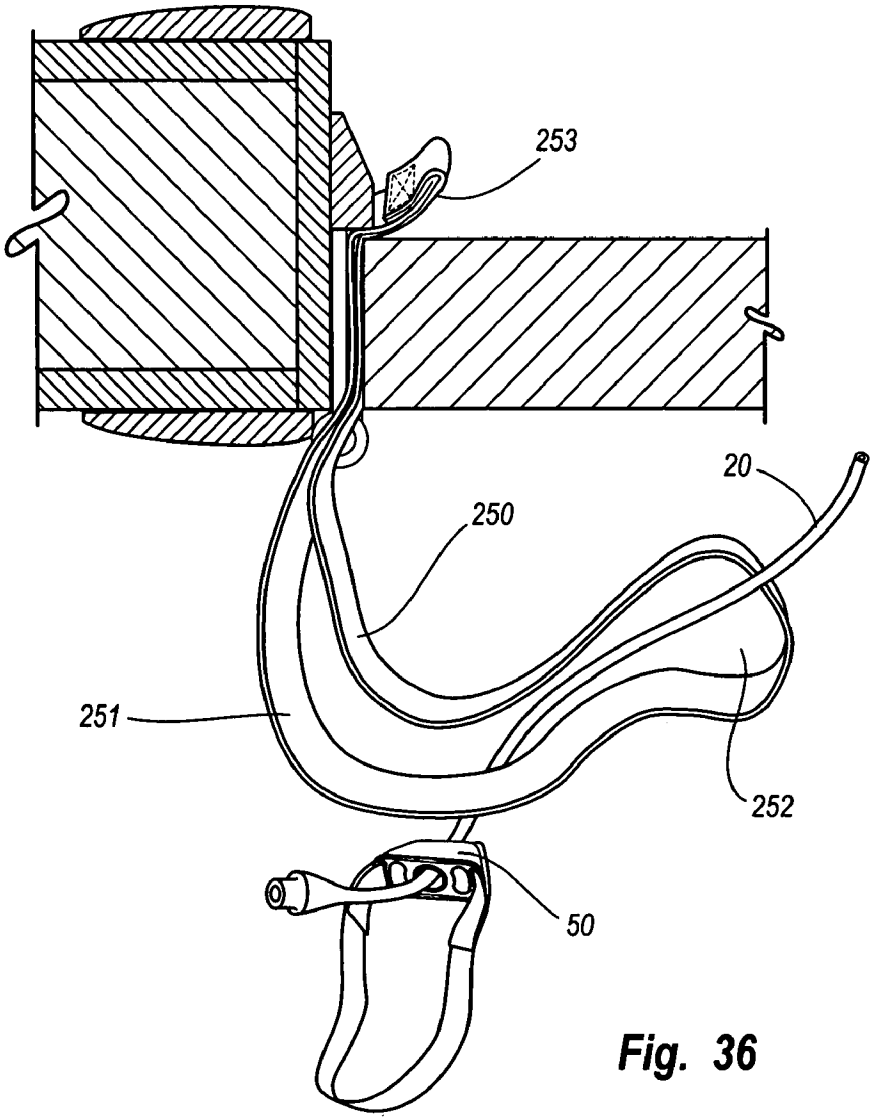
FIG. 36 is a perspective view of a door strap in accordance with an embodiment of the present invention.
Figure 39:
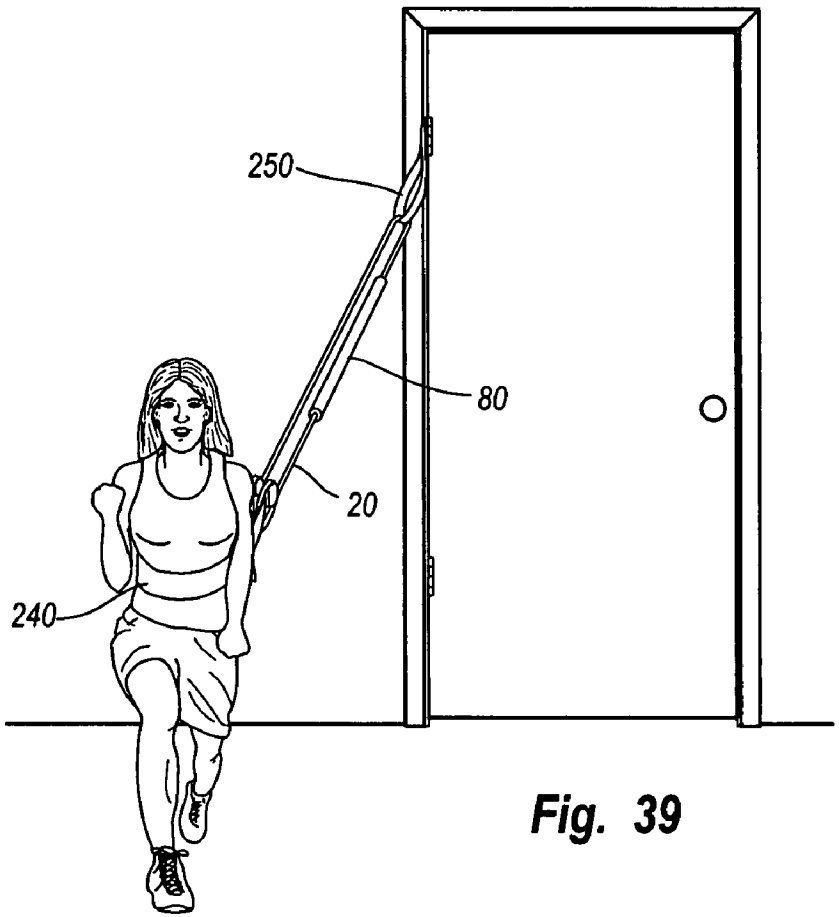
FIG. 39 is a perspective view of a personal exercise system including a door strap in accordance with a further embodiment of the present invention.
Figure 38:
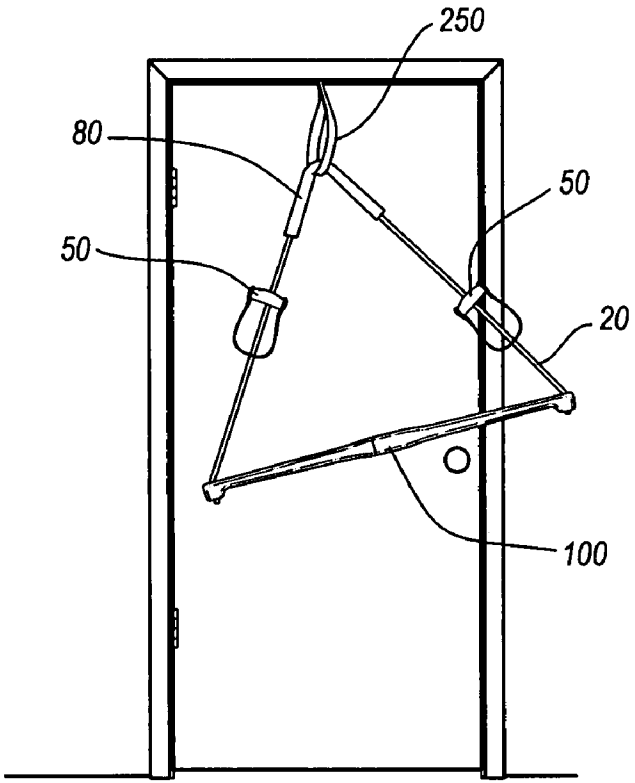
FIG. 38 is a perspective view of a personal exercise system including a door strap in accordance with another embodiment of the present invention.

As shown in FIGS. 36-39, a door strap 250 may be included in the personal exercise system 10. The door strap 250 includes a length 251 that is folded over to form a loop 252 that is sewn together at one end to form a fold 253. The door strap 250 can be made of a material such as webbing or like material. As shown in FIG. 36, the door strap 250 is inserted in a doorjamb next to a hinge. The fold 253 is placed behind the door and the loop 252 extends out towards the personal exercise system 10. The door is then closed sandwiching the fold 253 behind the door to prevent the door strap 250 from being pulled out of the doorjamb. The elastic cord assembly 20 is then inserted through the loop 252. The personal exercise system 10 may then be used with the beam assembly 100 as shown in FIG. 37, with the strap assemblies 50 or with the waist strap 240 as shown in FIG. 39. The door strap 250 may also be attached to the top of a door jamb as shown in FIG. 38 to vary the type of exercise by a user.

Figure 40B:
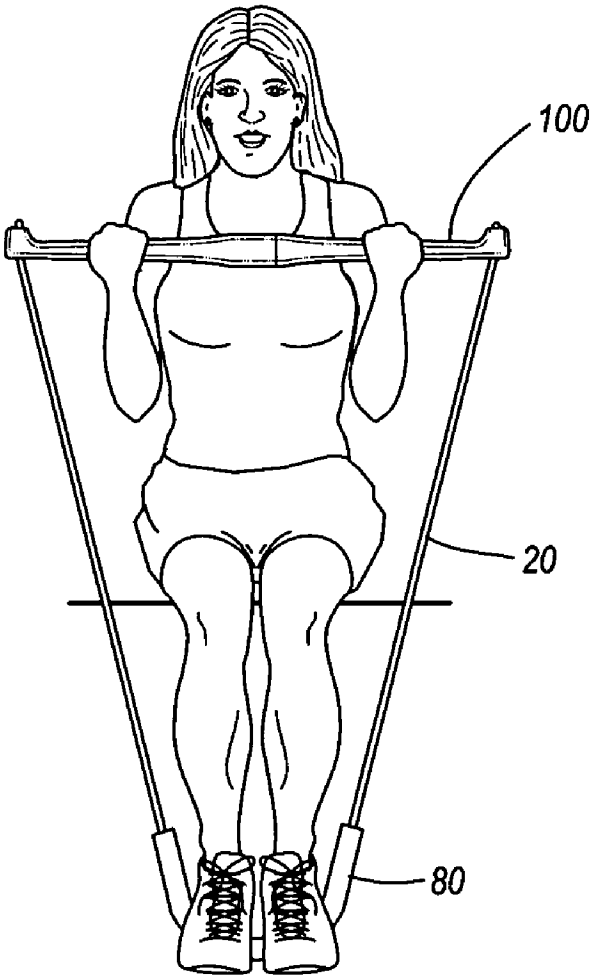
FIGS. 40A-66B illustrate assemblies and uses of a personal exercise system in accordance with the present invention.
Figure 40A:
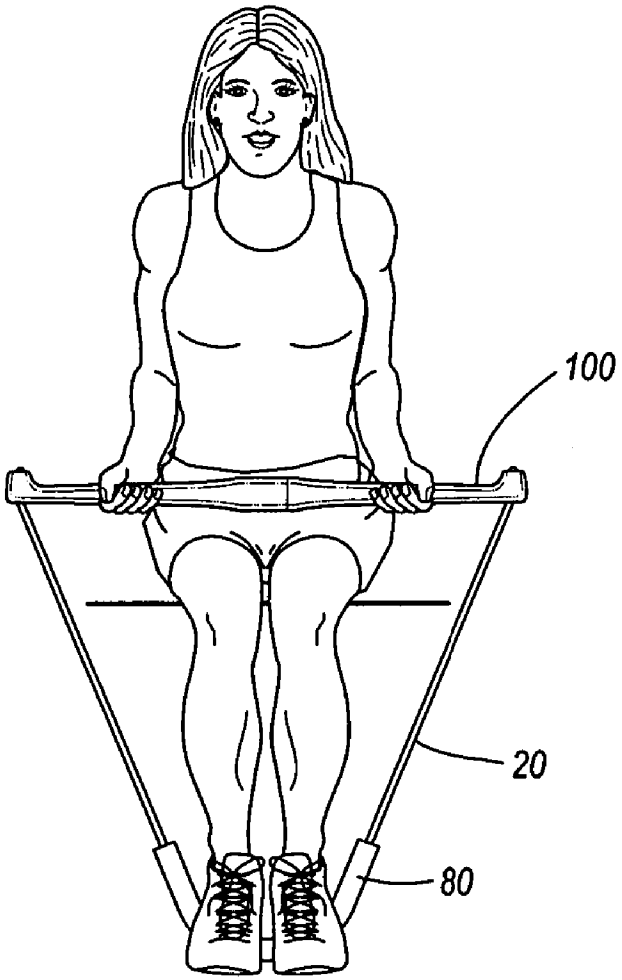

As discussed above, various combinations and arrangements of the personal exercise system 10 may be implemented to achieve an assortment of exercises. A biceps curl is illustrated in FIGS. 40A-B. Each of the user's feet are inserted into a strap assembly 50 or placed on the cushioning device 80. The user then sits upright with hands a shoulder width apart with palms facing up. In the start position, the user's forearms are raised parallel to the legs. The elbows are bent, keeping the muscles tight at the waist. The user then curls the beam assembly 100 towards his or her shoulders. Then, he or she slowly lowers the beam assembly 100 back to the starting position.

Figure 41B:
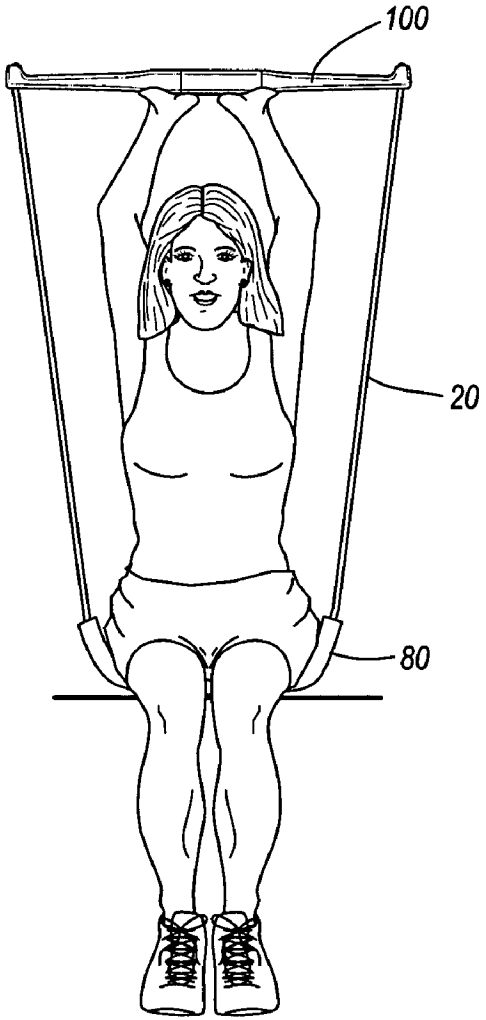
Figure 41A:
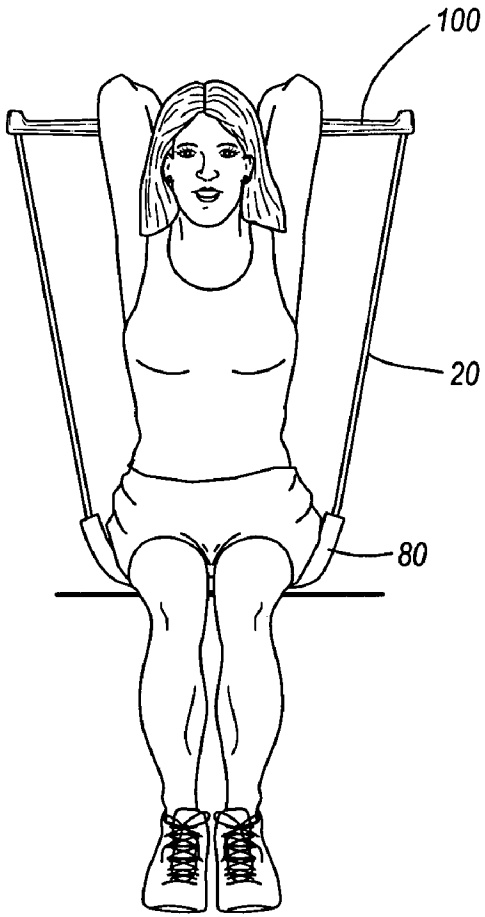

A triceps extension is illustrated in FIGS. 41A-B. In this exercise, the user sits on the cushioning device 80 with his or her knees together. He or she then grasps the beam assembly 100 with hands a shoulder width apart and palms facing up. The user then raises the beam assembly 100 overhead with elbows pointed towards the ceiling and the beam assembly 100 resting slightly above the shoulders. The user keeps the wrists straight and squeezes the elbows towards his or her head. Then, the user fully straightens the elbows, pressing the beam assembly 100 towards the ceiling. The arms extend directly over the shoulders and palms are facing forward. Then, the user slowly lowers the beam assembly 100 back to the shoulders.

Another triceps extension exercise can be accomplished by standing in a lunge position with the cushioning device 80 centered under the back foot. A user grasps the beam assembly 100 a shoulder width apart and palms facing up. The user raises beam assembly 100 overhead with elbows pointed towards ceiling, beam assembly 100 resting slightly above her shoulders. He or she keeps wrists straight while squeezing elbows towards head. The user then fully straightens the elbows, pressing the beam assembly 100 towards ceiling. The arms extend directly over shoulders, palms facing forward. The user then slowly lowers the beam assembly 100 back to shoulder level.

Figure 42B:
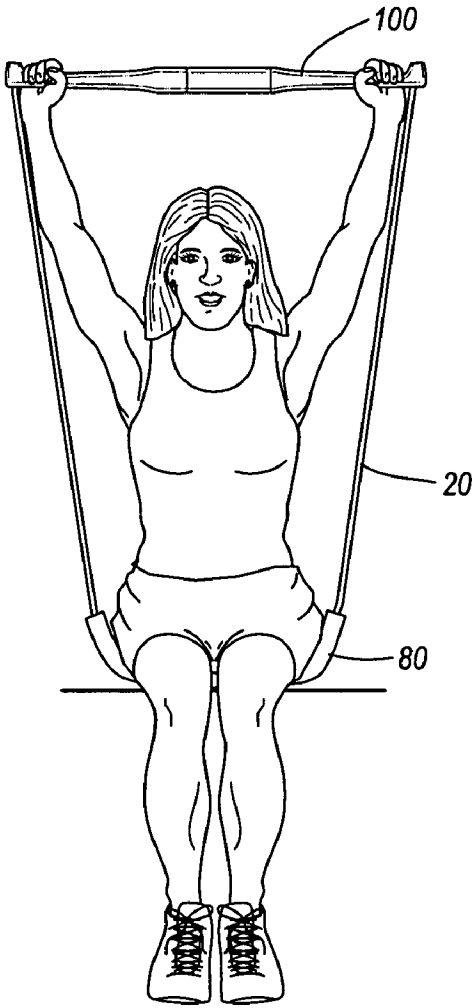
Figure 42A:
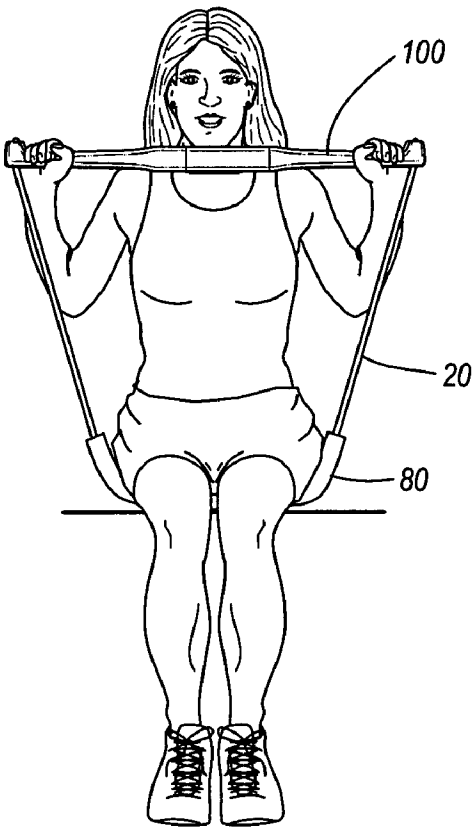

A shoulder press is illustrated in FIGS. 42A-B. In this exercise, the user sits on the cushioning device 80 with knees together. He or she then grasps the beam assembly 100 a shoulder width apart and palms facing down. First, the user lifts the beam assembly 100 to his or her shoulders with elbows into the body and palms facing forward. Then, the user fully straightens the elbows pressing towards the ceiling. Then, slowly lowering the beam assembly 100 back to shoulder level.

Figure 43B:
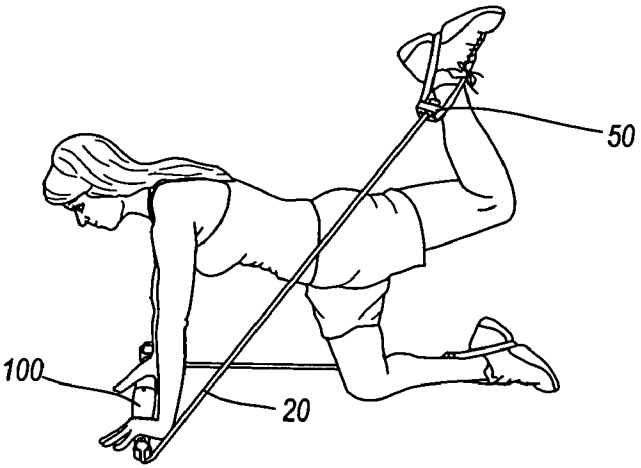
Figure 43A:
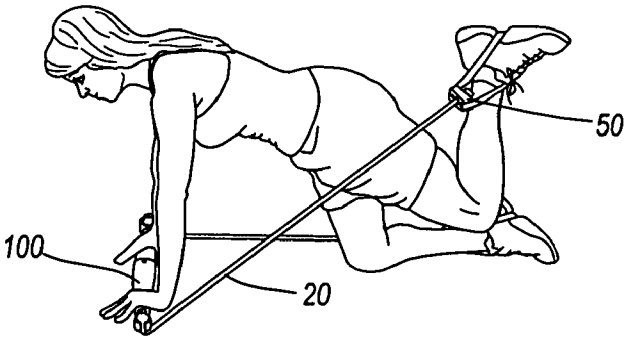

A bent knee raise is illustrated in FIGS. 43A-B. In this exercise, the user places the beam assembly 100 on the floor, then inserts each foot into a strap assembly 50. The user positions his or her body on all fours, hips directly over knees, arms directly under shoulders. The user holds the beam assembly 100 on the floor a shoulder width apart and pulls the abdominals in towards the spine, keeping the back straight. The user carefully extends the left leg with the knee bent and slowly raises the bent leg parallel with the body then down to the floor stopping an inch above floor. The user repeats the process on the other side.

Figure 44B:
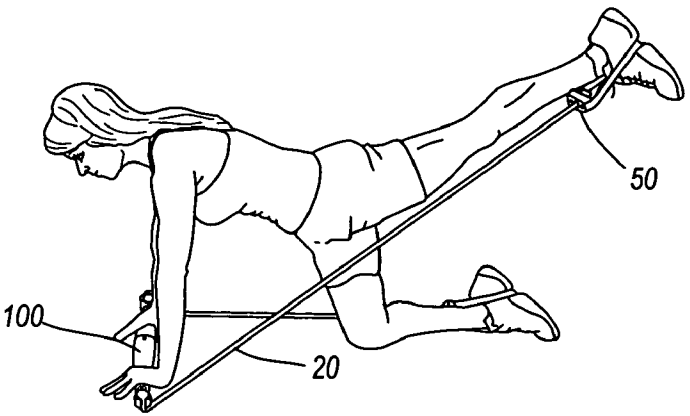
Figure 44A:
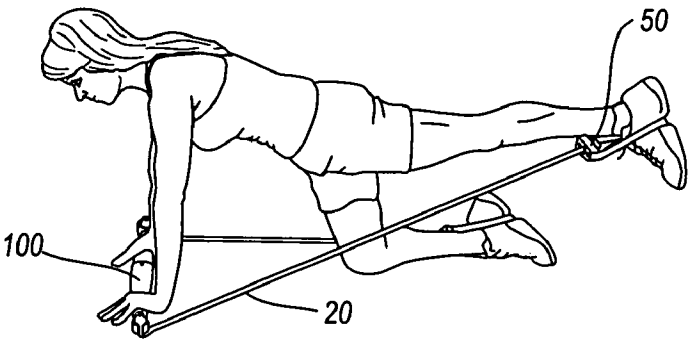

A straight leg raise is illustrated in FIGS. 44A-B. In this exercise, the user inserts each foot into a strap assembly 50. The user positions his or her body on all fours, hips directly over knees, arms directly under shoulders. The user holds the beam assembly 100 on the floor a shoulder width apart and pulls the abdominals in towards the spine, keeping the back straight. The user carefully extends the left leg parallel with the body then slowly raises the leg slightly above the body keeping back straight. The user repeats the process on the other side.

Figure 45:
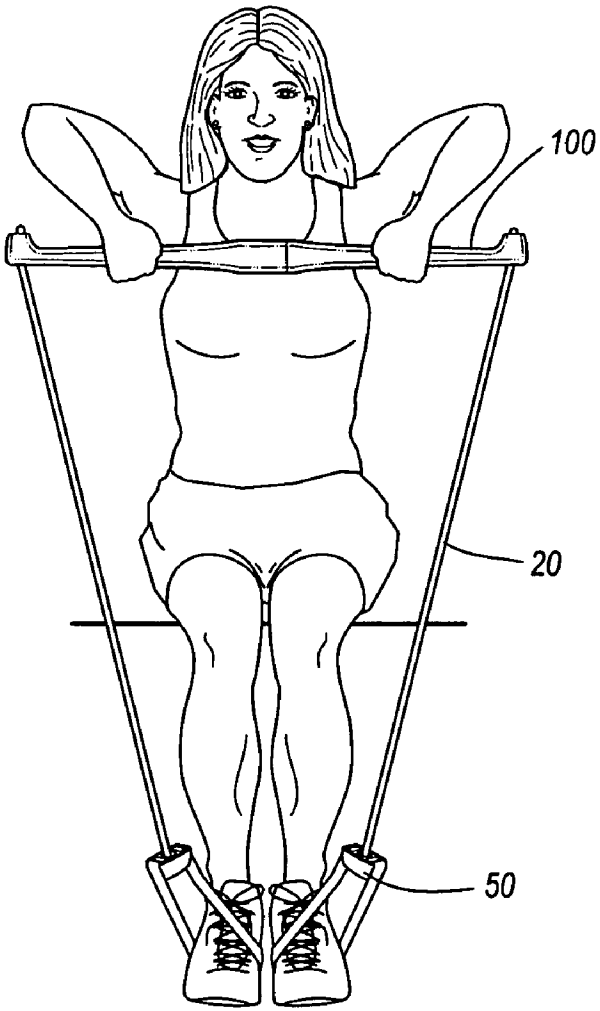

An upright row is illustrated in FIG. 45. In this exercise, the user inserts each foot into a strap assembly 50 or places his or her feet on the cushioning device 80. The user then sits in an upright position and holds the beam assembly 100 a shoulder width apart. The user then can roll the beam assembly 100 towards the body to tighten the elastic cord assembly 20 to increase resistance. The user grasps the beam assembly 100 near the center with the palms towards the body. First, the beam assembly 100 rests on the user's legs. Then, the user raises her elbows towards the ceiling bringing the beam assembly 100 to chin level. Then, she slowly lowers the beam assembly 100 back to the starting position.

Figure 46B:
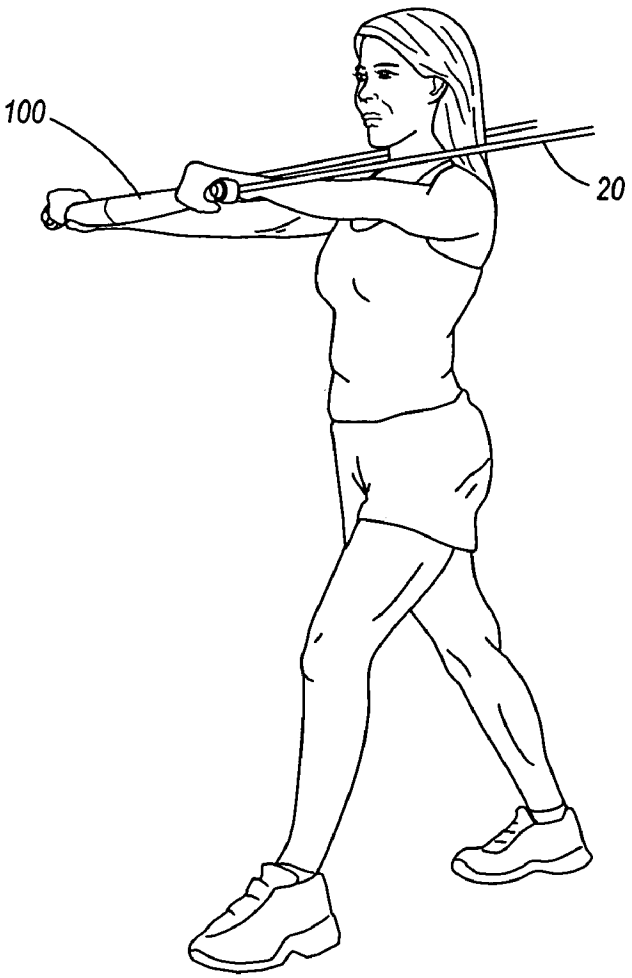
Figure 46A:
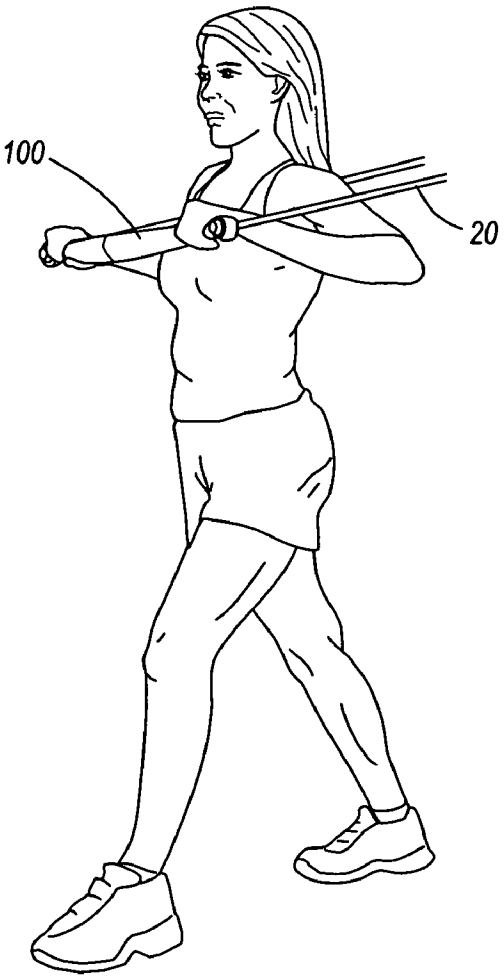

A chest press is illustrated in FIGS. 46A-B. The user places door strap at middle of door jam and centers the strap on the cushioning device 80. The user stands in the middle of the elastic cord assembly 20 facing beam assembly 100 in lunge position. The user grasps the beam assembly 100 with palms facing the floor at chest level and pulls her abdominals in towards the spine, keeping the chest lifted. The user then slowly extends the arms out straight, away from the body and parallel to the floor. The user bends her elbows and pulls the beam assembly 100 back towards the chest.

Another chest press exercise is accomplished by sitting with the knees together and the elastic cord assembly 20 centered across the mid-back. The beam assembly 100 may be rolled towards the body to tighten the elastic and increase resistance. The user then holds the beam assembly 100 a shoulder width apart and chest level and palms facing down. The user extends her elbows away from her body parallel to the floor. Then, the user bends her elbows back to the starting position.

Further, an alternative chest press exercise can be accomplished by standing shoulder width apart. The strap assembly 50 is centered across a user's mid-back. The user can roll the beam assembly 100 towards her body to tighten the elastic cord assembly 20. The user keeps chest lifted tall. The user holds the beam assembly 100 a shoulder width apart, chest level, palms facing down. The user fully extends the elbows away from her body, parallel to floor. The user bends elbows back to starting position.

An oblique twist exercise is not illustrated, but it is accomplished by sitting centered on the cushioning device 80 with knees together. The user may roll beam assembly 100 towards body to tighten the elastic cord assembly 20. He or she then holds beam assembly 100 shoulder width apart, palms facing ceiling. The user starts with hands parallel to legs. His or her elbows are bent, squeezing towards waist. The user keeps her elbows tight at the waist and the wrists remain straight. The user twists the waist and shoulders towards back while keeping knees straightforward. Then, he or she twists back to starting position. The user then repeats the action in the opposite direction.

Another exercise for the oblique twist is accomplished by standing shoulder width apart with each foot in a strap assembly 50. The user holds the beam assembly 100 shoulder width apart and palms facing the ceiling. The user's elbows should be bent with his or her arms parallel to floor. The user keeps the elbows tight at waist and with the wrists remaining straight, twists the waist and shoulders towards the back wall, keeping the knees and hips straightforward. Then the user twists back to the starting position. The user repeats the process in the opposite direction and then goes back to the starting position.

Figure 47B:
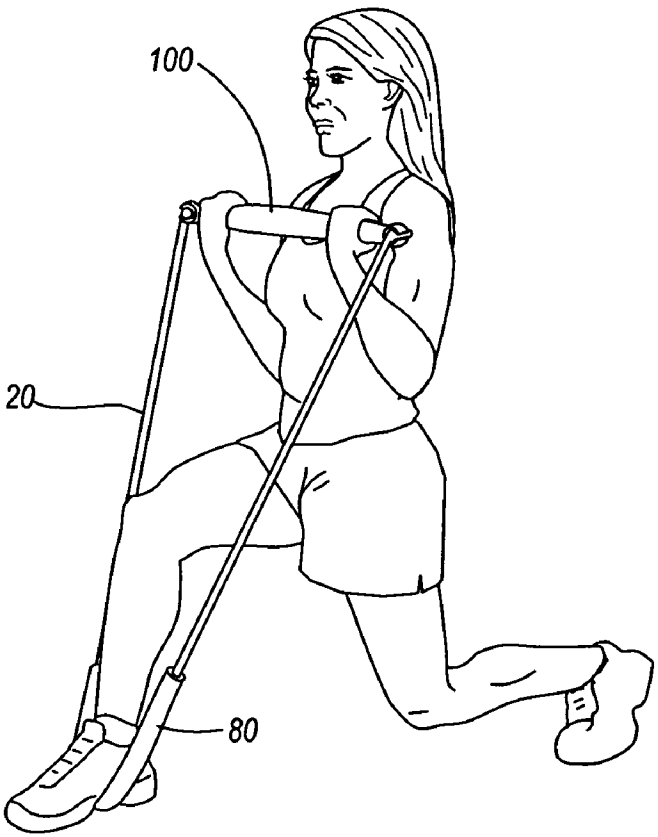
Figure 47A:
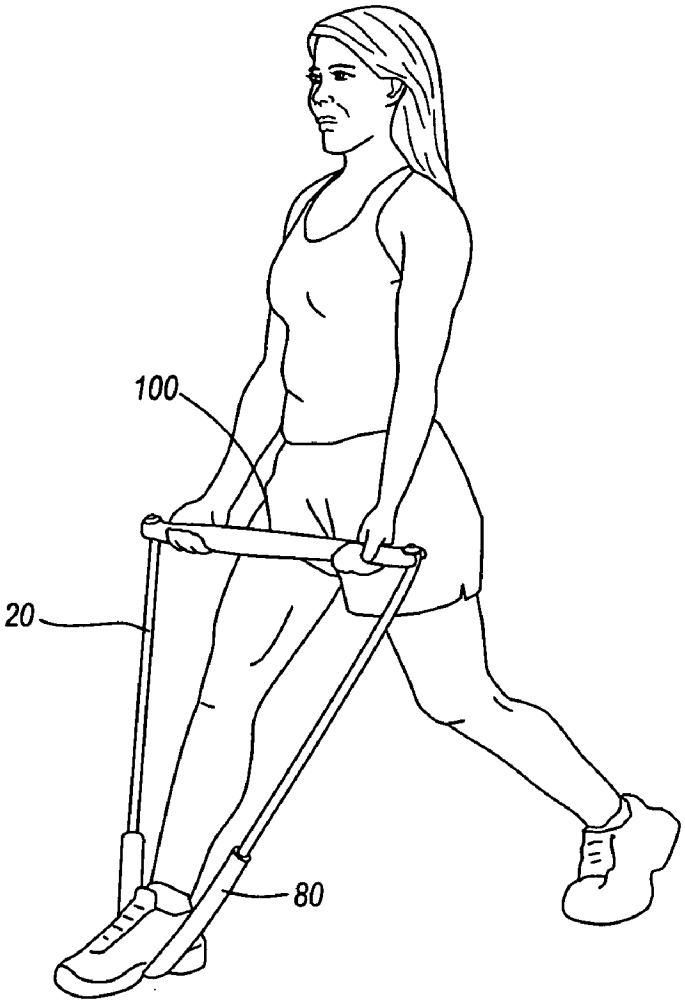

Another biceps curl exercise is illustrated in FIGS. 47A-B. The user stands in lunge position with front foot centered on the cushioning device 80. The hands are positioned a shoulder width apart with palms facing up. First, the hands and beam assembly 100 are resting at legs. Then, he or she bends the elbows, squeezing towards the waist. Keeping elbows tight at waist, he or she raises beam assembly 100 towards the shoulders while keeping her wrists straight. Finally, he or she slowly lowers the beam assembly 100 back to starting position.

Figure 48B:
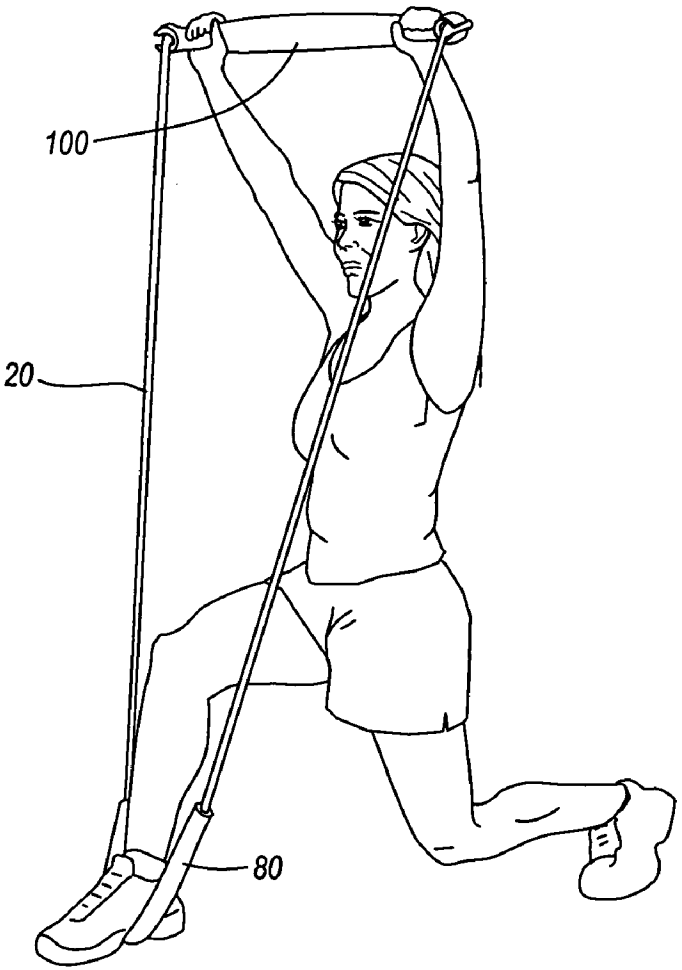
Figure 48A:
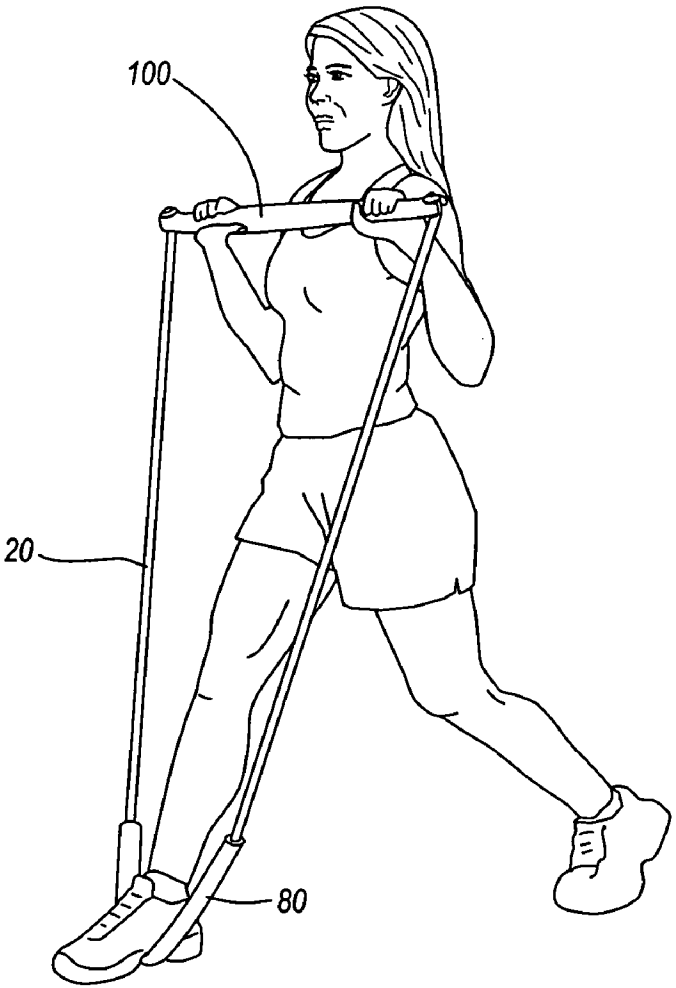

A shoulder press is illustrated in FIGS. 48A-B. The user stands in lunge position with her front foot centered on the cushioning device 80. He or she grasps the beam assembly 100 a shoulder width apart with palms towards the body. He or she keeps the chest lifted tall. He or she lifts beam assembly 100 to shoulders, palms facing forward. The user then fully straightens the elbows towards ceiling. She then slowly lowers beam assembly 100 back to shoulder level.

Figure 49B:
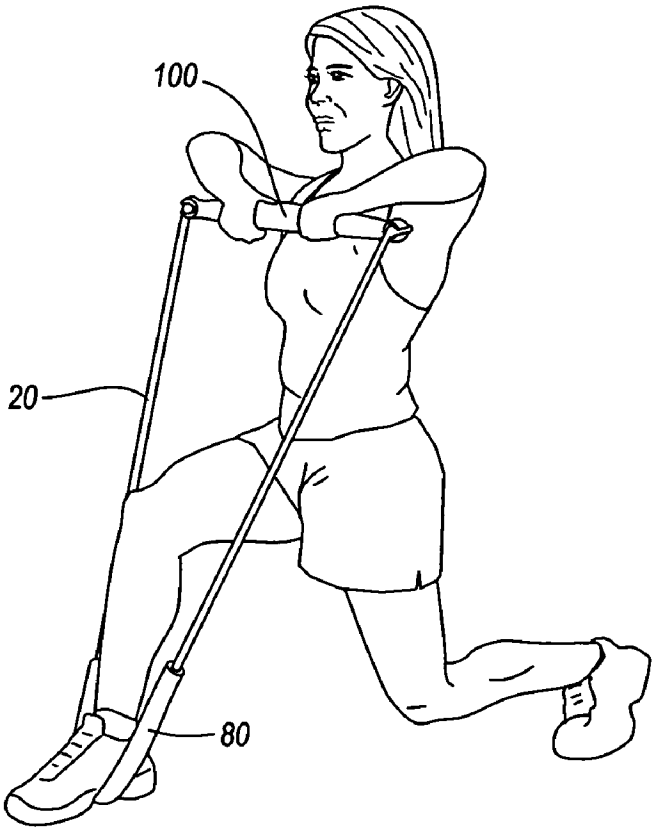
Figure 49A:
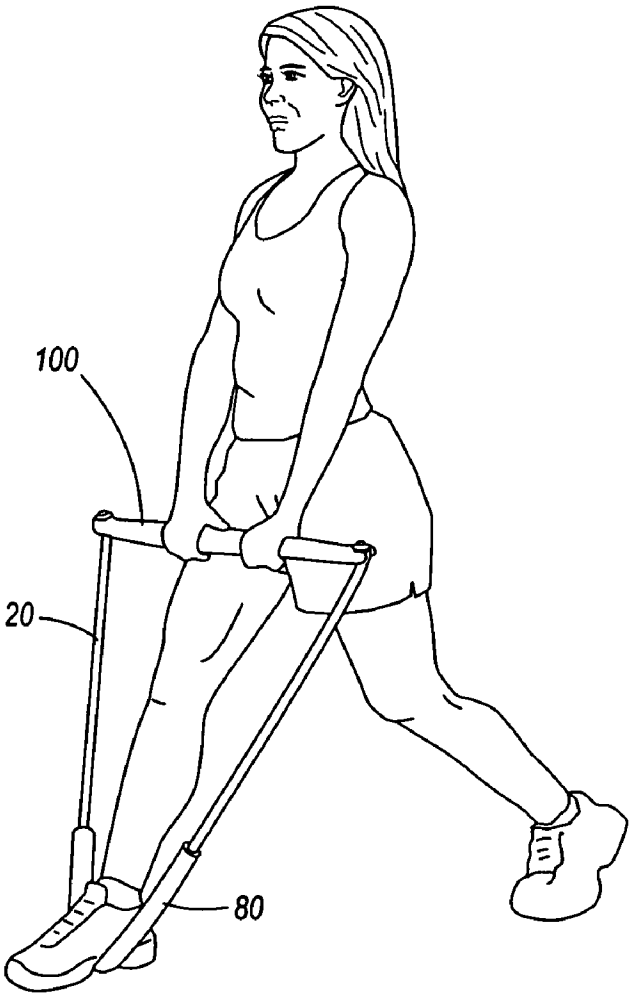

An upright row is illustrated in FIGS. 49A-B. The user is standing a shoulder width apart with each foot in a strap assembly 50. The user holds beam assembly 100 a shoulder width apart near the widest part with palms towards the body. The user begins with beam assembly 100 extended by the legs and keeps her chest lifted tall. The user raises the elbows towards ceiling, bringing beam assembly 100 to chin level. His or her elbows raise only parallel to the floor. The user then slowly lowers the beam assembly 100 back to starting position.

Shrugs are not illustrated, but can be accomplished by standing a shoulder width apart with each foot in a strap assembly 50. The user holds the beam assembly 100 a shoulder width apart and grasps the beam assembly 100 near center with the palms towards the body. The user begins with arms extended straight and chest lifted tall. Keeping the arms straight, the user shrugs his or her shoulders towards the ears. Then, she slowly lowers her shoulders back to starting position.

Triceps raises are not illustrated, but can be accomplished by standing in a lunge position with the cushioning device 80 centered under the back foot. A user holds the beam assembly 100 behind his or her back, a shoulder width apart and palms facing out. The user keeps his or her arms and wrists straight while raising the beam assembly 100 away from the body. The user then slowly lowers the beam assembly 100 back to starting position.

Figure 50:
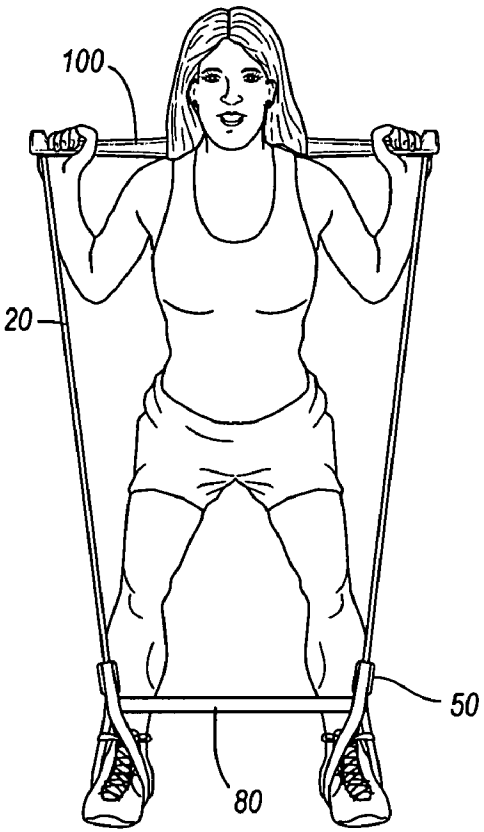

A squat is illustrated in FIG. 50. In this exercise, a user is standing a shoulder width apart with each foot in a strap assembly 50. The user holds the beam assembly 100 a shoulder width apart with palms facing down. The user then lifts the beam assembly 100 overhead, resting it on the shoulders (staying off the neck). Then with the user's palms facing forward and elbows pointing down, he or she lifts the torso while bending the knees to a 90-degree angle. (Like sitting down in a chair.) The user should keep the weight shifted back on the heels. The user's buttocks sit back and the knees stay over the ankles (not beyond her toes). Then the user straightens the knees back to starting position.

Figure 51B:
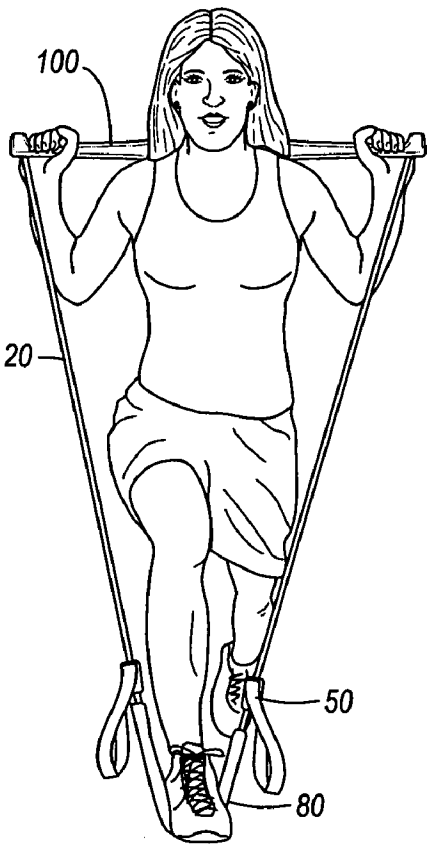
Figure 51A:
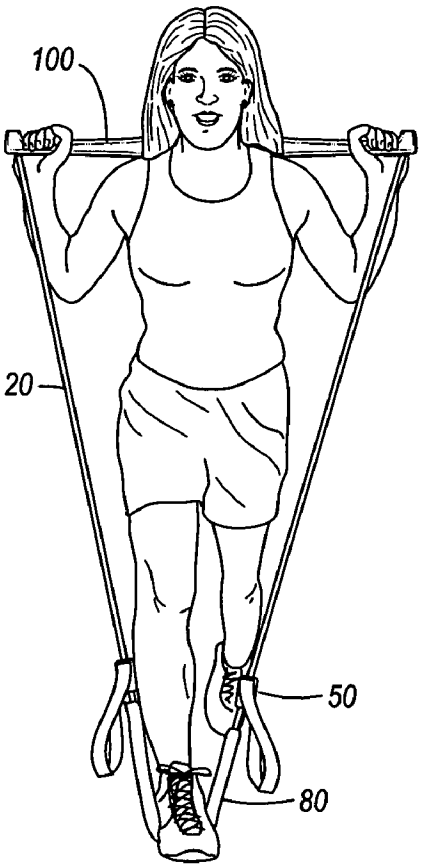

A lunge is illustrated in FIGS. 51A-B. The user stands in lunge position with the cushioning device 80 centered under the front foot holding the beam assembly 100 a shoulder width apart with palms facing down. The user then lifts the beam assembly 100 overhead, resting it on the shoulders (staying off the neck). With the palms facing forward and elbows pointing down, the user lifts his or her torso while bending the knees to a 90-degree angle. The weight should be centered in both legs. The user's front knee should stay over the ankle (not beyond the toes), and straightens knees back to starting position.

A bent over row is not illustrated, but is accomplished by standing a shoulder width apart with each foot in a strap assembly 50. The user holds the beam assembly 100 a shoulder width apart. The user can roll the beam assembly 100 towards the body to tighten the elastic cord assembly 20. The user then holds the beam assembly 100 a shoulder width apart and palms towards body keeping the knees slightly bent, and bends forward at the waist with the body parallel to floor. The user's back should be flat and the head neutral with the spine. The user then begins with the arms extended towards floor. He or she pulls the beam assembly 100 to the chest. Next, the user slowly lowers beam assembly 100 back to starting position.

A deadlift is not illustrated, but is accomplished by standing a shoulder width apart with each foot in a strap assembly 50. The user can roll the beam assembly 100 towards the body to tighten the elastic cord assembly 20. The user holds the beam assembly 100 a shoulder width apart and palms towards the body. The knees should be slightly bent. The user then bends forward at the waist until the body becomes parallel to floor, keeping the beam assembly 100 close to the legs. The user then ends with his or her back straight and the head neutral with the spine. The user squeezes the inner thighs and buttocks, keeping beam assembly 100 close to the legs, straightening his or her back to a standing position.

A front raise is not illustrated, but is accomplished by standing a shoulder width apart with each foot in a strap assembly 50. The user holds the beam assembly 100 shoulder width apart with palms facing body. Then keeping the elbows straight, he or she raises the beam assembly 100 up in front of the body, shoulder height, and parallel to the floor. The user then slowly lowers beam assembly 100 back to starting position.

A laying chest press is not illustrated, but is accomplished by positioning the center of the cushioning device 80 across the mid-back, holding the beam assembly 100. The user lays on floor with knees bent, feet flat on floor. The user can roll the beam assembly 100 towards the body to tighten the elastic cord assembly 20 to increase resistance. The user holds the beam assembly 100 a shoulder width apart, chest level. The user then fully extends the elbows straight up from the body, keeping the beam assembly 100 directly above the chest. The user then lowers the beam assembly 100 back to starting position.

A laying triceps extension is not illustrated, but can be accomplished by placing the center of the cushioning device 80 across the mid-back, holding the beam assembly 100. The user lays on floor with knees bent, feet flat on floor. The user can roll the beam assembly 100 towards the body to tighten the elastic cord assembly 20 to increase resistance. The user grasps the beam assembly 100 a shoulder width apart. The user raises beam assembly 100 to his or her forehead with elbows pointed towards ceiling, beam assembly 100 resting slightly above the forehead. The user keeps the wrists straight while squeezing the elbows towards the ears. The user then fully straightens the elbows, pressing the beam assembly 100 towards ceiling. The user's arms extend directly over the shoulders, palms facing forward. The user then slowly lowers the beam assembly 100 back to shoulder level.

A seated back row is not illustrated, but can be accomplished by sitting on the floor with legs together and slightly bent. The user places each foot in a strap assembly 50 around his or her feet. The user can roll the beam assembly 100 towards the body. The user holds beam assembly 100 a shoulder width apart. The user extends the arms straight towards the feet. The user then pulls the elbows toward the back wall, squeezing the shoulder blades together, keeping the chest lifted. The user then allows the arms to straighten back to starting position.

A torso twist is not illustrated, but is accomplished by removing the beam assembly 100 from the elastic cord assembly 20. The user sits on floor with knees bent and feet flat. The user inserts each foot in a strap assembly 50. The user places the beam assembly 100 on the elastic cord assembly 20. The user then extends the arms straight in front holding the beam assembly 100. The user rotates the torso to one side as far as possible. The user returns to center and goes opposite direction.

Figure 52A:
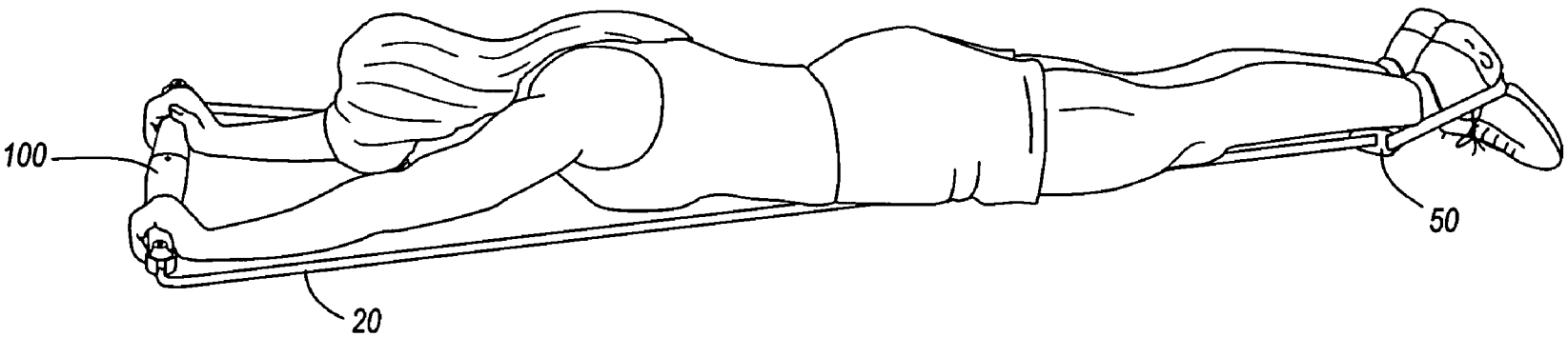
Figure 52B:
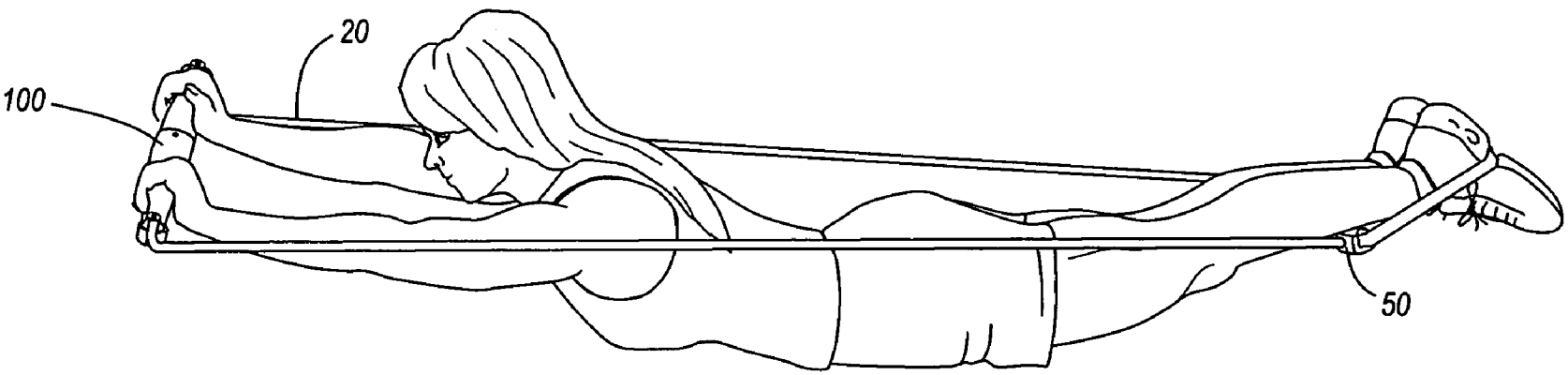

A superman is illustrated in FIGS. 52A-B and is accomplished by inserting each foot in a strap assembly 50 and placing the beam assembly 100 on the elastic cord assembly 20. The user lays on his or her stomach with the legs and arms extended. The user squeezes his or her glutes together. The user slowly raises the legs and arms off the floor. The user should position the head to look at beam assembly 100. The user then lowers the body; the beam assembly 100 and head are lowered to starting position.

Figure 53B:
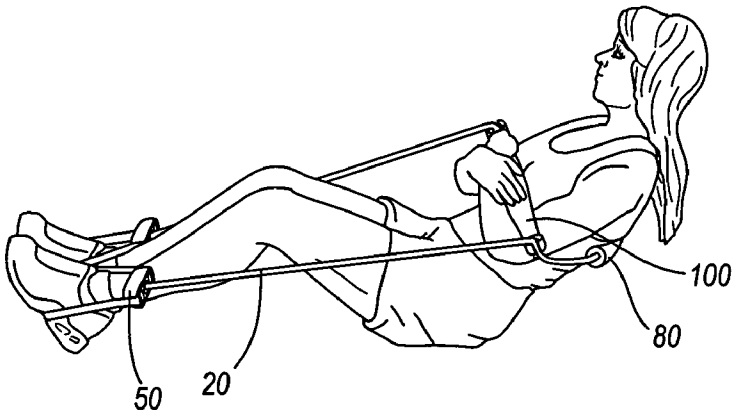
Figure 53A:
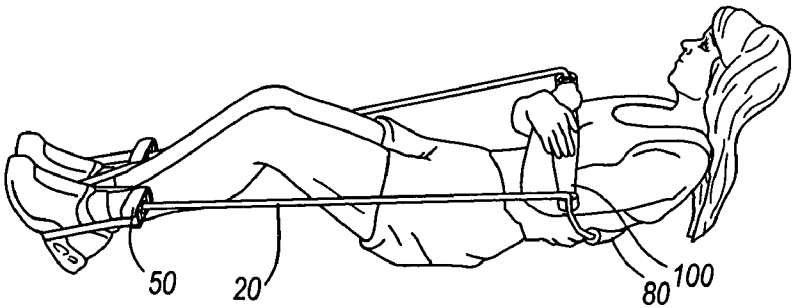

An abdominal roll up is illustrated in FIGS. 53A-B. The user removes beam assembly 100 from the elastic cord assembly 20. The user then inserts each foot into a strap assembly 50, placing the beam assembly 100 on the elastic cord assembly 20. The user crosses his or her arms to cradle the beam assembly 100, holding it close to the chest. The user lays flat on the floor with knees slightly bent. The user pulls the abdominals in towards spine. The user slowly raises his or her head and shoulders off floor. The user lowers the back down to the starting position.

Crunches are performed is a similar manner to the abdominal roll up discussed above. The user removes beam assembly 100 from the elastic cord assembly 20. The user inserts each foot into a strap assembly 50, placing the beam assembly 100 on the elastic cord assembly 20. The user crosses his or her arms to cradle the beam assembly 100, holding it close to the chest. The user then sits on floor with knees bent. The user keeps the neck relaxed, pulls abdominals in towards spine. The user keeps the upper body in a straight line, slowly lowers back towards floor a few inches. The user keeps the abdominals pulled in and raises the upper body back to the starting position.

Figure 54B:
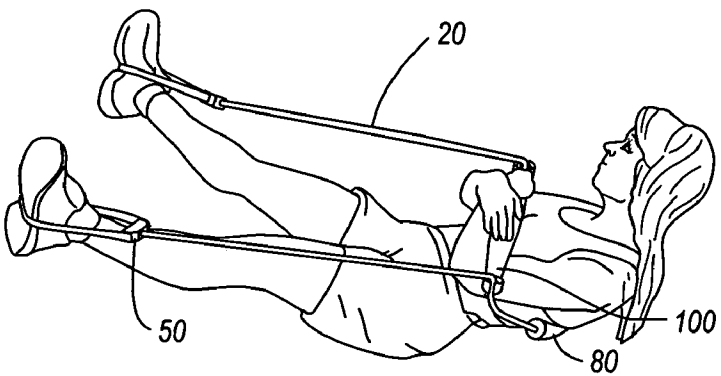
Figure 54A:
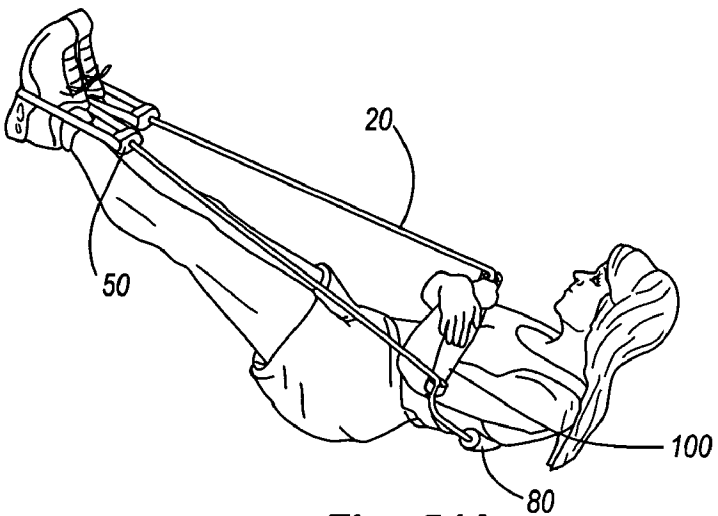

A V-sit is illustrated in FIGS. 54A-B. The user removes beam assembly 100 from the elastic cord assembly 20. The user inserts each foot into a strap assembly 50, placing the beam assembly 100 on the elastic cord assembly 20. The user crosses his or her arms to cradle beam assembly 100, holding it close to the chest. The user sits on floor with the knees slightly bent. The user keeps the neck relaxed, pulls abdominals in towards spine. Sitting tall, he or she slowly extends the legs to a diagonal while slightly leaning the upper body back on diagonal. The user then slowly lowers the legs and brings the upper body back to starting position.

Abdominal leg raises are not illustrated, but are accomplished by inserting each foot into a strap assembly 50, placing the beam assembly 100 on the elastic cord assembly 20. The user crosses his or her arms to cradle beam assembly 100, holding it close to the chest. The user lays flat on floor with legs straight. Then the user slowly raises head and shoulders off floor. The user extends legs up to 90 degrees and slowly lowers the legs a few inches towards floor, keeping the lower back pressed into floor. The user raises legs back to 90 degrees.

Figure 55B:
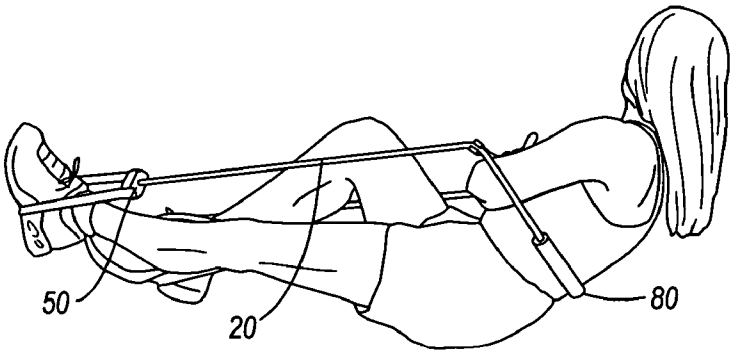
Figure 55A:
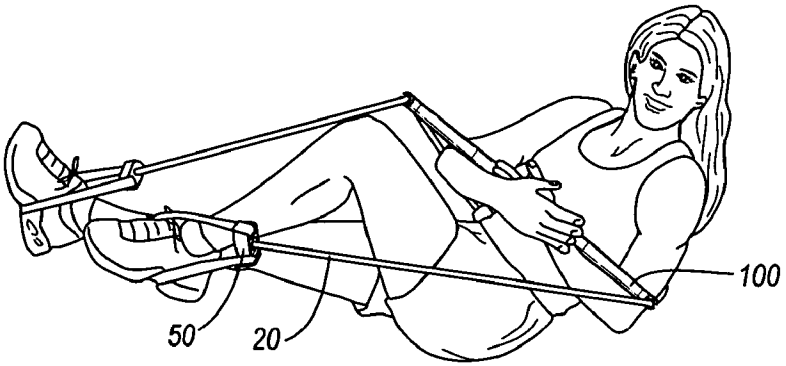

A bicycle is illustrated in FIGS. 55A-B. The user removes beam assembly 100 from the elastic cord assembly 20. The user inserts each foot into a strap assembly 50, placing the beam assembly 100 on the elastic cord assembly 20. The user crosses his or her arms to cradle the beam assembly 100, holding it close to the chest. The user then lays flat on floor with knees pulled up towards the chest. The user lifts head and shoulders off floor, then twists his or her right shoulder towards left knee while the right leg is extended. The user comes back to center and twists the left shoulder towards the right knee while the left leg is extended. The user continues alternating sides.

An inner/outer thigh is also illustrated in FIGS. 54A-B. The user removes beam assembly 100 from the elastic cord assembly 20. The user inserts each foot into a strap assembly 50 and places the beam assembly 100 on the elastic cord assembly 20. The user crosses his or her arms to cradle the beam assembly 100, holding it close to the chest. The user lays flat on floor with legs straight and pulls abdominals in towards spine. The user slowly raises his or her head and shoulders slightly off floor and extends the legs up to 90 degrees then lowers them to a diagonal. The user slowly spreads legs apart a few inches, keeping the lower back pressed onto the floor and squeezes the legs back together, then repeats.

Figure 56B:
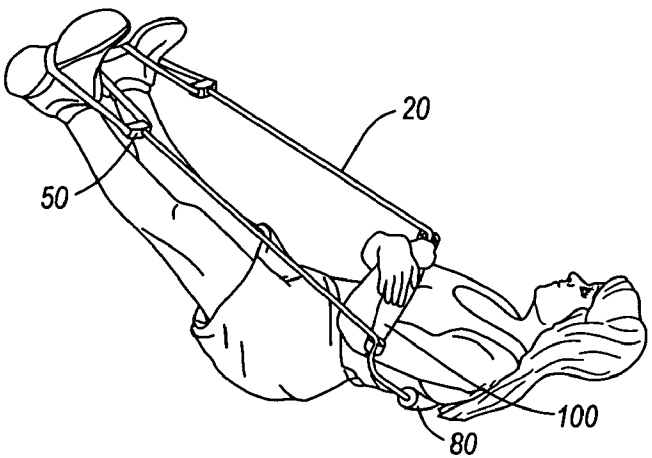
Figure 56A:
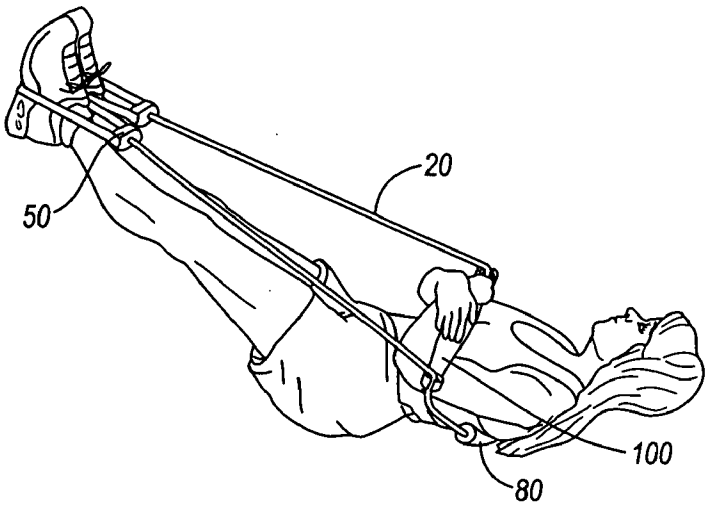

Leg circles are illustrated in FIGS. 56A-B. The user removes the beam assembly 100 from the elastic cord assembly 20. The user inserts each foot into a strap assembly 50 and places the beam assembly 100 on the elastic cord assembly 20. The user crosses the arms to cradle the beam assembly 100, holding it close to the chest. The user lays flat on the floor with legs straight and pulls the abdominals in towards the spine. The user slowly raises head and shoulders slightly off floor and extends the legs up to 90 degrees then lowers them to a diagonal. The user then slowly circles the legs in one direction tracing a small circle, keeping the lower back pressed onto the floor. After recovering from first direction, user circles the legs in an opposite direction keeping the lower back pressed onto the floor.

A straight leg raise is not illustrated, but is accomplished by inserting each foot into a strap assembly 50 and places the beam assembly 100 on the elastic cord assembly 20. The user positions the body on all fours, hips directly over knees and the arms directly under the shoulders. The user holds beam assembly 100 on the floor shoulder width apart and pulls the abdominals in towards the spine, keeping the back straight. The user then shifts his or her weight to the left leg, extending the right foot out straight. The user slowly raises his or her leg to ceiling then lowers the toes back to the floor, stopping an inch above floor. The user completes the right side, then repeats the process for the left side.

A bent knee raise is not illustrated, but is accomplished by inserting each foot into a strap assembly 50, placing the beam assembly 100 on the elastic cord assembly 20. The user positions the body on all fours, hips directly over the knees and the arms directly under her shoulders. The user holds beam assembly 100 on floor shoulder width apart and pulls the abdominals in towards the spine, keeping the back straight. The user shifts his or her weight to the left leg, keeping the leg bent and pressing the right foot towards the ceiling. The user then slowly lowers the bent knee back to the floor, stopping an inch above floor. The user completes the right side, then repeats the process on the left side.

Leg extensions (donkey kick) are not illustrated, but can be accomplished by inserting each foot into a strap assembly 50 and placing the beam assembly 100 on the elastic cord assembly 20. The user positions the body on all fours, hips directly over the knees and arms directly under the shoulders. The user holds the beam assembly 100 on floor a shoulder width apart and pulls the abdominals in towards the spine, keeping the back straight. The user shifts weight to left leg and extends the right foot towards the back wall. The user slowly bends his or her knee back to floor. The user completes right side, then repeats the process on the left side.

Figure 57:
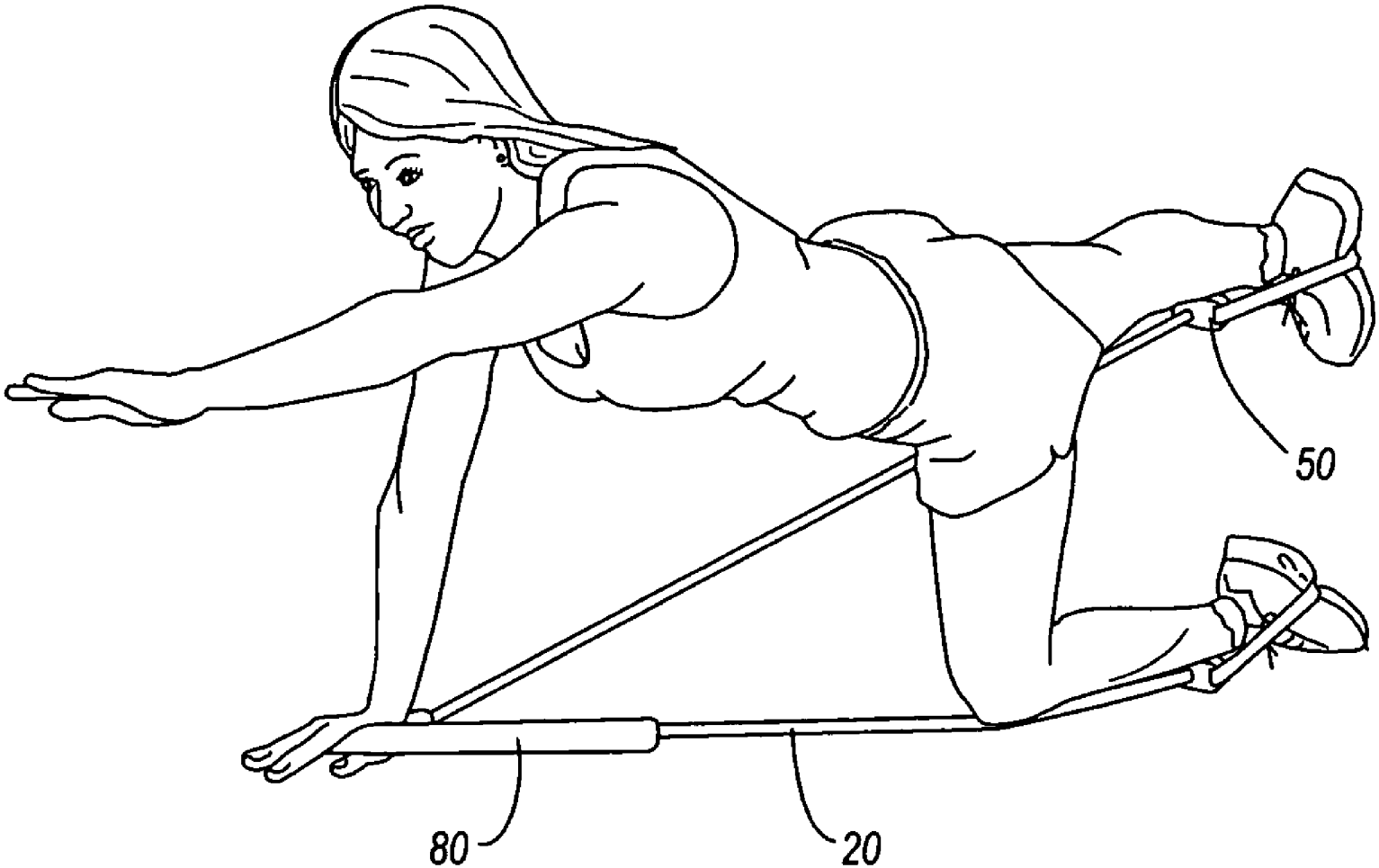

A bird dog is illustrated in FIG. 57. In this exercise, the user removes the beam assembly 100 from the elastic cord assembly 20, then inserts each foot into a strap assembly 50. The user positions the body on all fours, hips directly over knees, arms directly under the shoulders. The user holds the elastic cord assembly 20 on the floor a shoulder width apart and pulls the abdominals in towards the spine, keeping the back straight. The user shifts weight to the right arm, raising the left arm up parallel to the head. The user carefully extends the right foot out straight and slowly raises the balanced arm and leg down to the floor stopping an inch above the floor. The user slowly raises the arm and leg back parallel with the body. The user repeats the process on the other side.

An alternating biceps curl is not illustrated, but can be implemented by using the handle 200 or the strap assembly 50. The user stands a shoulder width apart centered on the elastic cord assembly 20. The user holds a handle 200 or strap assembly 50 in each hand and pulls the abdominals in towards the spine. The user's hands are resting at sides with palms facing up. The user keeps elbows tight at waist, raises one hand towards shoulder while keeping wrists straight. The user slowly lowers hand back to starting position and repeats on opposite side.

An alternate hammer curl is not illustrated, but is accomplished by standing a shoulder width apart centered on the elastic cord assembly 20. The user holds handle 200 or strap assembly 50 in each hand and pulls the abdominals in towards the spine. The user's hands are resting at his or her sides with palms facing his or her body. The user keeps elbows tight at the waist, raises one hand towards his or her shoulder while keeping wrists straight and palm turned towards his or her body. The user then slowly lowers his or her hand back to the starting position and repeats the process on the opposite side.

An alternate cross-body curl is not illustrated, but accomplished by standing a shoulder width apart centered on the elastic cord assembly 20. The user holds handle 200 or strap assembly 50 in each hand and pulls abdominals in towards spine. The user's hands are resting at his or her sides with palms facing up. The user keeps his or her elbows tight at the waist, raises one hand across body towards opposite shoulder while keeping his or her wrists straight. The user then slowly lowers his or her hand back to the starting position and repeats the process on the opposite side.

A diagonal curl is not illustrated, but is accomplished by standing a shoulder width apart centered on the elastic cord assembly 20. The user holds handle 200 or strap assembly 50 in each hand and pulls abdominals in towards spine. The user's hands should be resting at his or her sides with palms facing up, slightly rotated out. The user keeps his or her elbows tight at waist, raises his or her hands out in a diagonal motion up towards his or her shoulder while keeping wrists straight. The user then slowly lowers his or her hand back to the starting position and repeats the process on the opposite side.

An alternating front shoulder raise is not illustrated, but is accomplished by standing a shoulder width apart centered on the elastic cord assembly 20. The user holds handle 200 or strap assembly 50 in each hand, palms facing the back wall and pulls abdominals in towards spine. The user keeps his or her chest lifted tall and lifts one arm up straight, parallel to shoulders, palms facing floor. The user then slowly lowers his or her arm back to the beginning position and repeats the process on the opposite side.

A shoulder laterals straight arm is not illustrated, but is accomplished by standing a shoulder width apart centered on the elastic cord assembly 20. The user holds handle 200 or strap assembly 50 in each hand, palms facing his or her body and pulls abdominals in towards spine. The user keeps his or her chest lifted tall and lifts one arm out straight to the side, parallel to the shoulders with palms facing the floor. The user then slowly lowers his or her arm back to the beginning position and repeats the process on the opposite side.

A shoulder laterals bent arm is not illustrated, but is accomplished by standing a shoulder width apart centered on the elastic cord assembly 20. The user holds handle 200 or strap assembly 50 in each hand, palms facing the body and pulls abdominals in towards spine. The user keeps his or her chest lifted tall and lifts his or her forearms up to his or her sides, parallel to floor with palms facing her body. The user slowly raises her elbows up, parallel to the floor and palms facing the floor. The user then lowers them back to the beginning position.

An overhead triceps extension is not illustrated, but is accomplished by standing in a lunge position with the elastic cord assembly 20 under the back foot. The user pulls abdominals in towards the spine and holds the handle in one hand. The user then raises his or her arm overhead with elbows pointed towards the ceiling, palms facing up and his or her hand resting at shoulder. The user should keep his or her wrists straight while squeezing his or her elbow towards his or her head. The user fully straightens elbow, extending arm towards the ceiling and directly over shoulder, palm facing forward. The user then slowly bends elbow back to the starting position. The user repeats the process on the other side.

Figure 58B:
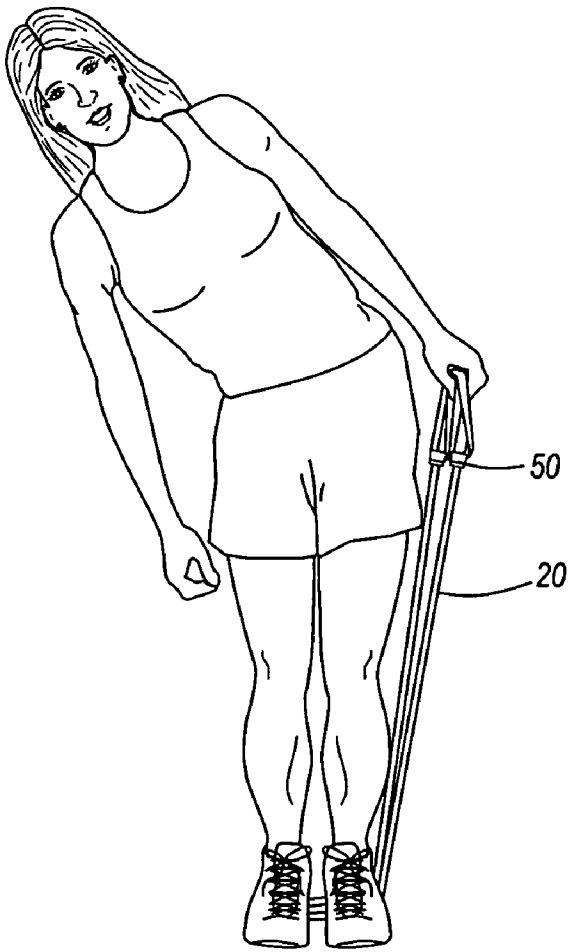
Figure 58A:
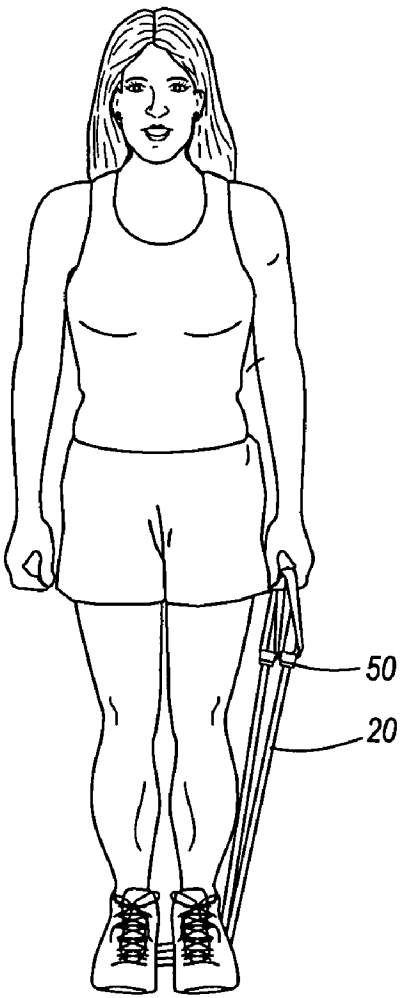

The oblique bends are illustrated in FIGS. 58A-B. The user stands a shoulder width apart centered on the elastic cord assembly 20. The user holds the handle (with both ends of the elastic attached to the handle) or the strap assembly in one hand, palms facing the body and pulls abdominals in towards the spine. The user keeps the chest lifted tall. With shoulders stacked over his or her hips, bending at the waist towards one side then straightening back to the center. The process can be repeated for the opposite side where the user bends in the opposite direction.

Figure 59B:
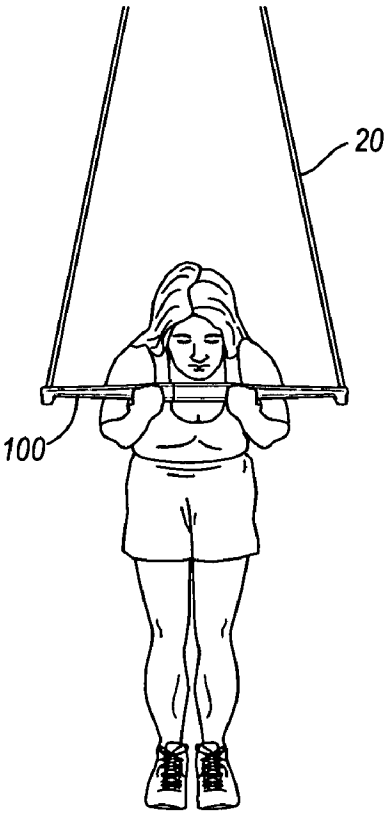
Figure 59A:
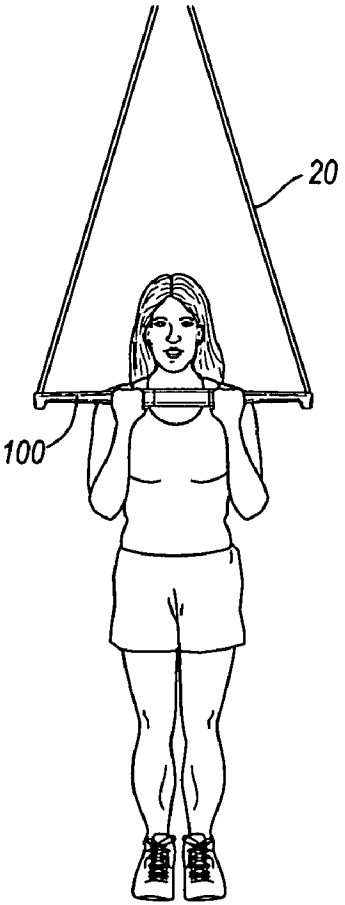

A standing abdominal crunch is illustrated in FIGS. 59A-B. The user places the door strap at the top of a door jam and centers the door strap on the cushioning device 80. The user stands centered between the elastic cord assembly 20, facing away from door, feet together, knees slightly bent. The user grasps the beam assembly 100 with palms facing up and pulls abdominals in towards spine. With the elbows bent at sides, squeezing his or her waist, hands at shoulder level and wrists straight, the user then slowly curls his or her body over the beam assembly 100. Keeping abdominal contracted, the user slowly raises body back to the starting position.

A kneeling abdominal crunch is not illustrated, but is preformed in a similar manner. The user places door strap at top of the door jam and centers the door strap on the cushioning device 80. The user kneels with knees together centered between the elastic cord assembly 20 facing away from the door and grasps the beam assembly 100 with palms facing up. The user then pulls his or her abdominals in towards spine, elbows bent at sides squeezing waist and hands at shoulder level, wrists straight. The user slowly curls body over the beam assembly 100, keeping abdominals contracted, and then slowly raises his or her body back to the starting position.

Figure 60B:
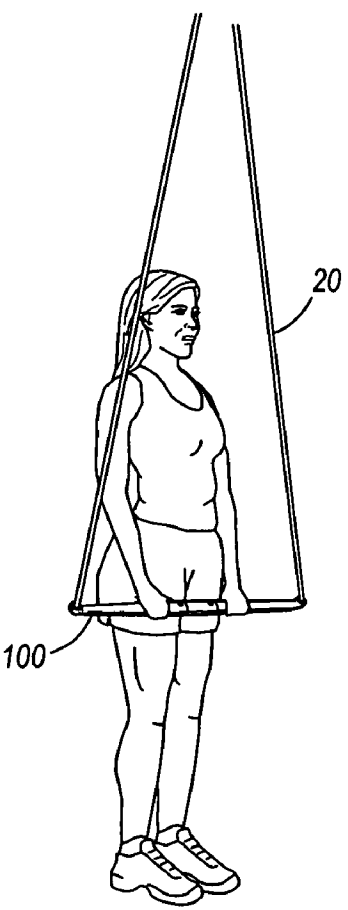
Figure 60A:
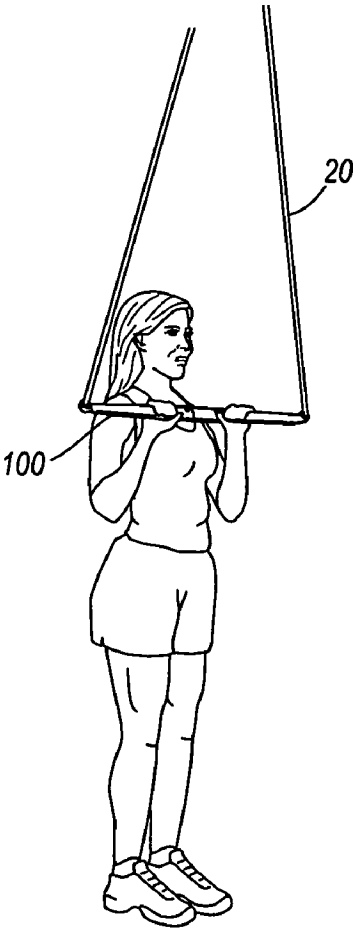

The triceps press down is illustrated in FIGS. 60A-B. The user places door strap at the top of the door jam and centers the door strap on the cushioning device 80. The user stands centered between the elastic cord assembly 20, facing away from the door, feet together, knees slightly bent. The user grasps the beam assembly 100 with palms facing down and pulls abdominals in towards the spine. With elbows bend at sides and squeezing his or her waist, the user slowly extends arms straight pressing the beam assembly 100 towards the floor. Then, her or she controls the beam assembly 100 back up to the starting position.

Figure 61B:
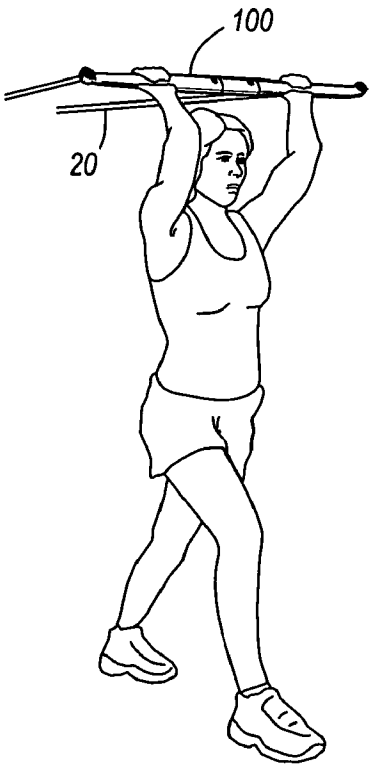
Figure 61A:
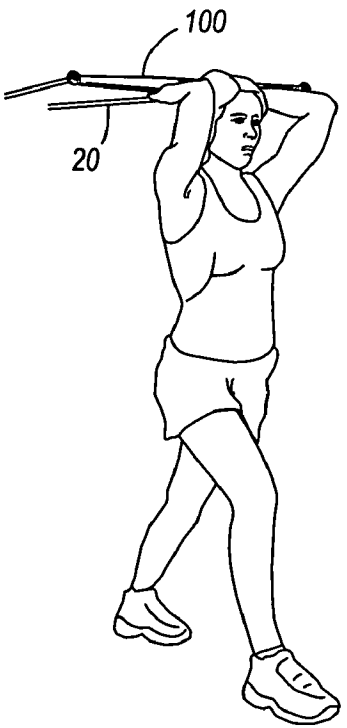

The triceps pull down is illustrated in FIGS. 61A-B. The user places door strap at top of door jam, centers the door strap on the cushioning device 80. The user stands centered between the elastic cord assembly 20, facing away from the door, feet together, knees slightly bent. The user grasps the beam assembly 100 with palms facing up and pulls abdominals in towards the spine. With elbows bent overhead, the user slowly extends arms straight pulling the beam assembly 100 forward. The user then controls the beam assembly 100 back to the starting position.

Figure 62B:
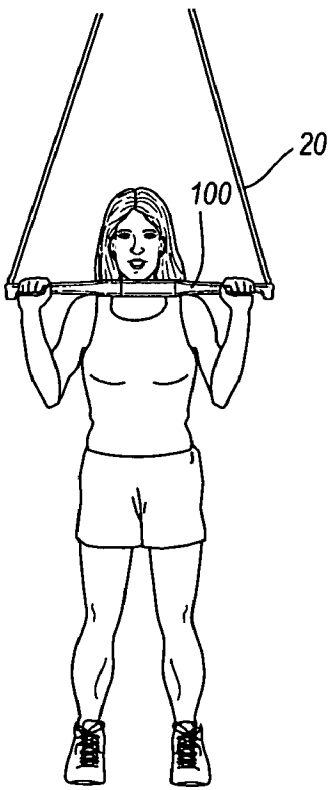
Figure 62A:
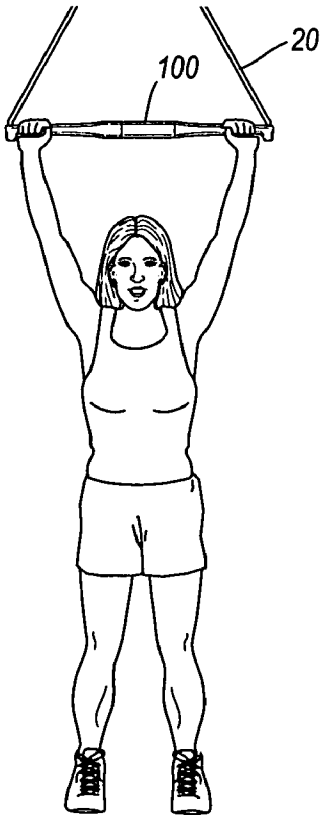

A lat pull down is illustrated in FIGS. 62A-B. The user places the door strap at top of door jam, centers the door strap on the cushioning device 80. The user stands centered between the elastic cord assembly 20, facing away from the door and stands with his or her feet a shoulder width apart and knees slightly bent. The user grasps the beam assembly 100 with palms facing forward and pulls the abdominals in towards the spine, keeping the chest lifted. The user then extends his or her arms towards the ceiling and bends elbows, pulling the beam assembly 100 down to shoulder level. The user extends arms back up to the starting position.

A lat pull over is not illustrated, but accomplished by placing the door strap at the top of the door jam and centering the door strap on the cushioning device 80. The user stands centered between the elastic cord assembly 20, facing away from door, positioning his or her feet a shoulder width apart and knees slightly bent. The user grasps the beam assembly 100 with palms facing forward and pulls the abdominals in towards spine, keeping the chest lifted. With arms extended towards ceiling and straight, he or she pulls the beam assembly 100 down towards his or her legs. The user then extends arms back to the starting position.

Figure 63B:
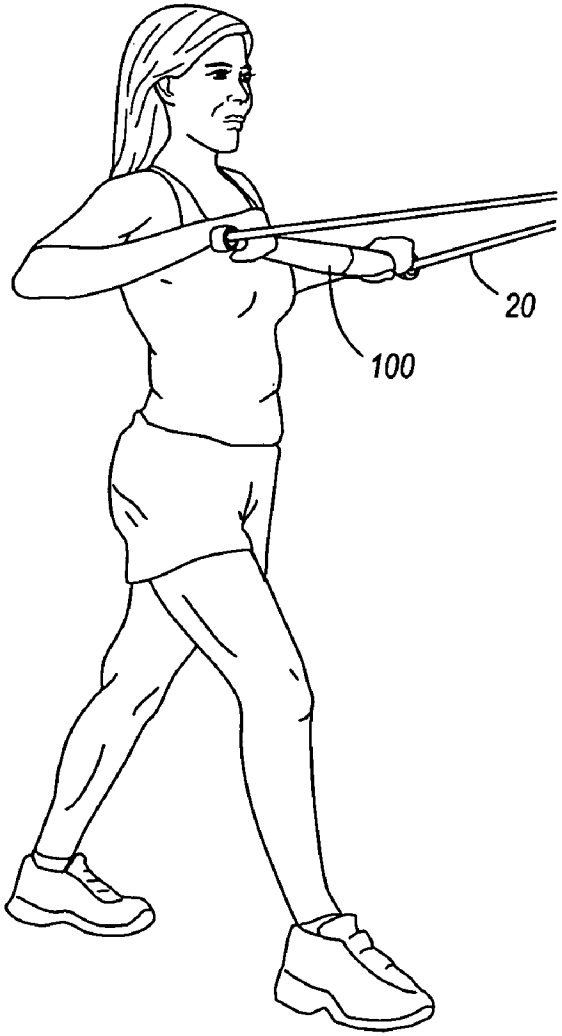
Figure 63A:
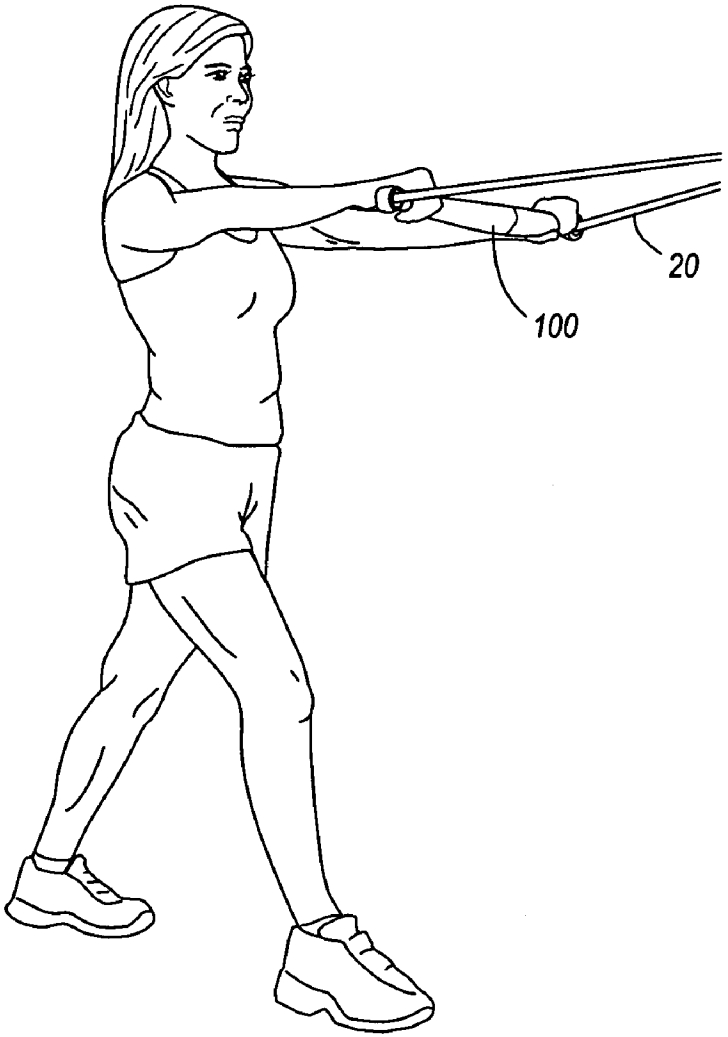

A back row is illustrated in FIGS. 63A-B. The user places the door strap at the middle of the door jam and centers the door strap on the cushioning device 80. The user stands in front of the beam assembly 100 facing door in lunge position. The user grasps beam assembly 100 with palms facing the floor at chest level. The arms are extended parallel to floor. The user pulls abdominals in towards the spine, keeping the chest lifted. The user then slowly pulls the beam assembly 100 towards the chest, squeezing the shoulder blades together. The user extends his or her elbows back to the starting position.

Figure 64B:
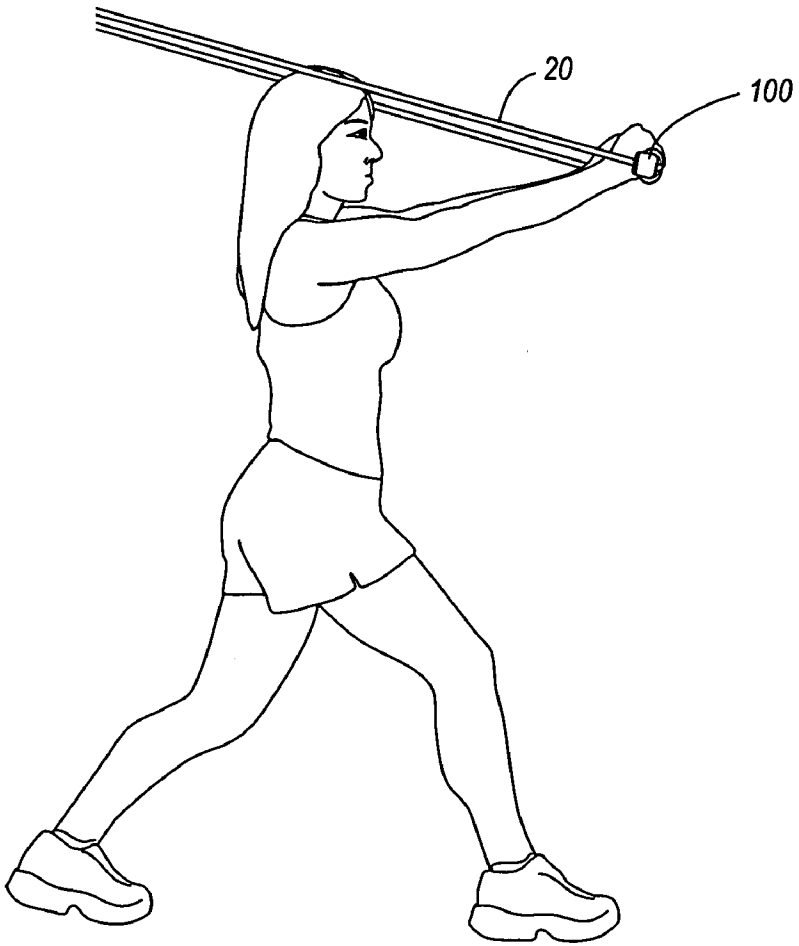
Figure 64A:
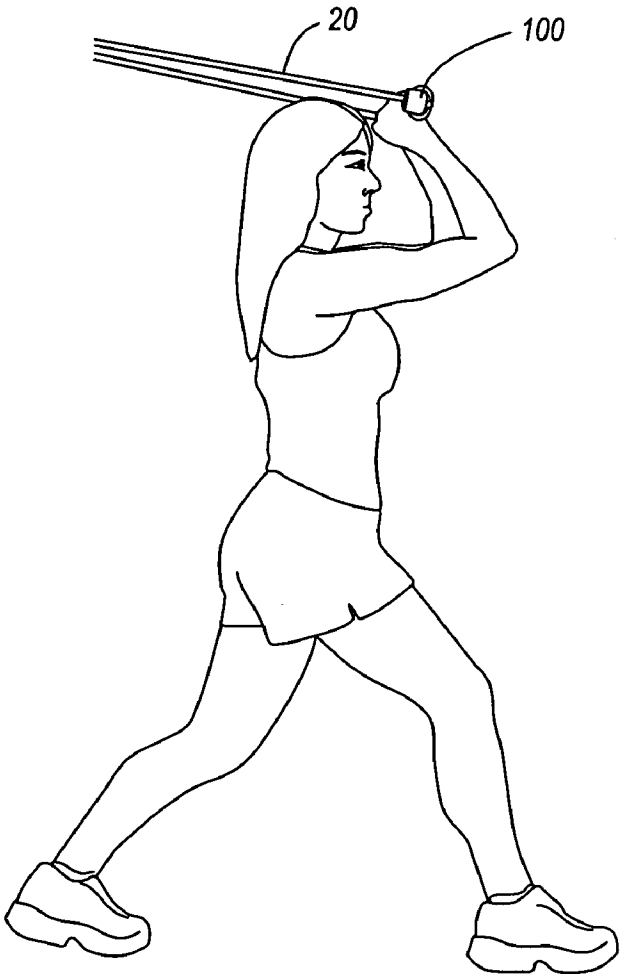

The triceps extension is illustrated in FIGS. 64A-B. The user places the door strap at the middle of the door jam and centers the strap on the cushioning device 80. The user stands in the middle of the elastic cord assembly 20 facing away from the door in a lunge position. The user grasps the beam assembly 100 with the palms facing the floor at chest level and pulls the abdominals in towards the spine, keeping the chest lifted. The user then pulls the arms up to the shoulder level, elbows parallel to the floor. The user raises the beam assembly 100 to his or her forehead, slowly extends the elbows straight, arms parallel to floor and palms facing down. The user bends elbows back to forehead.

A reverse lat pull over is not illustrated, but is accomplished by placing the door strap at bottom of the door jam and centering the door strap on the cushioning device 80. The user stands facing the door with feet shoulder width apart, knees slightly bent. The user grasps the beam assembly 100 slightly wider than shoulder width apart and pulls the abdominal towards the spine. With the arms extended down at legs and palms facing the body, the user keeps arms and wrists straight and pulls the beam assembly 100 up overhead, lifting the chest tall. The user then slowly lowers the back to the starting position.

A biceps curl is not illustrated, but accomplished by placing the door strap at bottom of the door jam and centering the door strap on the cushioning device 80. The user stands facing the door, feet a shoulder width apart and knees slightly bent and pulls the abdominals in towards the spine. The user grasps the beam assembly 100 shoulder width apart with palms facing up. With the hands and beam assembly 100 resting at the legs, the user bends elbows, squeezing towards the waist. Keeping the elbows tight at the waist, the user raises the beam assembly 100 towards the shoulders while keeping the wrists straight. The user then slowly lowers the beam assembly 100 back to the starting position.

A shoulder front raise is not illustrated, but is accomplished by placing the door strap at bottom of the door jam and centering the door strap on the cushioning device 80. The user stands facing the door, feet a shoulder width apart, knees slightly bent and pulls the abdominals in towards the spine. The user holds the beam assembly 100 a shoulder width apart and the palms facing the body. Keeping elbows straight, user raises the beam assembly 100 up in front of his or her body, shoulder height and parallel to the floor. The user slowly lowers the beam assembly 100 back to the starting position.

An upright row is not illustrated, but is accomplished by placing the door strap at bottom of the door jam and centering the door strap on the cushioning device 80. The user stands facing the door, feet a shoulder width apart, knees slightly bent and pulls the abdominals in towards the spine. The user holds the beam assembly 100 a shoulder width apart. The user grasps the beam assembly 100 near center, arms straight down and palms facing the body. The user then raises the elbows towards the ceiling, bringing the beam assembly 100 to chin level. The user slowly lowers the beam assembly 100 back to the starting position.

A shrug is not illustrated, but is accomplished by placing the door strap at bottom of the door jam and centering the door strap on the cushioning device 80. The user stands facing the door, feet a shoulder width apart, knees slightly bent. The user pulls the abdominals in towards the spine and grasps the beam assembly 100 near the center with palms facing the body. The user begins with arms extended straight. Keeping the chest lifted tall and arms straight, the user shrugs his or her shoulders towards his or her ears. The user then slowly lowers shoulders back to the starting position.

A triceps press down is not illustrated, but is accomplished by placing the door strap at top of the door jam and centering the door strap on the cushioning device 80. The user stands centered between the elastic cord assembly 20, facing away from the door, feet together and knees slightly bent. The user grasps the handles with palms facing down and pulls the abdominals in towards the spine. With the elbows bent at the sides, squeezing the waist, the user slowly extends arms straight pressing the handles towards the floor. The user bends his or her arms back up to the starting position.

A lat pull down is not illustrated, but is accomplished by placing the door strap at top of the door jam and centering the door strap on the cushioning device 80. The user stands centered between the elastic cord assembly 20, facing away from the door, positioning the feet a shoulder width apart and knees slightly bent. The user grasps the handles with the palms facing forward and pulls the abdominals in towards the spine, keeping the chest lifted. The user extends the arms towards the ceiling. Bending the elbows, the user pulls the handles down to shoulder level. The user extends the arms back up to the starting position.

A lat pull over is not illustrated, but is accomplished by placing the door strap at top of the door jam and centering the door strap on the cushioning device 80. The user stands centered between the elastic cord assembly 20, facing away from the door, positioning the feet a shoulder width apart and knees slightly bent. The user grasps the handles with the palms facing forward and pulls the abdominals in towards the spine, keeping the chest lifted. With the arms extended towards the ceiling, the user keeps arms straight and pulls the handles down towards the legs. The user then extends the arms back to the starting position.

A standing abdominal crunch is not illustrated, but is accomplished by placing the door strap at top of the door jam and centering the door strap on the cushioning device 80. The user stands centered between the elastic cord assembly 20, facing away from the door, feet together, knees slightly bent. The user grasps the handles with the palms facing the body and pulls the abdominals in towards the spine. With the elbows bent at the sides, squeezing the waist, hands at shoulder level and wrists straight, the user slowly curls the body down with the handles tight at the shoulders. The user keeps the abdominals contracted and slowly raises the body back to the starting position.

A chest press is not illustrated, but is accomplished by placing the door strap at the middle of the door jam and centering the door strap on the cushioning device 80. The user stands in the middle of the elastic cord assembly 20 facing away from the door in a lunge position. The user grasps the handles with the palms facing down. With the arms at chest level, the user pulls the abdominals in towards the spine, keeping the chest lifted. The user slowly extends the arms out straight, away from the body and parallel to the floor. The user then bends his or her elbows and pulls his or her arms back towards the chest.

Chest flies are not illustrated, but are accomplished by placing the door strap at the middle of the door jam and centering the door strap on the cushioning device 80. The user stands in the middle of the elastic cord assembly 20 facing away from the door in a lunge position. The user grasps the handles with palms facing in. With arms at chest level, the user pulls the abdominals in towards the spine, keeping the chest lifted and the elbows slightly bent. The user then slowly pulls the arms out in a semicircle, squeezing shoulder blades together, lifting chest up. The user keeps elbows slightly bent, pulls arms back together to the starting position.

A standing row is not illustrated, but is accomplished by placing the door strap at the middle of the door jam and centering the door strap on the cushioning device 80. The user stands facing the door in a lunge position. The user grasps the handles with the palms facing the floor at chest level. With the arms extended parallel to the floor, the user pulls the abdominals in towards spine, keeping the chest lifted. The user then slowly pulls the arms back towards the chest, squeezing the shoulder blades together. The user extends elbows back to the starting position.

The rear deltoid flies are not illustrated, but are accomplished by placing the door strap at the middle of the door jam and centering the door strap on the cushioning device 80. The user stands facing the door in a lunge position. The user grasps the handles with the palms facing in. With the arms extended parallel to floor, the user pulls the abdominals in towards the spine, keeping the chest lifted. The user then slowly pulls arms out in a semicircle, squeezing the shoulder blades together. The user keeps elbows slightly bent and pulls arms back together to the starting position.

The inner thigh raises are not illustrated, but accomplished by placing the door strap at the bottom of the door jam and centering the door strap on the cushioning device 80. The user inserts one foot in both feet straps. The user pulls the abdominals in towards the spine. Keeping the chest lifted and spine aligned and standing leg slightly bent, the user raises leg with the foot straps across the body, squeezing the inner thigh. The user returns back to the starting position and repeats the process with the other leg.

Outer thigh raises are not illustrated, but are accomplished by placing the door strap at the bottom of the door jam and centering the door strap on the cushioning device 80. The user inserts one foot in both foot straps. The user pulls the abdominals in towards the spine. Keeping the chest lifted, spine aligned and standing leg slightly bent, the user raises leg with the foot straps away from the body, squeezing the hip. The user returns back to the starting position.

A reverse lat pull over is not illustrated, but is accomplished by placing the door strap at the bottom of the door jam and centering the door strap on the cushioning device 80. The user stands facing the door, feet a shoulder width apart and knees slightly bent. The user grasps a handle in each hand, palms facing the legs. The user pulls the abdominal in towards the spine. With the arms extended down at legs, the user keeps arms and wrists straight and pull arms up overhead, lifting the chest tall. The user slowly lowers the handles back to the starting position.

A biceps curl is not illustrated, but is accomplished by placing the door strap at the bottom of the door jam and centering the door strap on the cushioning device 80. The user stands with feet a shoulder width apart, knees slightly bent. The user holds the handle in each hand and pulls the abdominals in towards the spine. With the hands resting at sides and palms facing up, the user keeps elbows tight at waist and raises his or her hands towards the shoulder while keeping the wrists straight. The user slowly lowers his or her hand back to the starting position.

An external shoulder rotation is not illustrated, but is accomplished by placing the door strap at the bottom of the door jam and centering the door strap on the cushioning device 80. The user stands facing the door and grasps a handle in one hand. The user holds the arm at a 90 degree angle from the shoulder, palm facing down, wrist straight, arm parallel to floor. The user pulls the abdominals in towards the spine. The user keeps wrist straight, pulling the elastic cord assembly 20 back to form a square, stopping the hand at head level and the arm remaining parallel to floor. The user then lowers the elbows back to the starting position.

A shoulder front raise is not illustrated, but is accomplished by placing the door strap at the bottom of the door jam and centering the door strap on the cushioning device 80. The user stands a shoulder width apart, knees slightly bent. The user holds a handle in each hand, palms facing down. The user pulls the abdominals in towards the spine. Keeping the chest lifted tall, the user lifts arms up straight, parallel to shoulders, palms facing floor. The user then slowly lowers the arm back to the beginning position.

A shoulder lateral raise is not illustrated, but is accomplished by placing the door strap at the bottom of the door jam and centering the door strap on the cushioning device 80. The user stands a shoulder width apart, knees slightly bent. The user holds a handle in each hand, palms facing the body. The user pulls the abdominals in towards the spine. The user keeps the chest lifted tall and lifts the arms out straight to the side, parallel to the shoulders, palms facing the floor. The user then slower lowers the arms back to the beginning position.

Figure 65B:
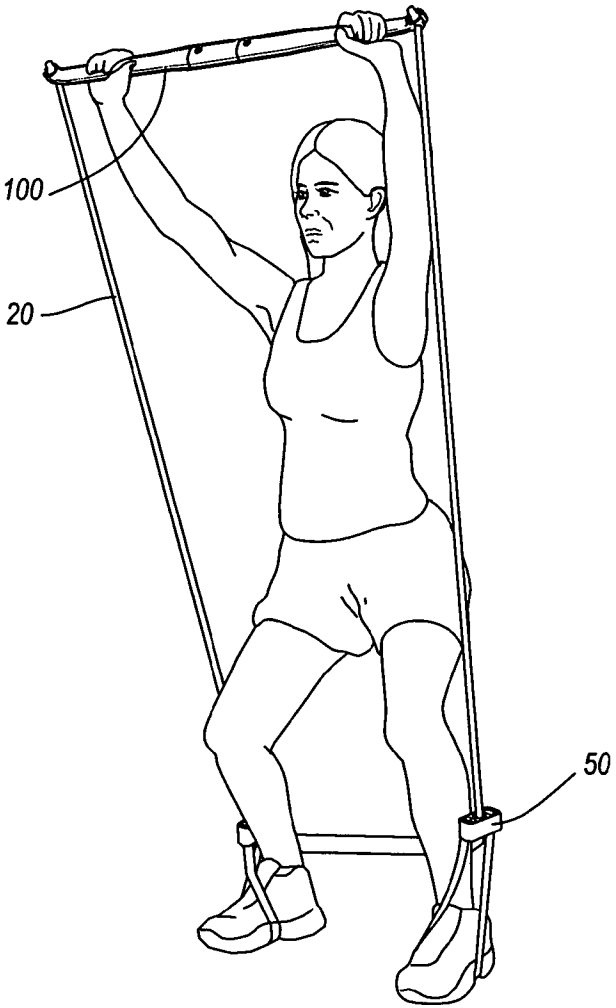
Figure 65A:
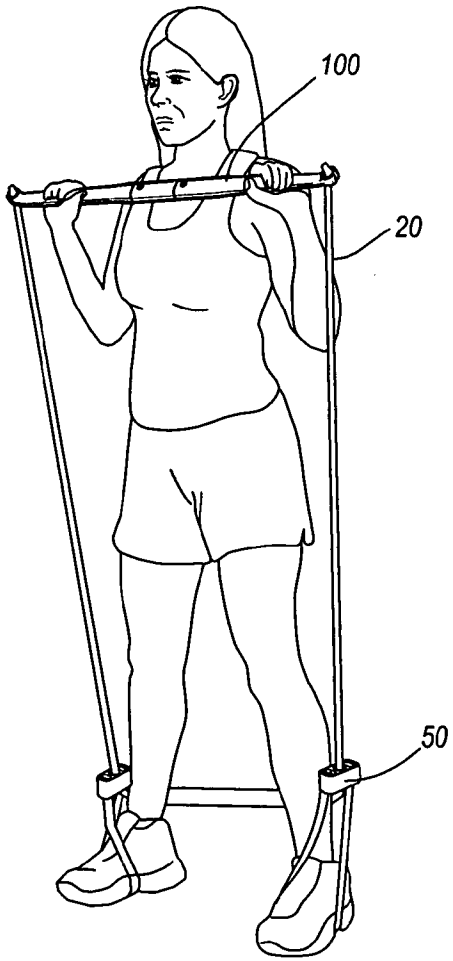

The squat and press is illustrated in FIGS. 65A-B. The user stands a shoulder width apart with each foot in a strap assembly 50. The user pulls the abdominals in towards the spine.

The user holds the beam assembly 100 a shoulder width apart, palms face down and lifts the beam assembly 100 to the chest level. With the palms facing forward, elbows pointing down and chest lifted while bending knees to a 90-degree angle (like sitting down in a chair), the user keeps his or her weight shifted back on heels, buttocks sitting back and knees staying over the ankles (not beyond the toes). While going down into squat position, the user lifts the beam assembly 100, fully straightening the elbows towards ceiling. The user slowly lowers the beam assembly 100 back to shoulder level as the knees straighten back to the starting position.

The squat and row is not illustrated, but is accomplished by standing a shoulder width apart with each foot in a strap assembly 50. The user pulls the abdominals in towards the spine. The user holds the beam assembly 100 with hands close together and palms facing down. The user's chest is lifted while bending knees to a 90-degree angle. (Like sitting down in a chair.) The user keeps his or her weight shifted back on heels, buttocks sitting back and knees staying over the ankles (not beyond the toes). While going down into squat position, the user raises the elbows towards ceiling, bringing the beam assembly 100 to chin level. The elbows raise only parallel to the floor. The user then slowly lowers the beam assembly 100 back towards the legs as the knees straighten back to the starting position.

The squat and curl is not illustrated, but is accomplished by standing a shoulder width apart with each foot in a strap assembly 50. The user pulls the abdominals in towards the spine. The user holds the beam assembly 100 a shoulder width apart, palms facing up. The chest is lifted while bending the knees to a 90-degree angle. (Like sitting down in a chair.) The user keeps his or her weight shifted back on the heels, buttocks sitting back and knees staying over the ankles (not beyond the toes). While going down into squat position, the user bends the elbows, squeezing towards the waist. The user keeps the elbows tight at waist, raises the beam assembly 100 towards the shoulders while keeping the wrists straight. The user slowly lowers the beam assembly 100 back towards the legs as the knees straighten back to the starting position.

The lunge and row is not illustrated, but is accomplished by standing in a lunge position with the cushioning device 80 centered under the front foot. The user pulls the abdominals in towards the spine. The user holds the beam assembly 100 a shoulder width apart, palms facing forward and elbows pointing down. The chest is lifted while bending the knees to a 90-degree angle. The user keeps his or her weight centered in both legs. The front knee stays over the ankle (not beyond the toes). While going down into a lunge position, the user raises the elbows towards the ceiling, bringing the beam assembly 100 to chin level. Elbows raise only parallel to the floor. The user slowly lowers the beam assembly 100 back towards the legs as the knees straighten back to the starting position.

The lunge and curl is not illustrated, but is accomplished by standing in a lunge position with the cushioning device 80 centered under the front foot. The user pulls the abdominals in towards the spine. The user holds the beam assembly 100 a shoulder width apart, palms facing up. Chest is lifted while bending knees to a 90-degree angle. (Like sitting down in a chair.) The user keeps his or her weight shifted back on the heels, buttocks sitting back and knees staying over ankles (not beyond the toes). While going down into lunge position, user bends the elbows, squeezing towards the waist. The user keeps elbows tight at waist, raises the beam assembly 100 towards the shoulders while keeping the wrists straight. The user slowly lowers the beam assembly 100 back towards the legs as the knees straighten back to the starting position.

The lunge and press is not illustrated, but is accomplished by standing in a lunge position with the cushioning device 80 centered under the front foot. The user holds the beam assembly 100 a shoulder width apart, palms facing down. The user then lifts the beam assembly 100 to chest level. With the palms facing forward, elbows point down, the chest is lifted while bending the knees to a 90-degree angle. (Like sitting down in a chair.) The user keeps his or her weight shifted back on the heels, buttocks sitting back and knees staying over the ankles (not beyond the toes). While going down into a lunge position, the user lifts the beam assembly 100, fully straightens the elbows towards the ceiling. The user then slowly lowers the beam assembly 100 back to shoulder level as the knees straighten back to the starting position.

Figure 66B:
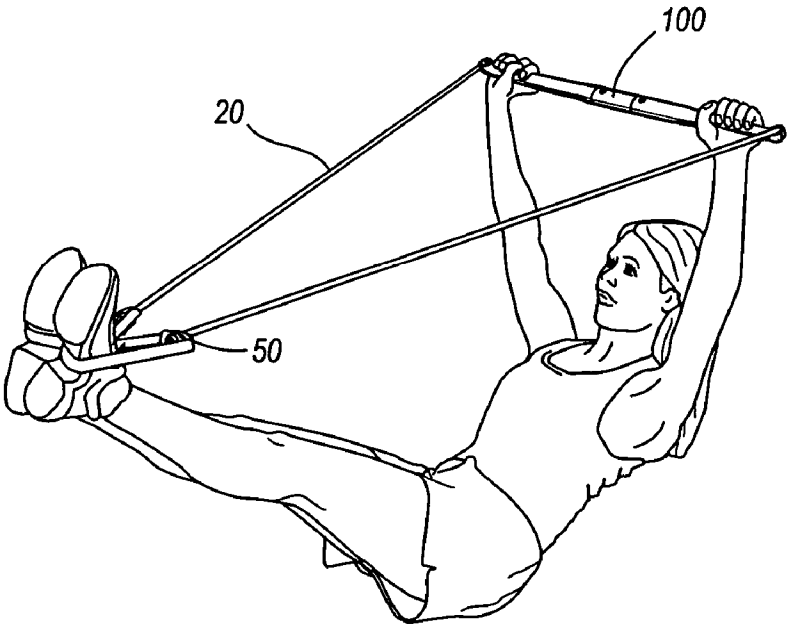
Figure 66A:
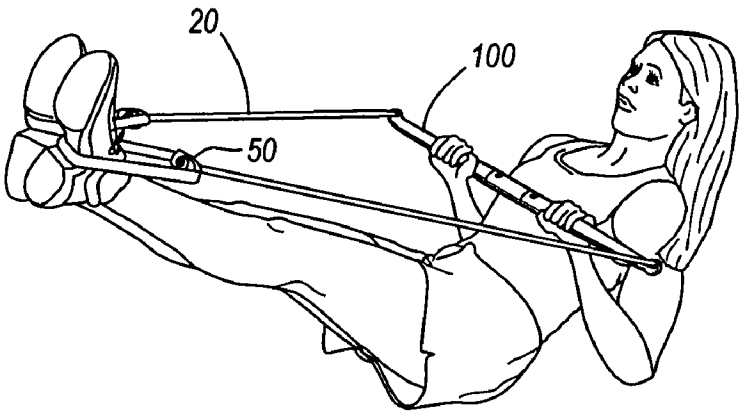

The v-sit shoulder press is illustrated in FIGS. 66A-B. The user inserts his or her feet in the foot straps, places the beam assembly 100 on the elastic cord assembly 20. The user holds the beam assembly 100 shoulder level and palms facing forward. The user sits on floor with knees slightly bent. The user keeps neck relaxed, pulls the abdominals in towards spine. Sitting tall, the user then slowly extends the legs to a diagonal while slightly leaning his or her upper body back on a diagonal. While going into the v-sit position, user fully straightens the elbows to lift the beam assembly 100 towards the ceiling. The user then slowly lowers the legs and arms back to the starting position.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An exercise system kit comprising:

an elastic cord assembly including an elastic and plugs, the elastic having a first and second end and a stretch between the first and second ends, one of the plugs being inserted into the first end and another one of the plugs being inserted into the second end;

at least one strap assembly slidably attached to the elastic cord assembly, the strap assembly including a strap and a block, the block having an aperture formed from one side to another side of the block forming an unbroken wall through the block, the strap being connected to the block in a manner that forms a loop in the strap;

a beam assembly including a receiver section, a tongue section and a locking device, one end of the receiver section being configured to be connected to one of the first and second ends of the elastic cord assembly and the opposing end of the receiver section being configured to be connected to the tongue section, one end of the tongue section being configured to be connected to the other of the first and second ends of the elastic cord assembly and the opposing end of the tongue section being configured to be connected to the receiver section, at least one of the receiver section and the tongue section having a first surface and a second surface; and illustrations placed on at least one of the first and second surfaces for observation by the user, the illustrations showing various configurations for the user to perform selected exercises.

2. The exercise system kit of claim 1, further comprising a cushioning device disposed on the elastic cord assembly between the first and second ends of the elastic.

3. The exercise system kit of claim 1, further including an extension to be connected between the receiver section and the tongue section.

4. The exercise system kit of claim 1, further including a waist strap to be attached to the elastic cord assembly and to the waist of a user.

5. The exercise system kit of claim 1, further including a door strap to be attached to the elastic cord assembly and to a door.

6. The exercise system kit of claim 1, further including a handle configured to receive at least one of the first and second ends of the elastic.

7. An exercise system comprising:

an elastic having a first end, a second end and a stretch there between, said first end having a first lumen and said second end having a second lumen;

a first plug and a second plug both sized to be larger than said first lumen and said second lumen respectively and for insertion into said first end and said second end respectively;

a beam assembly having a first section with a connector end and a first securement end, a first connector formed at said connector end of said first section, said first connector including a first wall defining a first opening sized to slideably receive said stretch of said elastic there through and to inhibit movement through said opening of said first end with said first plug in said first lumen, a second section with a connector end and a second securement end, said second securement end and said first securement end being configured for mechancial connection one to the other to form a beam, at least one of the first section and the second section having a first surface, a second surface, and rounded edges between the first and second surfaces, the first surface opposing the second surface, the rounded edges connecting the first surface to the second surface on one side and the second surface to the first surface on the other side; and a second connector formed at said connector end of said second section, said second connector including a wall defining a second opening sized to slidably receive said stretch of said elastic there through and to inhibit movement through said second opening of said second end with said second plug in said second lumen.

8. The exercise system of claim 7 wherein said first wall and said second wall each include an slot sized to receive said stretch there sized for passage of said stretch there through to said first opening and said opening.

9. The exercise system of claim 7 wherein said first surface and said second surface each has a planar surface.

10. The exercise system of claim 9 wherein said first section and said second section have a first length and a second length respectively, and wherein said first surface and said second surface extend from said first securement end and said second securement end at least half said first length and half said second length toward said first connector end and said second connector end respectively.

11. The exercise system of claim 10 wherein said first section and said second section have a locking mechanism formed on first securement end and said second securement end.

12. The exercise system of claim 11 wherein said locking mechanism includes an aperture formed in one of said first section and said second section and a button connected to the other of said first section and said second section to register with said aperture with said first section and said second section second section.

13. The exercise system of claim 12 wherein said first surface and said second surface each extend substantially the length of said first section and said second section.

14. The exercise system of claim 7 wherein said first surface and said second surface are continuous arcuate surfaces extending between the rounded edges.

15. The exercise system of claim 7 wherein said first surface and said second surface are convex surfaces extending between the rounded edges.

* * * * *

US007578775C1

(12) EX PARTE REEXAMINATION CERTIFICATE (9254th)

United States Patent
Terry

(10) Number: US 7,578,775 C1
(45) Certificate Issued: Aug. 28, 2012

(54) PERSONAL EXERCISE SYSTEM

(76) Inventor: Douglas C. Terry, Salt Lake City, UT (US)

Reexamination Request:
No. 90/011,673, Jun. 9, 2011

Reexamination Certificate for:

| | |
|---|---|
| Patent No.: | **7,578,775** |
| Issued: | **Aug. 25, 2009** |
| Appl. No.: | **10/934,669** |
| Filed: | **Sep. 3, 2004** |

(51) Int. Cl.
*A63B 21/00* (2006.01)

(52) U.S. Cl. ..... 482/126; 482/121
(58) Field of Classification Search ..... None
See application file for complete search history.

(56) References Cited

To view the complete listing of prior art documents cited during the proceeding for Reexamination Control Number 90/011,673, please refer to the USPTO's public Patent Application Information Retrieval (PAIR) system under the Display References tab.

*Primary Examiner*—Danton DeMille

(57) ABSTRACT

An exercise system includes an elastic cord assembly including an elastic and plugs. The elastic has a first and second end and a stretch between the first and second ends. One of the plugs is inserted into the first end and another one of the plugs is inserted into the second end. At least one strap assembly is slidably attached to the elastic cord assembly. The strap assembly includes a block having an aperture formed from one side to another side of the block forming an unbroken wall through the block. The strap assembly also includes a strap connected to the block in a manner that forms a loop in the strap. The plugs retain the strap assembly on the stretch of the elastic cord assembly between the first and second ends.

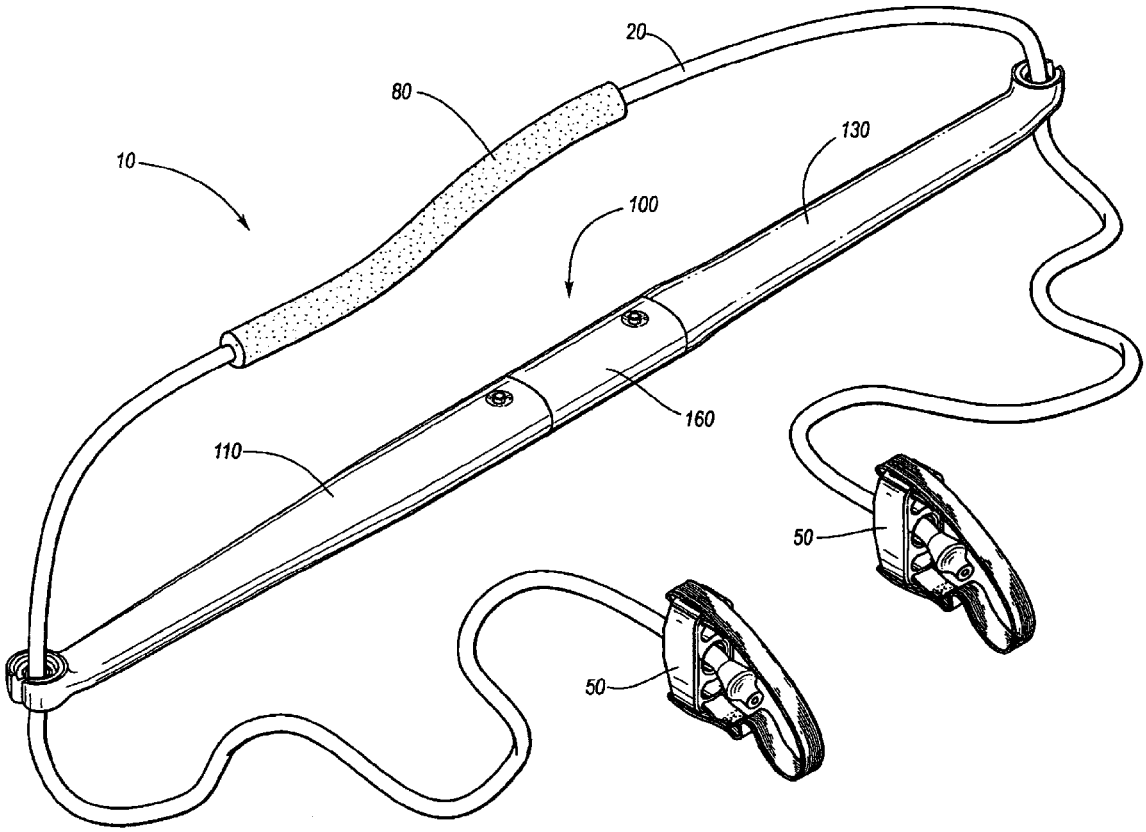

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 2 and 7-15 are cancelled.

Claim 1 is determined to be patentable as amended.

Claims 3-6, dependent on an amended claim, are determined to be patentable.

1. An exercise system kit comprising:

an elastic cord assembly including an elastic and plugs, the elastic having a first and second end and a stretch between the first and second ends, one of the plugs being inserted into the first end and another one of the plugs being inserted into the second end;

at least one strap assembly slidably attached to the elastic cord assembly, the strap assembly including a strap and a block, the block having an aperture formed from one side to another side of the block forming an unbroken wall through the block, the strap being connected to the block in a manner that forms a loop in the strap;

*a cushioning device disposed on the elastic cord assembly between the first and second ends of the elastic;* a beam assembly including a receiver section, a tongue section and a locking device, one end of the receiver section being configured to be connected to one of the first and second ends of the elastic cord assembly and the opposing end of the receiver section being configured to be connected to the tongue section, one end of the tongue section being configured to be connected to the other of the first and second ends of the elastic cord assembly and the opposing end of the tongue section being configured to be connected to the receiver section, at least one of the receiver section and the tongue section having a first surface and a second surface; and illustrations placed on at least one of the first and second surfaces for observation by the user, the illustrations showing various configurations for the user to perform selected exercises.

* * * * *